US007827920B2

(12) United States Patent
Beck et al.

(10) Patent No.: US 7,827,920 B2
(45) Date of Patent: Nov. 9, 2010

(54) WORK SPACE MANAGEMENT AND FURNITURE SYSTEM

(75) Inventors: Robert L. Beck, Zeeland, MI (US); Ayse Birsel, New York, NY (US); Andrew J. Kurrasch, Saugatuck, MI (US); Robert A. Oren, Holland, MI (US); Henry A. Thenikl, Grand Rapids, MI (US); Jeffrey Clark, Holland, MI (US); Richard DeHaan, III, Hudsonville, MI (US)

(73) Assignee: Herman Miller Inc., Zeeland, MI (US)

( * ) Notice: Subject to any disclaimer, the term of this patent is extended or adjusted under 35 U.S.C. 154(b) by 2295 days.

(21) Appl. No.: 09/835,288

(22) Filed: Apr. 13, 2001

(65) Prior Publication Data

US 2002/0011193 A1 Jan. 31, 2002

(51) Int. Cl.
*A47B 37/00* (2006.01)

(52) U.S. Cl. ..... 108/50.02; 108/50.01; 108/64; 312/223.6

(58) Field of Classification Search ..... 108/50.01, 108/50.02, 64, 180, 182, 153.1; 312/223.6, 312/223.3, 196, 195; 52/36.1, 36.6, 234, 52/243

See application file for complete search history.

(56) References Cited

U.S. PATENT DOCUMENTS

| | | | |
|---|---|---|---|
| 703,023 | A | 6/1902 | Wade |
| 785,571 | A | 3/1905 | Raines et al. |
| 1,098,516 | A | 6/1914 | Matthews |
| 1,506,502 | A | 8/1924 | Rheinberger |
| 1,578,117 | A | 3/1926 | Gahring |
| 1,994,981 | A | 3/1935 | Cook |
| 2,187,408 | A | 1/1940 | Thumm |
| 2,636,224 | A | 4/1953 | Murdoch et al. |
| 2,754,535 | A | 7/1956 | Plemeng |
| 3,017,969 | A | 1/1962 | Nielsen |
| 960,490 | A | 3/1963 | Jones |

(Continued)

FOREIGN PATENT DOCUMENTS

| | | | |
|---|---|---|---|
| DE | 2848929 | A1 | 5/1980 |

(Continued)

OTHER PUBLICATIONS

ISA/US, International Search Report for parent International Patent Application No. PCT/US99/23793 mailed Mar. 6, 2000.

(Continued)

*Primary Examiner*—José V Chen
(74) *Attorney, Agent, or Firm*—Leydig, Voit & Mayer, Ltd.

(57) ABSTRACT

A system for defining a plurality of work zones within an otherwise open area. The system includes a framework formed from a plurality of spaced apart poles extending upward from a base surface. The poles are interconnected by a plurality of crossbeams at a height substantially above a standing user. At least some of the poles are adapted to provide a raceway for the delivery of utilities. The framework is capable of being arranged in a plurality of substantially non-linear patterns and includes an at least partially open area between adjacent poles.

15 Claims, 50 Drawing Sheets

U.S. PATENT DOCUMENTS 3,180,459 A 4/1965 Liskey, Jr.
3,181,274 A 5/1965 Izenour
3,195,698 A 7/1965 Codrea
3,361,508 A 1/1968 Chassevent
3,396,731 A 8/1968 Peebles
3,418,765 A 12/1968 Propst et al.
3,478,993 A 11/1969 Wyeroski et al.
3,561,518 A 2/1971 Johnson
3,683,100 A 8/1972 Deal et al.
3,770,334 A 11/1973 Weber
3,786,934 A 1/1974 Burgin
3,858,528 A 1/1975 Petersen
3,875,711 A 4/1975 Palmer
4,001,987 A 1/1977 Coulthard
4,015,397 A 4/1977 Flachbarth et al.
4,021,973 A 5/1977 Hegg et al.
4,060,294 A 11/1977 Haworth et al.
4,092,486 A 5/1978 Meyers
4,224,769 A 9/1980 Ball et al.
4,252,989 A 2/1981 Blumenthal
4,284,840 A 8/1981 Baker
4,295,307 A 10/1981 Jensen
4,302,865 A 12/1981 Dixon et al.
4,372,087 A 2/1983 Kump
4,373,570 A 2/1983 Nussdorf et al.
4,457,116 A 7/1984 Kump
4,470,232 A 9/1984 Condevaux et al.
4,493,174 A 1/1985 Arens
4,516,620 A 5/1985 Mulhern
4,606,394 A 8/1986 Bannister
4,639,049 A 1/1987 Frascaroli et al.
4,685,255 A 8/1987 Kelley
4,761,922 A 8/1988 Black
4,762,072 A 8/1988 Boundy et al.
4,771,583 A 9/1988 Ball et al.
4,774,792 A 10/1988 Ballance
4,807,540 A 2/1989 Priesemuth
RE32,890 E 3/1989 DeFouw et al.
4,831,791 A 5/1989 Ball
D302,496 S 8/1989 Tingley
4,852,500 A 8/1989 Ryburg et al.
4,856,242 A 8/1989 Baloga et al.
4,863,223 A 9/1989 Weissenbach et al.
4,870,908 A 10/1989 Wolters et al.
4,874,027 A 10/1989 Boundy et al.
4,876,835 A 10/1989 Kelley et al.
4,879,955 A 11/1989 Moll et al.
4,914,873 A 4/1990 Newhouse
4,924,931 A 5/1990 Miller
4,957,333 A 9/1990 Hsu et al.
5,016,405 A 5/1991 Lee
5,016,947 A 5/1991 Hsu et al.
5,037,164 A 8/1991 Weissenbach et al.
5,038,539 A 8/1991 Kelly et al.
5,044,135 A 9/1991 Kroon et al.
5,058,331 A 10/1991 Epps
5,058,347 A 10/1991 Schuelke et al.
5,065,832 A 11/1991 Mark
5,078,055 A 1/1992 Bellini et al.
5,094,174 A 3/1992 Grund et al.
5,097,643 A 3/1992 Wittler
5,103,741 A 4/1992 Grund et al.
5,144,896 A 9/1992 Fortsch
5,150,554 A 9/1992 Quinlan, Jr. et al.
5,152,698 A 10/1992 Juhlin et al.
5,157,273 A 10/1992 Medendorp et al.
5,160,188 A 11/1992 Rorke et al.
5,164,609 A 11/1992 Poppe et al.
D331,672 S 12/1992 Brodbeck
D331,842 S 12/1992 Brodbeck
D332,188 S 1/1993 Brodbeck
5,209,035 A 5/1993 Hodges et al.
5,220,871 A 6/1993 Grund et al.
5,226,705 A 7/1993 Rorke et al.
5,253,595 A 10/1993 Heidmann
5,277,006 A 1/1994 Ruster
5,277,131 A 1/1994 Fortsch
5,279,231 A 1/1994 Kolvites et al.
5,282,341 A 2/1994 Baloga et al.
5,287,666 A 2/1994 Frascaroli et al.
5,291,838 A 3/1994 Ferchau et al.
5,318,259 A 6/1994 Fussler
5,328,260 A 7/1994 Beirise
5,341,615 A 8/1994 Hodges et al.
5,352,033 A * 10/1994 Gresham et al. ..... 108/50.01
5,354,025 A 10/1994 McCaffrey
5,362,923 A 11/1994 Newhouse et al.
5,393,013 A 2/1995 Schneider et al.
5,394,658 A 3/1995 Schreiner et al.
5,403,082 A 4/1995 Kramer
5,406,760 A 4/1995 Edwards
5,416,666 A 5/1995 Maguire, Jr.
5,451,101 A 9/1995 Ellison et al.
5,452,547 A 9/1995 Baloga et al.
5,473,994 A 12/1995 Foley et al.
5,487,246 A 1/1996 Hodges et al.
5,511,348 A 4/1996 Cornell et al.
5,522,324 A * 6/1996 van Gelder et al. ..... 108/50.02
5,530,435 A 6/1996 Toms et al.
5,544,593 A 8/1996 Canfield et al.
5,561,960 A 10/1996 Minnick et al.
5,606,919 A 3/1997 Fox et al.
5,606,920 A 3/1997 Meyer et al.
5,626,404 A 5/1997 Kelley et al.
5,638,758 A 6/1997 Carr
5,638,759 A 6/1997 Klugkist
D380,630 S 7/1997 Ahrensburg
5,651,219 A 7/1997 Baloga et al.
5,660,120 A 8/1997 Sims
5,671,579 A 9/1997 Miranda Cambino et al.
5,673,632 A 10/1997 Sykes
5,675,949 A 10/1997 Forslund et al.
5,681,017 A 10/1997 Clausen
5,684,469 A 11/1997 Toms et al.
5,685,113 A 11/1997 Reuter et al.
5,689,926 A 11/1997 Nichols
5,695,261 A 12/1997 Slesinger et al.
5,704,298 A 1/1998 Corpuz, Jr. et al.
5,715,760 A 2/1998 Frascaroli et al.
5,724,778 A 3/1998 Cornell et al.
5,752,449 A 5/1998 Simon et al.
5,768,840 A 6/1998 Feldpausch et al.
5,784,843 A 7/1998 Greer et al.
5,791,259 A 8/1998 Mansfield et al.
5,802,778 A 9/1998 Thorp et al.
5,809,708 A 9/1998 Greer et al.
5,816,000 A 10/1998 Izatt et al.
5,875,597 A 3/1999 Gingrich et al.
5,899,025 A 5/1999 Casey et al.
5,943,966 A 8/1999 Machado et al.
5,974,742 A 11/1999 Schreiner et al.
6,062,147 A 5/2000 Footitt et al.
6,076,903 A * 6/2000 Vander Park ..... 108/50.02
6,101,954 A * 8/2000 Rein et al. ..... 108/50.02
6,109,456 A 8/2000 Heinz
6,170,200 B1 1/2001 Cornell et al.
6,170,410 B1 * 1/2001 Gioacchini et al. ..... 108/50.01
6,206,206 B1 3/2001 Saylor et al.
6,213,191 B1 4/2001 Nitzsche
6,267,064 B1 * 7/2001 Ostertag et al. ..... 108/50.02
6,276,102 B1 8/2001 Shipman et al.
6,279,643 B1 8/2001 Shipman
6,301,846 B1 10/2001 Waalkes et al.
6,352,323 B1 3/2002 Rives

| | | | | |
|---|---|---|---|---|
| 6,382,747 | B1 * | 5/2002 | Catta et al. | 108/50.02 |
| 6,460,470 | B1 * | 10/2002 | Scharer et al. | 108/50.01 |

FOREIGN PATENT DOCUMENTS

| | | | |
|---|---|---|---|
| DE | 39007770 | C1 | 3/1989 |
| DE | 4039097 | A1 | 6/1991 |
| DE | 19646541 | C1 | 10/1996 |
| JP | 58-44941 | | 3/1983 |
| JP | 4-193205 | * | 7/1992 |
| JP | 8-19438 | | 1/1996 |
| JP | 10-201541 | | 8/1998 |
| JP | 10-262744 | | 10/1998 |
| JP | 06240786 | A | 3/2003 |

OTHER PUBLICATIONS

European Patent Office; Search Report for cognate EP Application No. 99953147.8 mailed Oct. 17, 2001.

Japanese Patent Office, Official Action for cognate JP Application No. 2000-575397 dated Aug. 11, 2009, partial translation by Nakamura & Partners, Sep. 29, 2009.

* cited by examiner

FIG. IB
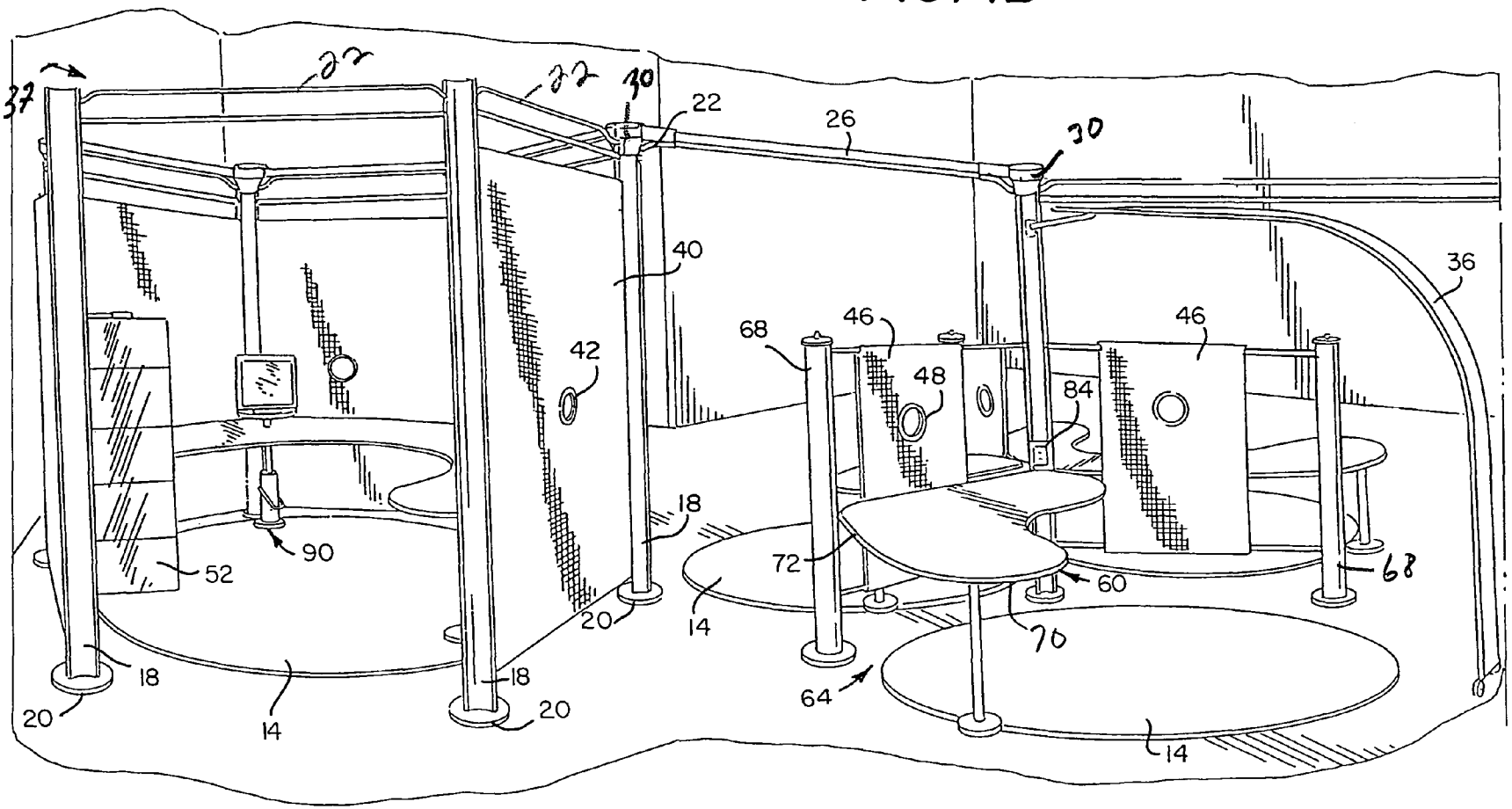

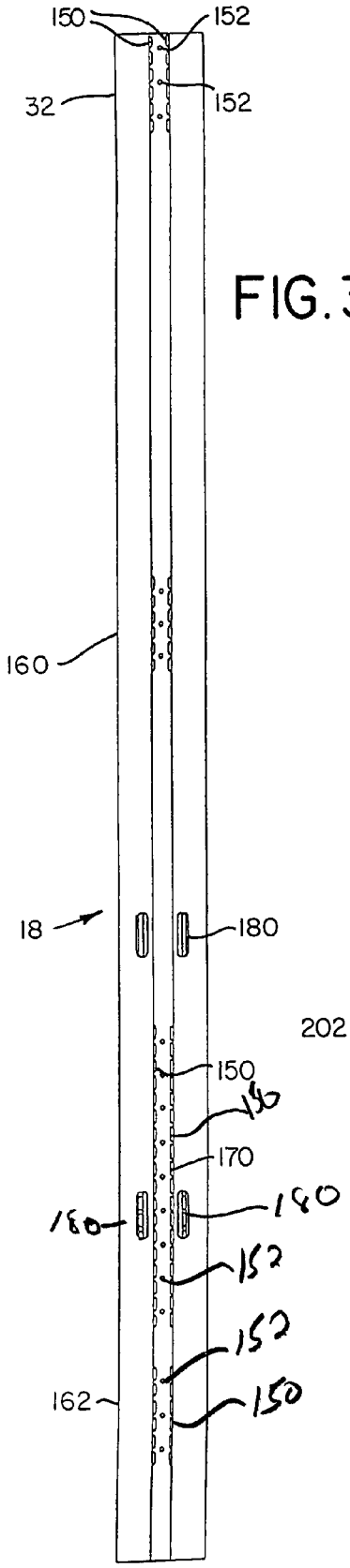
FIG. 3
FIG. 4
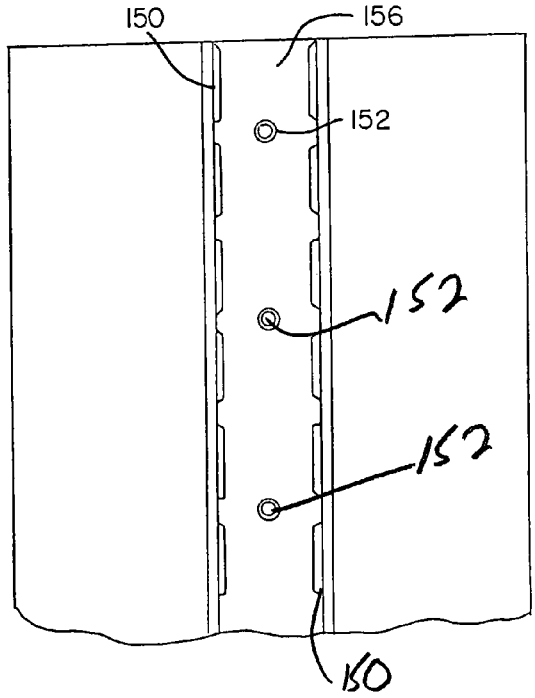
FIG. 5
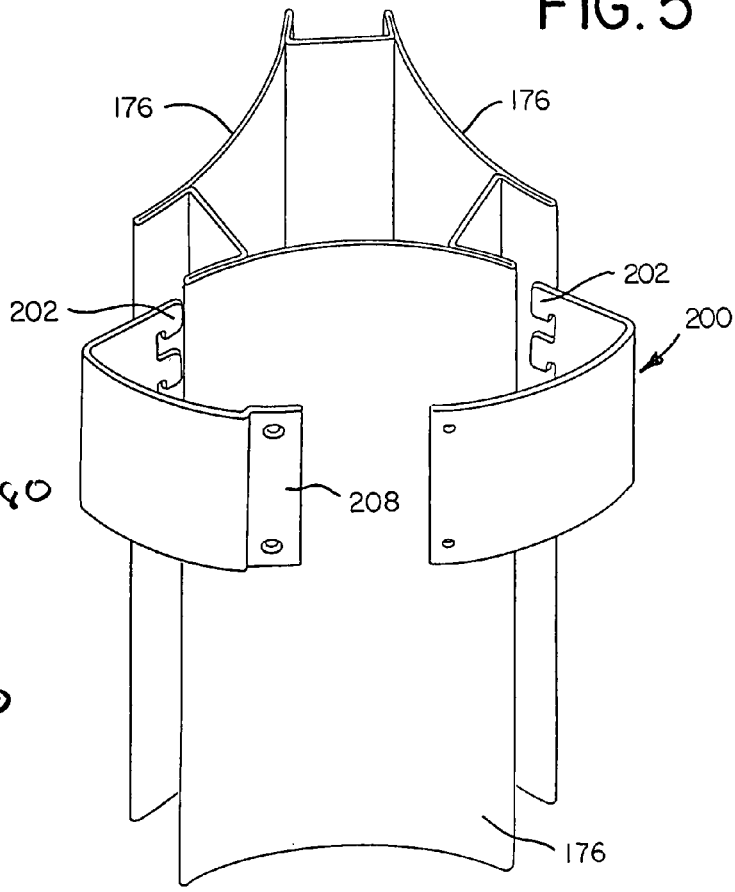

FIG. 16
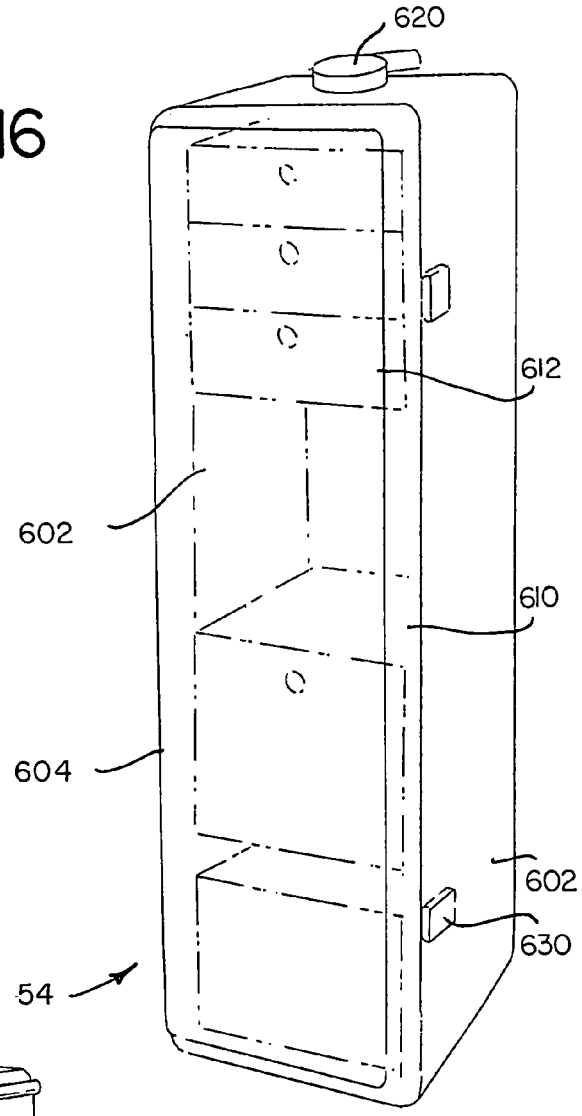
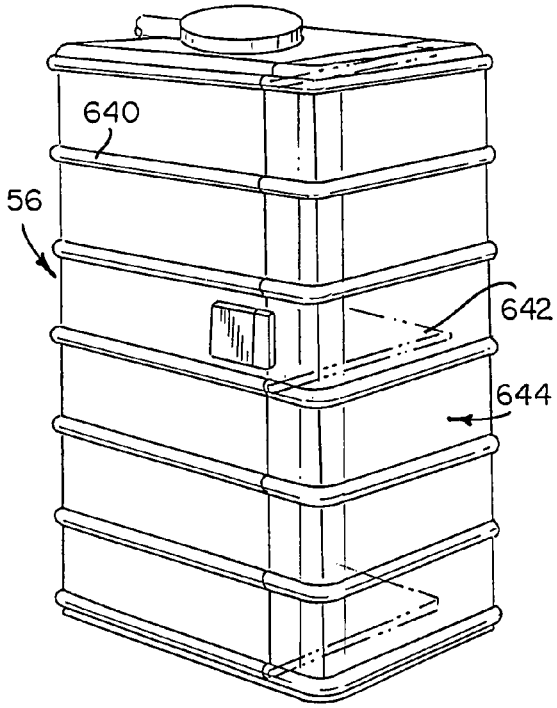
FIG. 16A

| |
|---|
| FIG. 26 |
| FIG. 27 |

| FIG.40A | FIG.40B |
|---|---|

FIG.41
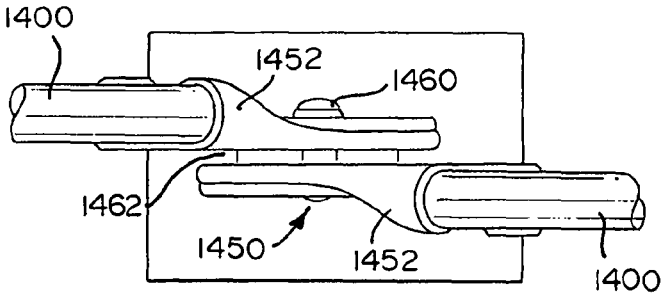
FIG. 48A
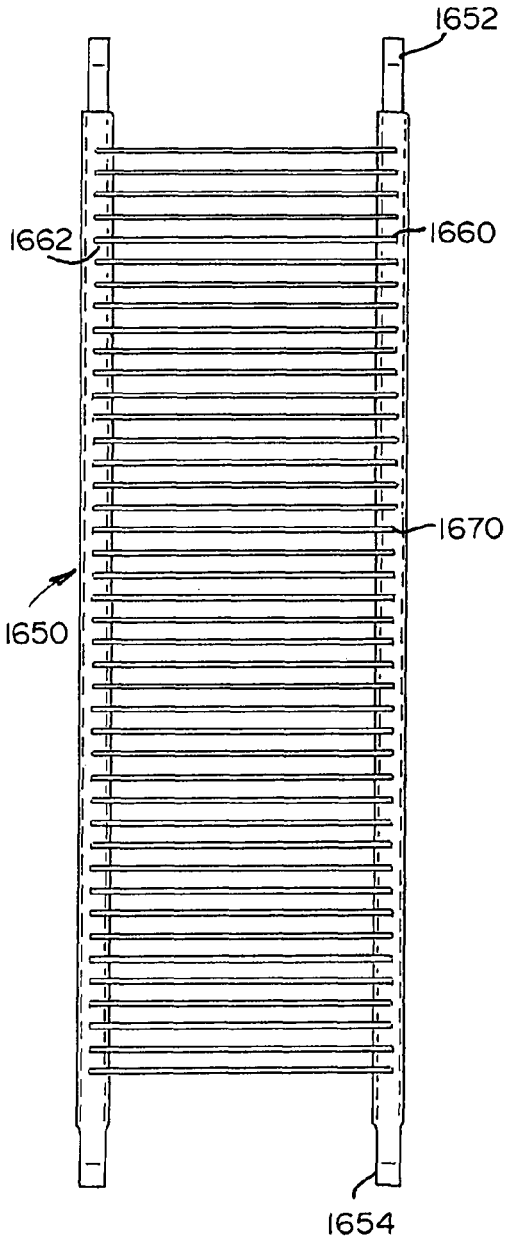
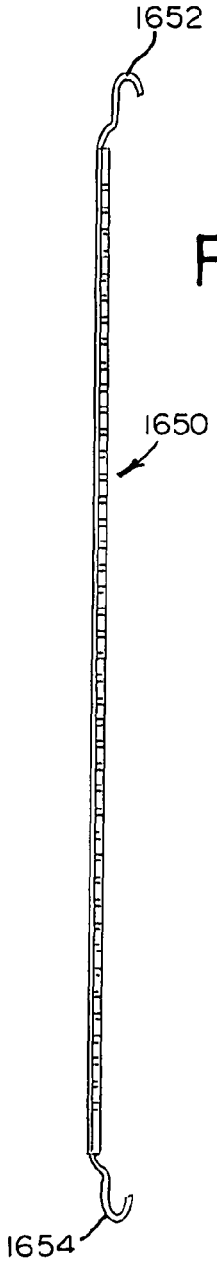
FIG. 48B

| FIG. 42A | FIG. 42B |
|---|---|

WORK SPACE MANAGEMENT AND FURNITURE SYSTEM

RELATED APPLICATIONS

This application claims the benefit of Provisional Application No. 60/104,101 filed on Oct. 13, 1998 and PCT/US99/23793 filed on Oct. 13, 1999, pursuant to 35 U.S.C. §§119(e) and 120. The disclosures of these applications are hereby incorporated by reference.

BACKGROUND OF THE INVENTION

The present invention relates to a system for the arrangement of work spaces within an open office. In particular, this invention relates to a utilities and furniture system adapted to simultaneous multi-purpose uses and, at the same time, capable of providing easy changeover to a plurality of configurations and uses.

Because the concept of what is considered an appropriate working environment is rapidly changing, it is necessary that any system of arranging and defining work areas be capable of many different configurations allowing rapid changeover from one arrangement to another. Such systems must be flexible enough to accommodate different work activities and tools. In addition, such systems must be easily assembled or reconfigured into a plurality of space efficient plans.

Previous systems have failed to adequately provide a flexible and efficient use of an open area workspace. For example, it has been known to erect permanent or semi-permanent space dividing walls and then to furnish each individual work area created by these walls with furniture. The furniture used in these systems has been of the conventional type, entirely or substantially independent of the walls. Such arrangements were tolerable under circumstances in which the requirements of the activities performed within the work spaces remained relatively static over long periods of time.

Open plan office systems or systems furniture typically provide a series of rigid panels which are in turn rigidly connected together at facing edges to divide work spaces into work or task areas. The panels are coupled together at facing edges for straight lane rectangular coupling. Vertical slots are provided at the facing edges to support brackets for hanging cabinets, shelves and work surfaces to efficiently use the space.

Although systems furniture remains a viable solution for many office environments, some business organizations have functional and esthetic requirements which cannot be practically or commercially met by such a product. In particular, the increasing use of computer equipment and work teams results in the need for an extremely flexible system. As computer technology spreads throughout the office, there is an increasing need to link a diverse range of users with electronic equipment and databases. This need is solved by a local network of communication and electrical wiring which must be easy to install, adaptive to easy change and capable of delivering cabling to individual users at a convenient location. Many current open plan systems do not meet this requirement.

The use of built-in or semi-built-in space dividing systems and of conventional system furniture immediately creates a problem when a change is to be made. The cost and time requirements of changing the space divider systems is often so great that necessary and desirable changes frequently are not made. Furniture of the conventional type is static in design, often usable only for a single purpose. When not in use, conventional furniture is bulky and requires substantial storage space.

In addition, most previous systems could only be organized into a limited number of rectilinear patterns because they were based upon a format whereby panels, and work surfaces line up at 90 degree corners. As a result, the number of work areas within an open space can be limited. The rectilinear construction can also create a lot of unusable space because of its shape. Lastly, both the space separation means and the furnishings, are often used long after they have attained functional obsolescence because of the cost of reorganization and replacement.

Therefore, there is a need for a system that defines work areas capable of efficiently organizing workers within a flexible work area while being easily assembled or reorganized.

SUMMARY OF THE INVENTION

The present invention is directed to an improved assembly that provides an increased efficiency and flexibility over previous open plan furniture systems.

According to a first aspect of the present invention, a system for defining a plurality of work zones within an otherwise open area is provided. The system includes a framework formed from a plurality of spaced apart poles extending upward from a base surface. The poles are interconnected by a plurality of crossbeams at a height substantially above a standing user. At least some of the poles are adapted to provide a raceway for the delivery of utilities. The framework is capable of being arranged in a plurality of substantially nonlinear patterns and includes an at least partially open area between adjacent poles.

According to another aspect of the invention, a system for defining a plurality of work zones within an otherwise open area is provided. The system includes a framework formed from a plurality of spaced apart poles extending upward from a base surface with an at least partially open area defined between adjacent poles. The poles are interconnected by a plurality of crossbeams at a height substantially above a standing user. At least some of the poles and crossbeams are adapted to provide a raceway for the delivery of power and data cabling. The framework is capable of being configured in a plurality of nonlinear patterns in order to form a work area for a group of users.

According to yet another aspect of the invention, a work space management and furniture system is provided. The system includes a plurality of spaced apart poles extending upward from a base surface with an at least partially open area defined between adjacent poles. The poles are interconnected by a plurality of crossbeams. The crossbeams are adapted to be attached to the poles such that most groups of two crossbeams form an obtuse angle. At least some of the poles and crossbeams are attached to a work environment element selected from the group consisting of: work surfaces, storage members, monitor support members, and dividing screens.

As used herein the term "accessories" is intended to be interpreted broadly and include elements such as signage, garbage bins, shelves, personal storage organizers, telephone trays, personal shelves, marker boards, clocks, frames, fans and other known elements.

As used herein the term "utilities" is intended to be interpreted broadly and include elements such as power, data, HVAC and other known utility elements.

As used herein, the term "an angle of 120 degrees" or other similar language is intended to include angles substantially equal to 120 degrees, such as 115 degrees or 125 degrees.

The present invention, together with attendant objects and advantages, will be best understood with reference to the detailed description below in connection with the attached drawings.

BRIEF DESCRIPTION OF THE DRAWINGS

FIGS. 1A and 1B illustrate an elevated side view of the system constructed in accordance with a preferred embodiment of the present invention.

FIG. 3 is an side view of a pole constructed in accordance with the preferred embodiment.

FIG. 4 is an enlarged view illustrating the attachment apertures used to connect work environment elements to the pole.

FIG. 5 illustrates an attachment mechanism for use with the pole.

FIG. 16 illustrates a preferred embodiment of a large rigid storage member useful with the system of the present invention.

FIG. 16A illustrates a preferred embodiment of a midsize rigid storage member useful with the system of the present invention.

FIG. 41 illustrates the interconnection of the two portions of the rolling barrier member illustrated in FIG. 40.

FIG. 48 illustrate a front perspective and side views of a tool bar useful with the system shown in FIGS. 1A-E.

DETAILED DESCRIPTION OF THE PREFERRED EMBODIMENTS

Figure 1A:
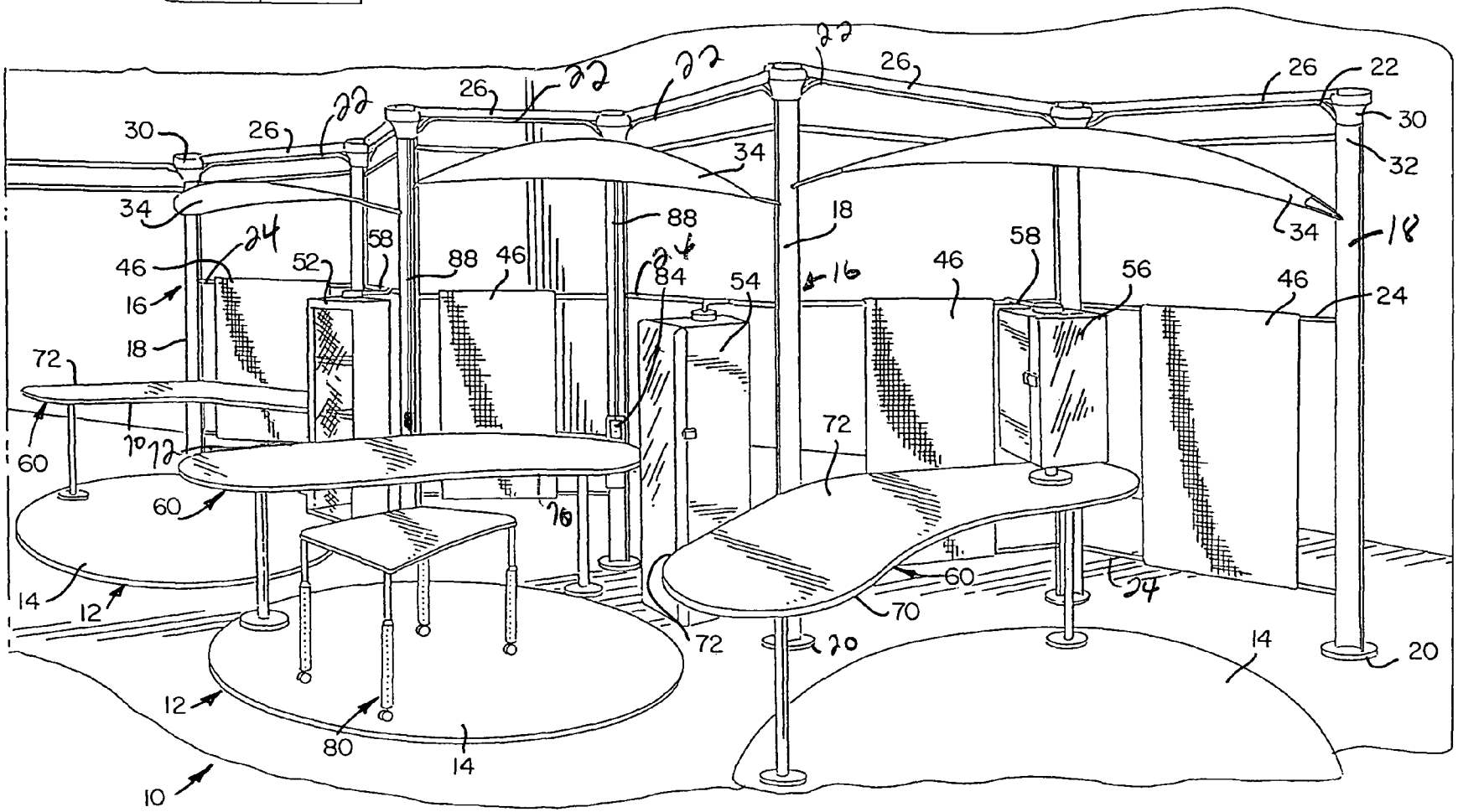

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings. It should also be understood that the drawings are not to scale and in certain instances details have been omitted which are not necessary for an understanding of the present invention such as conventional details of fabrication and assembly.

The present invention is directed to a unique system 10 that divides up space into a plurality of work areas 12. Floor mats 14 are used to assist in the installation of the system 10 and to define personal space for each user. A three-dimensional framework 16 including poles 18 and crossbeams 22, 24 separates the space for each user and provides for the distribution of utilities. Once assembled, the system 10 is self-supporting and does not depend on architecture or interior design elements of the space for stability. The system 10 is an open-end system adding a geometry formed primarily on the use of a 120-degree angle. The 120-degree angle provides the most economical and structurally sound geometry for the connection of poles 18 and crossbeams 22, 24. The system 10 is capable of creating a plurality of workspaces of identical characteristics or unique characteristics and is also extremely effective in achieving high room densities for users.

The system 10 is also characterized by a novel ability to be easily moved, changed or restyled without removing or disconnecting the mainframe work. The system 10 is designed and engineered to be sufficiently lightweight such that it can be carried and moved by one installer.

By way of example, the system 10 illustrated in the figures defines a plurality of work areas 12. The work areas 12 can be at least partially defined by the floor mats 14. The floor mats 14 help with installation by aiding the layout of the floor plan of the office. The floor mats 14 also help by defining personal work areas for the users. The floor mats 14 can also be constructed from resilient and sound absorbing material.

Adjacent the floor mats 14 is the framework 16 that interconnects adjacent work areas and forms the basis for the system 10. The framework 16 includes a plurality of vertically extending poles 18 extending upward from base members 20. A plurality of crossbeams such as the upper crossbeam 22 and the lower crossbeam 24 interconnect adjacent poles 18. The upper crossbeam 22 includes trough 26 through which utilities pass. The connection of crossbeams 22, 24 to poles 18 is at the pre-defined 120-degree angle. This self-defined, angular orientation provides for unique capabilities such as the use of space by a large number of users as well as creating a relatively easy installation process.

An aesthetic cover 30 may be attached to an upper portion 32 of the pole 18. A movable canopy 34 and rotatable canopy 36 may also be attached to the upper portion 32 of the pole 18. The canopies 34 and 36 are capable of providing privacy or openness depending on their positioning. In areas having high ceiling spaces, they also help to bring the work area 12 to a more human sized perspective. Moreover, the canopies 34, 36 can provide an acoustical barrier for the workspace and neutralize screen glares from monitors.

With particular reference to the room 36 as illustrated in FIG. 1B, an upper crossbeam 22 may also be attached to a barrier member 40. The illustrated barrier member 40 includes centrally positioned apertures 42. The lower crossbeams 24 as illustrated in the figures may also include barrier members 46. The barrier members 40, 46 can provide various functions such as privacy, sound adsorption or storage features through the use of Velcro and connection members. Optionally, the barrier members 46 may be translucent, porous to air and include an aperture 48. Another preferred barrier member 49 is illustrated in FIG. 1C.

The lower crossbeams 24 may also be used for attachment to storage members 52, 54 and 56. An arm 58 is attached to the lower crossbeam 24 and extends outward therefrom. The storage members 52, 54 and 56 are attached in a manner such that they may be rotated by the user to a selected position. Other accessory elements may be attached to the crossbeams 22 and 24. A plurality of work surfaces 60 are shown attached to the poles 18. With particular reference to the work surface arrangement 64 illustrated in FIG. 1B, the work surfaces 60 may be attached to short poles 68 having a height substantially less than the pole 18. The work surface 60 has a curved front edge 70. The rear edge 72 is angled to generally form a 120 degree angle. The 120 degree angle conforms with the 120 degree angle that is defined by any two crossbeams 22, 24 or a group of three poles 18.

Figure 1C:
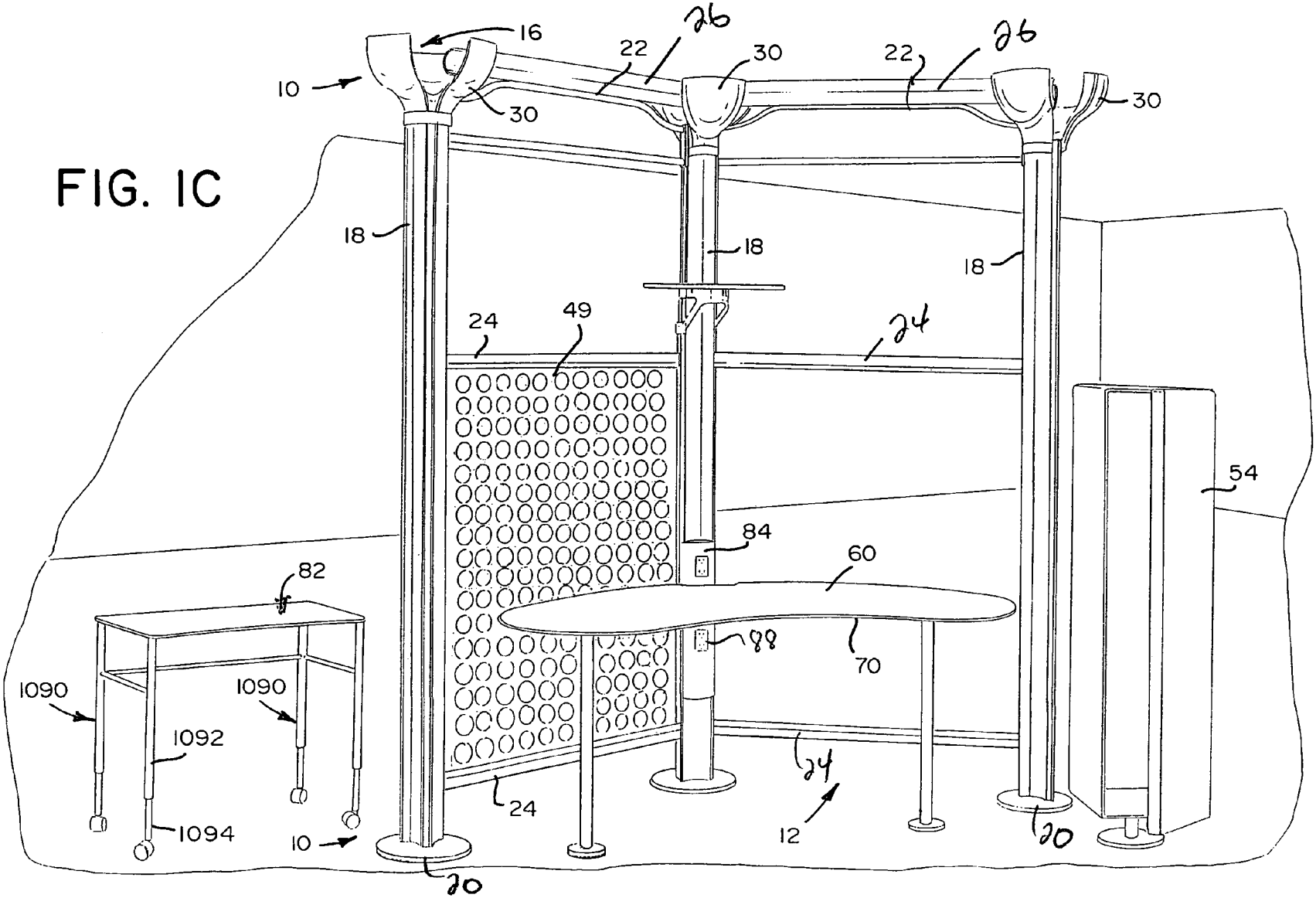
FIGS. 1C and 1D-E illustrate elevated side views of the system constructed in accordance with additional preferred embodiments of the present invention.

A movable work surface 80 is illustrated in FIG. 1A. The movable work surface 80 is adjustable both vertically and angularly. The movable work surface 80 allows the user to customize the movable work surface 80 to his or her body type and to the type of work being conducted. In particular, the movable work surface 80 is capable of supporting a keyboard and mouse or other work area implements such as a pen and paper. The movable nature of the work surface 80 allows the user to be at a distance and a viewing angle from a monitor and therefore provides a unique freedom and mobility. The preferred embodiment includes a shape such that it follows the contours of a user's body. When unused, the movable work surface 80 can be easily be stored under a larger work surface 60. In the alternative, multiple movable work surfaces 80 may be grouped together to form a larger meeting table. An alternate moveable work surface embodiment 82 is illustrated in FIG. 1C.

The poles 18 provide for the distribution of utilities such to the power receptacles 84 or data lines 88. The system 10 also provides for an easy access to utilities from walls, ceilings, floors or other elements. The utilities can be easily routed anywhere within the system to serve the needs of a particular user. Commercial power cabling and connectors useful with the system 10 are available from sources such Pent Inc. of Kendallville, Ind.

Again referring to the room 36, a monitor lift 90 is also illustrated. The monitor lift 90 is preferably attached to the pole 18. Monitor lifts can be used within the system 10 of the present invention which are not attached to a pole 18. Monitor lifts as shown in FIGS. 17-24 enable a worker to use a computer and monitor setup without the need for a horizontal work surface. Alternatively, a monitor lift can be incorporated within a work surface 60 such that a greater surface area of the work surface 60 is available to the user (see FIGS. 21-24). Monitor lifts can be either free standing or anchored to the framework. Monitor lifts can also allow for rotation to different display angles. The adjustment feature on the monitor lifts allows the user to work from a variety of positions including both sitting and standing.

Figure 1D:
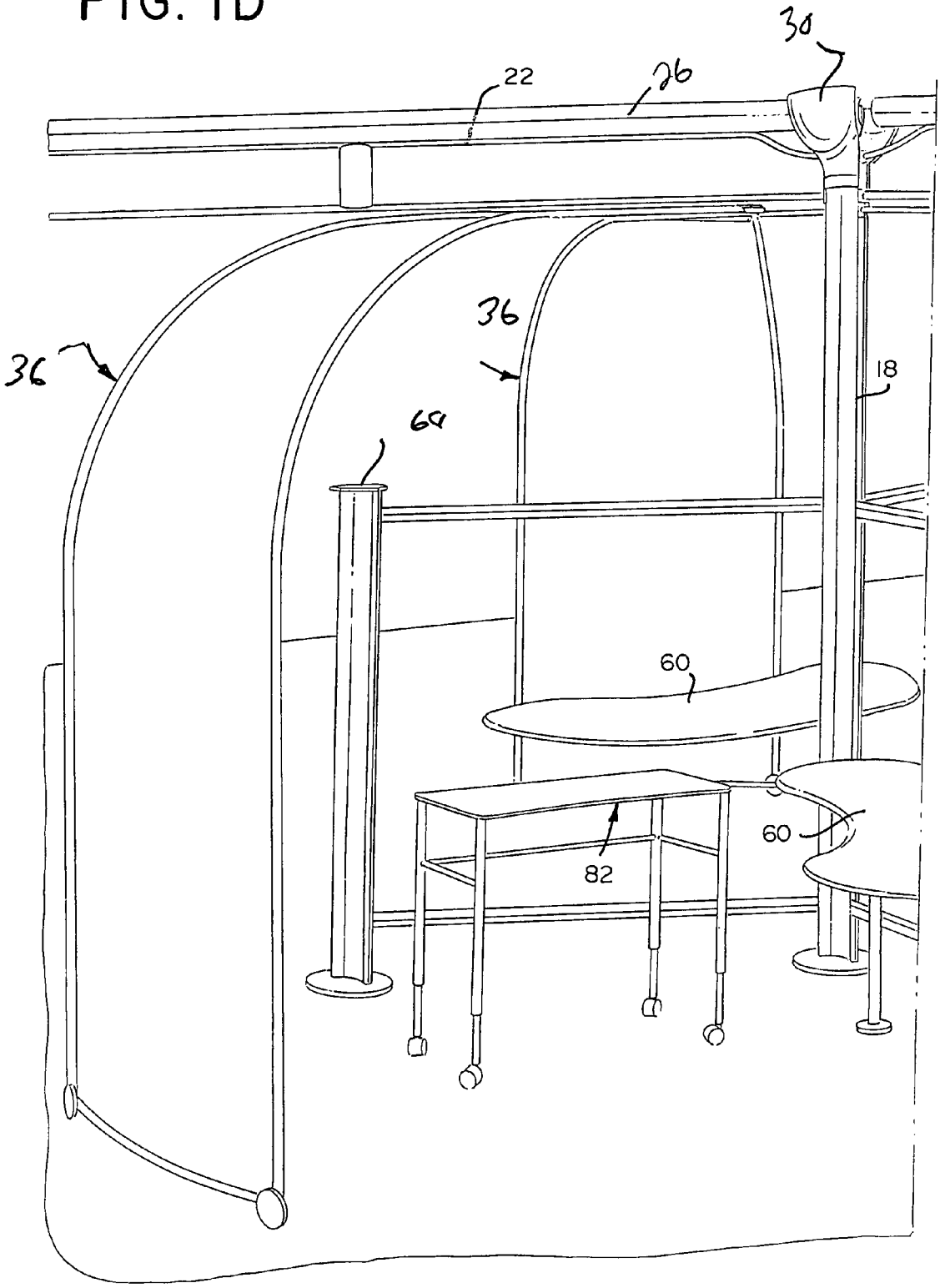
Figure 1E:
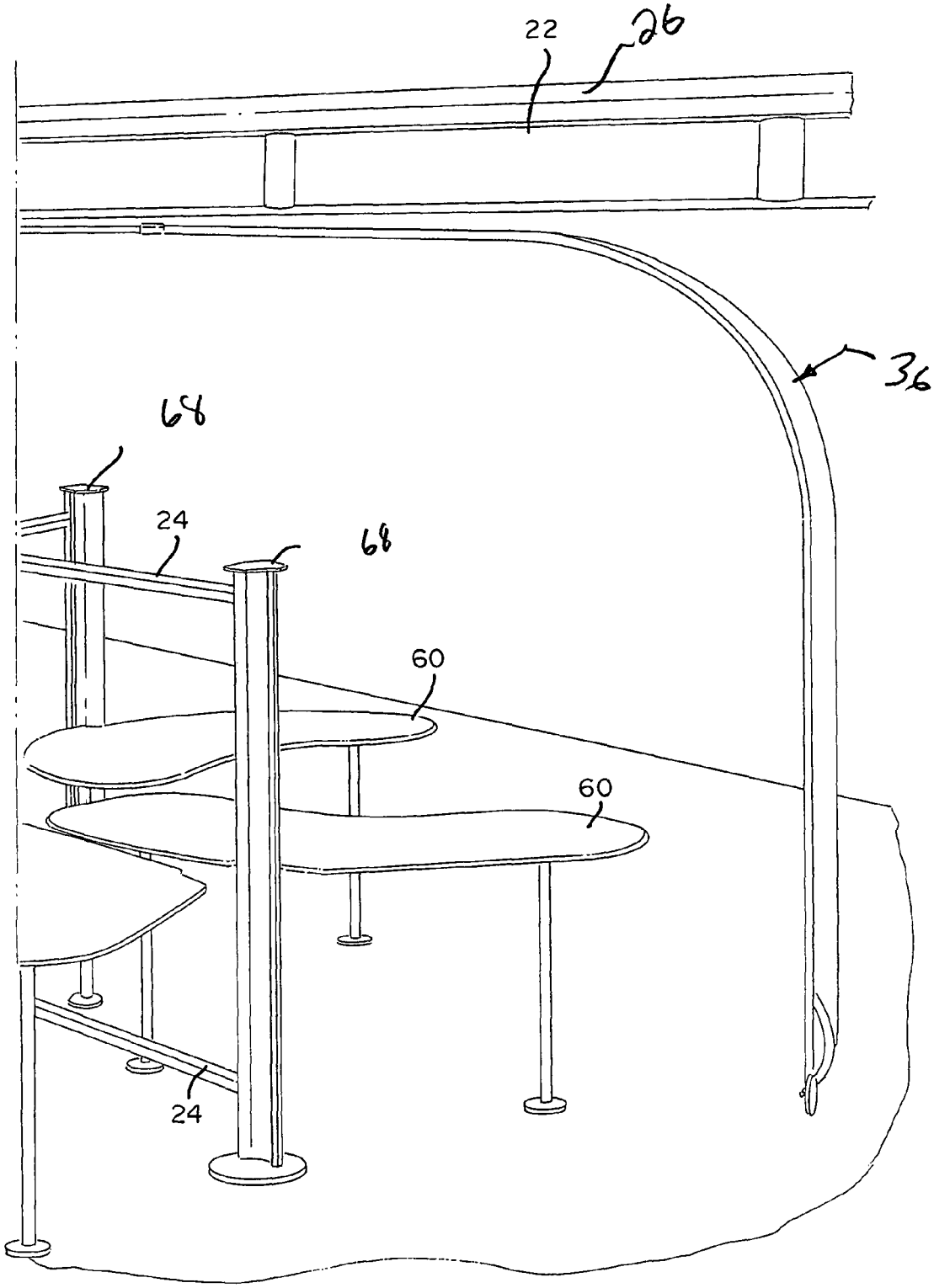

FIGS. 1D-E also illustrate moveable barrier member 104. The moveable barrier member 104 can be rolled to a wide variety of positions in order to substantially or partially enclose a work area 12.

Figures 2A, 2B, 2C, 2D, 2E, 2F, 2G, 2H, 2I:
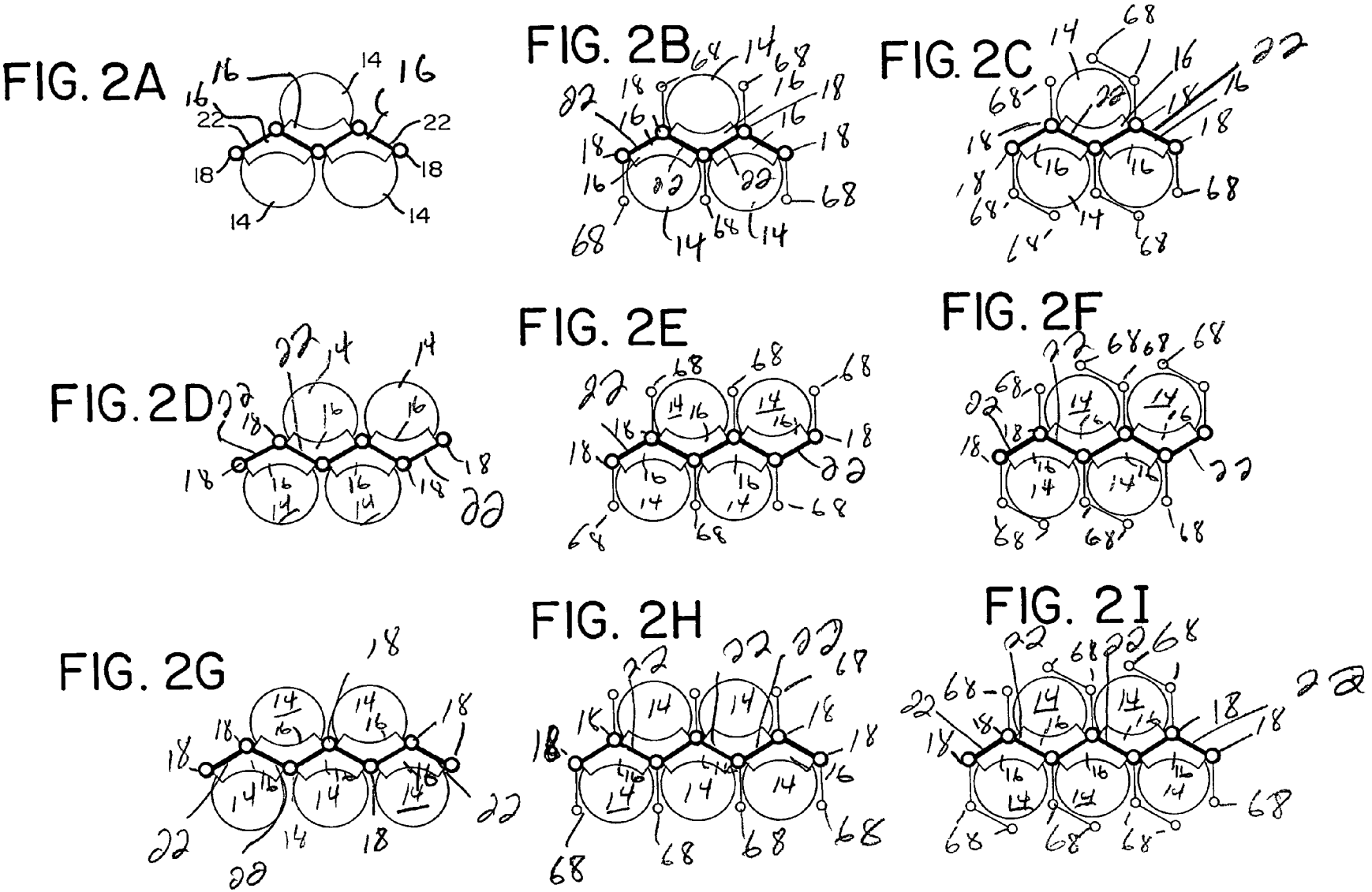
FIGS. 2A-2XX are an illustration of a plurality of office layout configurations using the framework of the preferred embodiment as illustrated in FIG. 1.
Figure 2J:
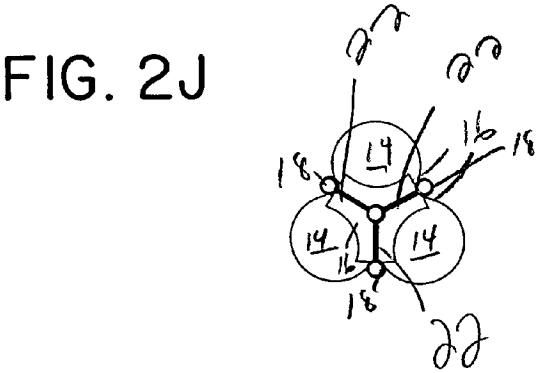
Figure 2K:
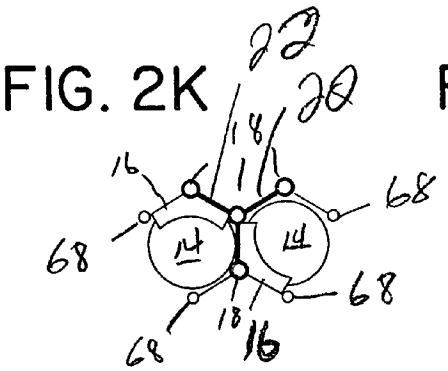
Figure 2L:
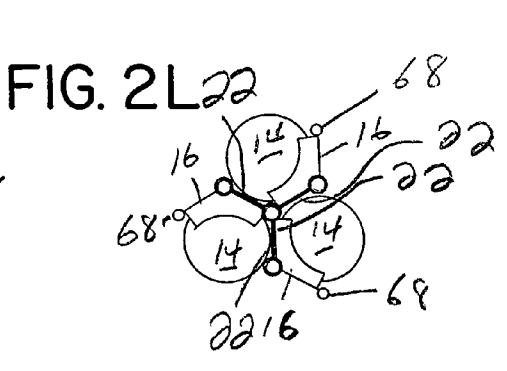
Figure 2M:
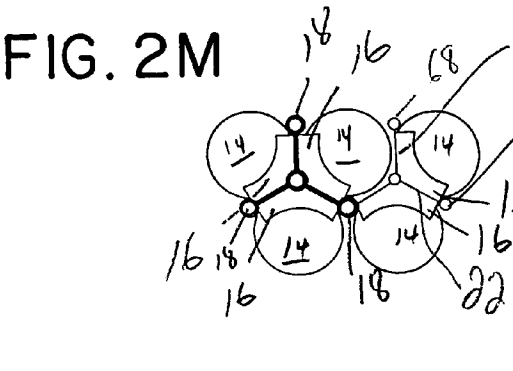
Figure 2N:
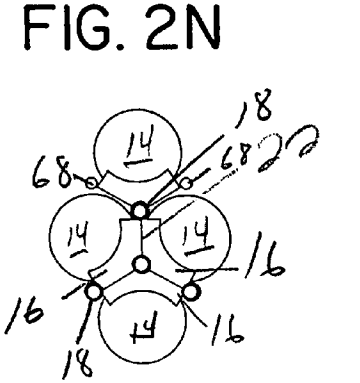
Figure 2O:
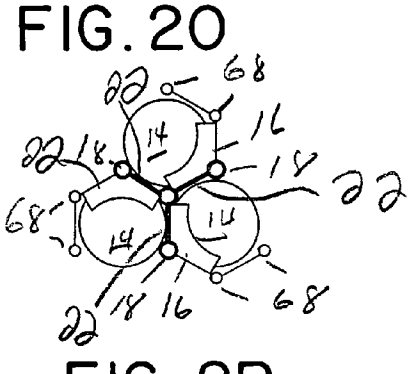
Figure 2P:
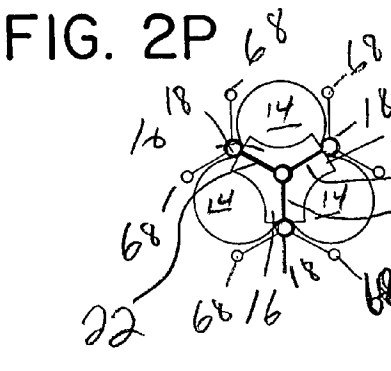
Figure 2Q:
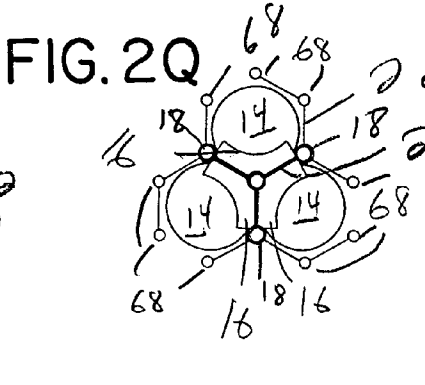
Figure 2R:
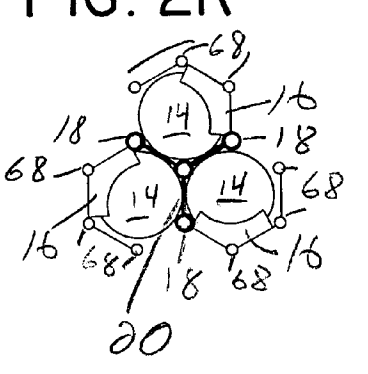
Figure 2U:
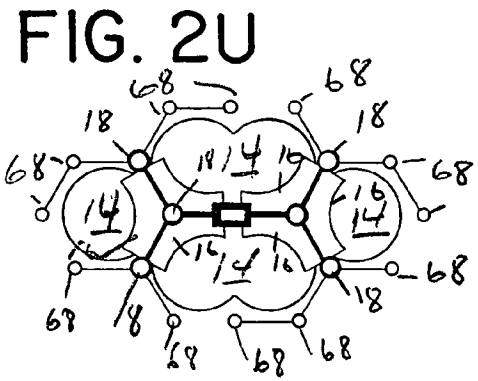
Figure 2T:
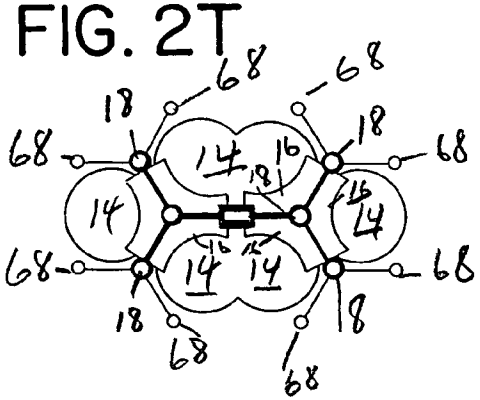
Figure 2S:
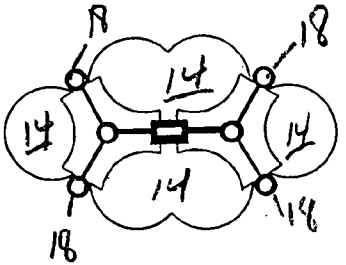
Figure 2W:
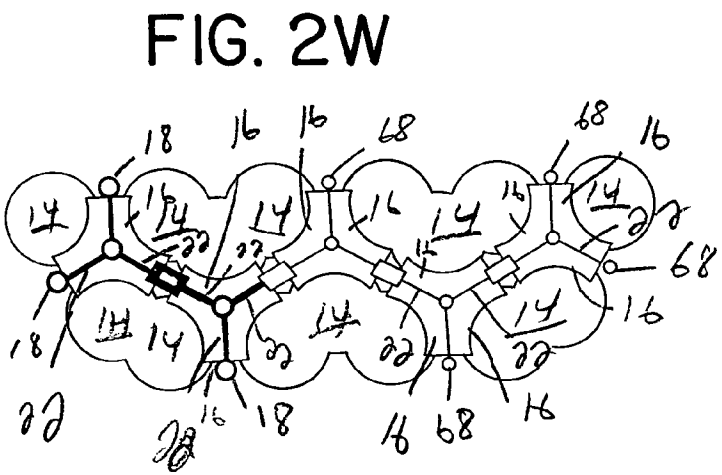
Figure 2V:
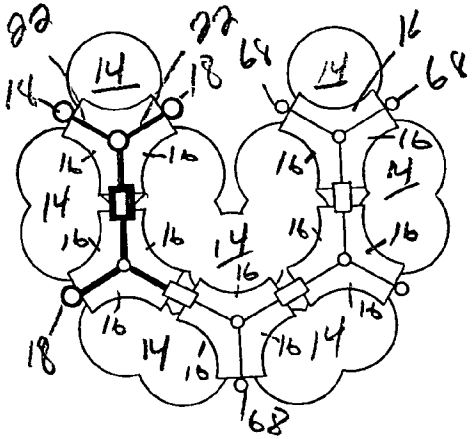
Figures 2A, 2B, 2C, 2D, 2E, 2X, 2Y, 2Z:
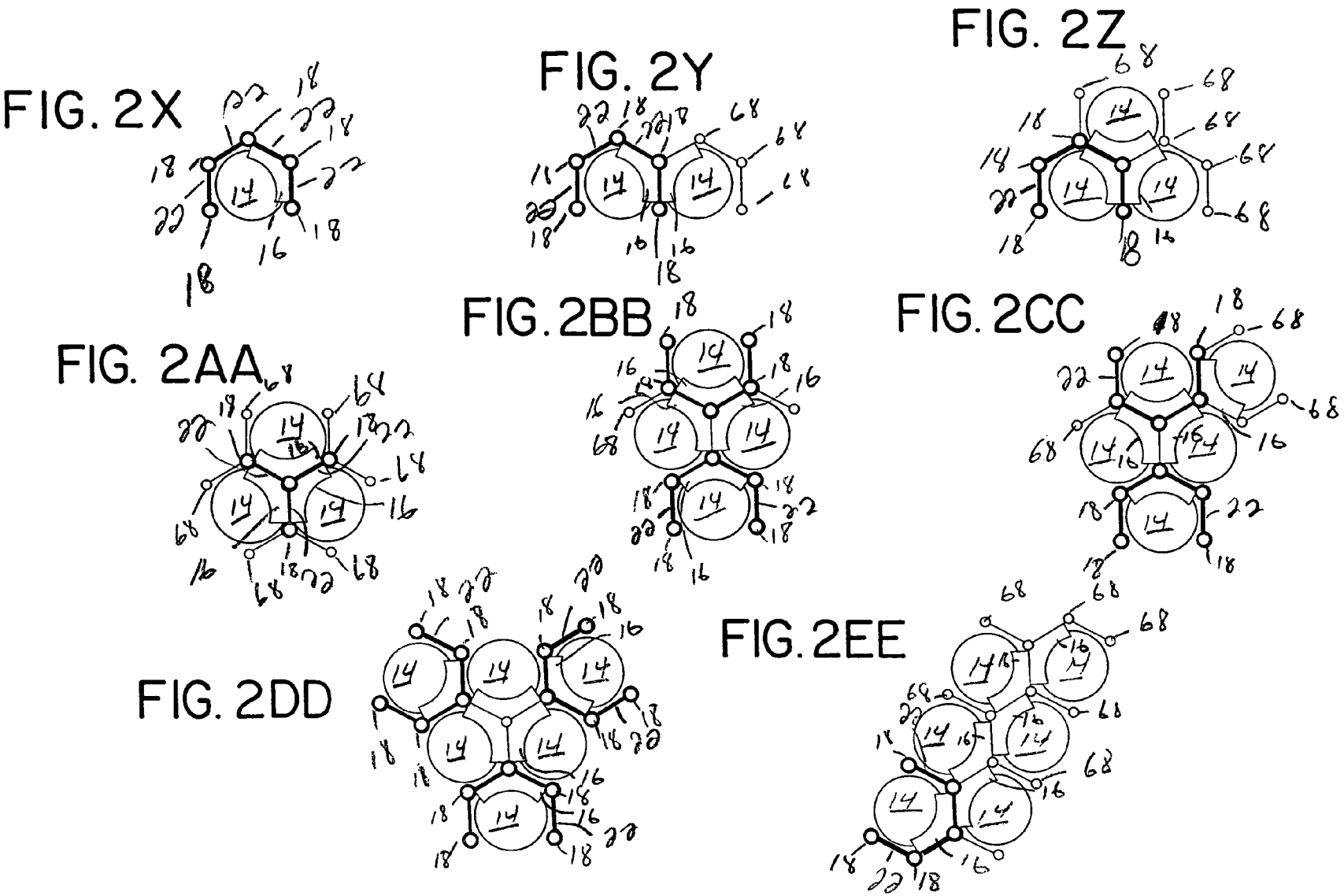
Figure 2H:
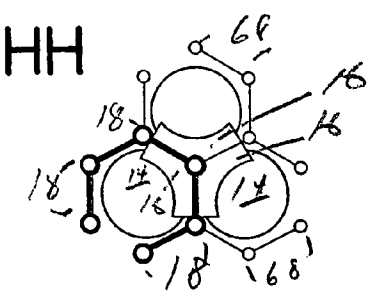
Figure 2K:
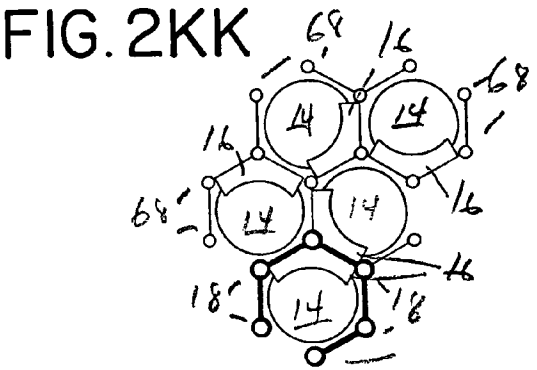
Figure 2G:
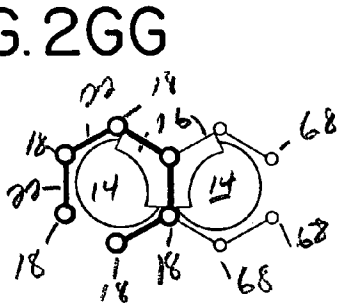
Figure 2J:
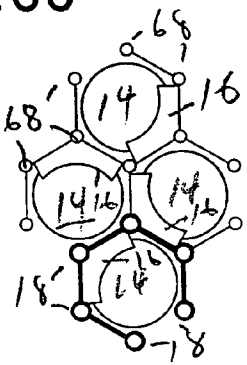
Figure 2M:
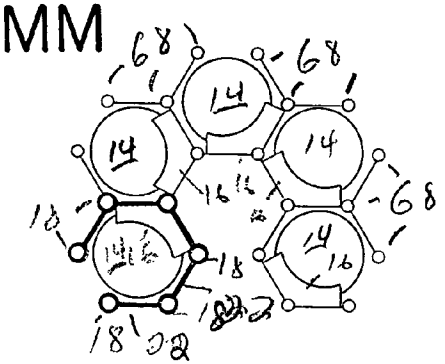
Figure 2F:
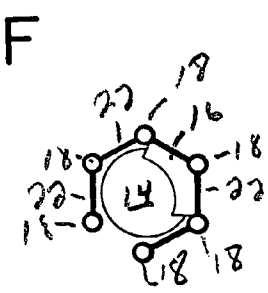
Figure 2I:
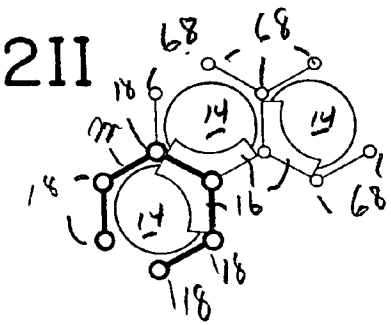
Figure 2L:
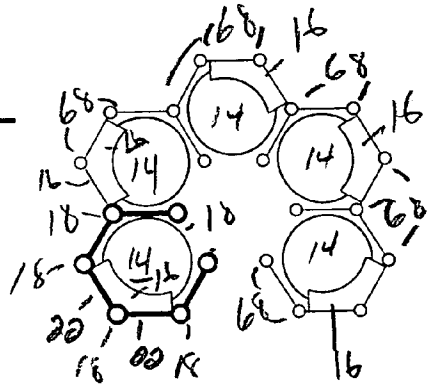
Figure 2P:
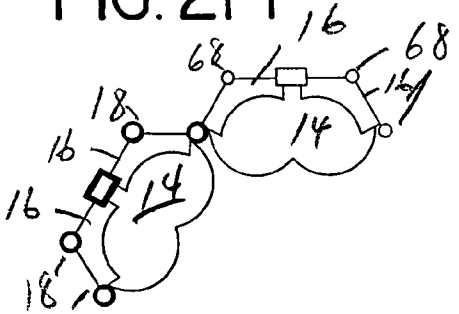
Figure 2S:
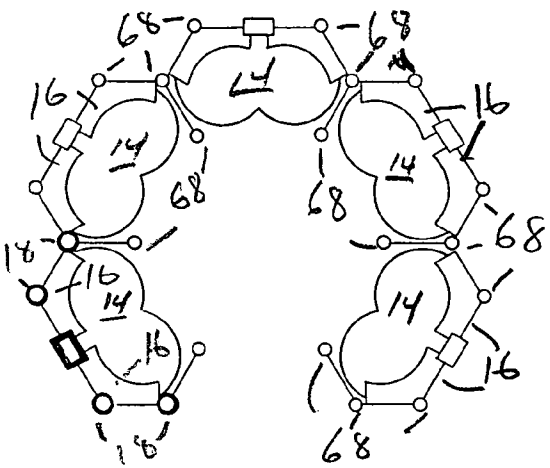
Figure 2O:
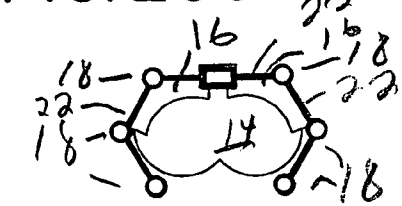
Figure 2R:
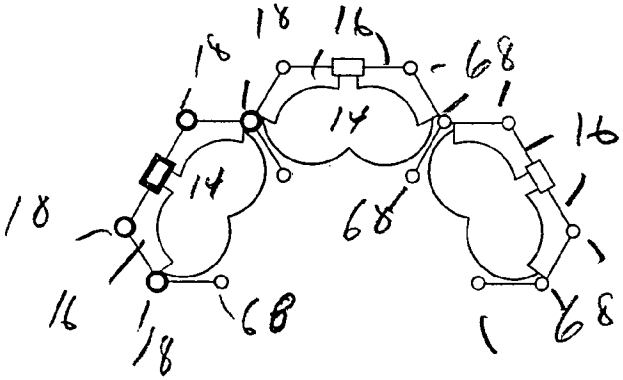
Figure 2N:
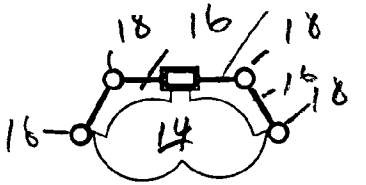
Figure 2Q:
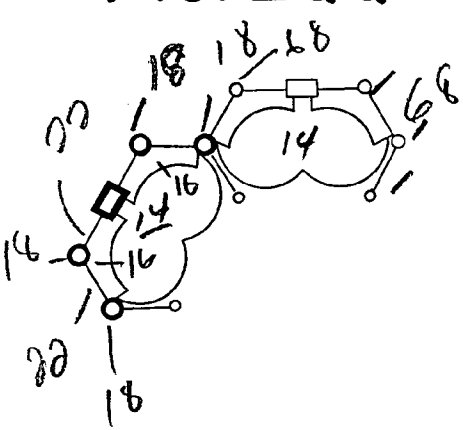
Figure 2V:
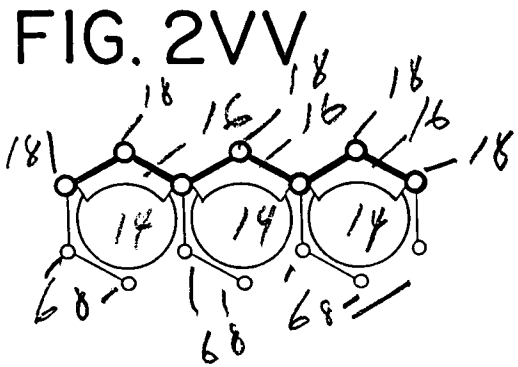
Figure 2U:
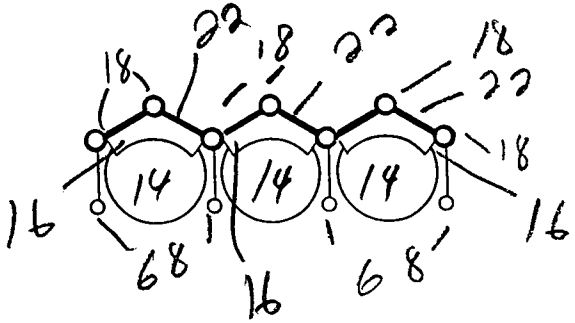
Figure 2T:
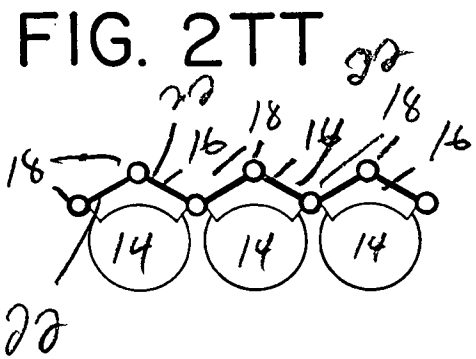
Figure 2X:
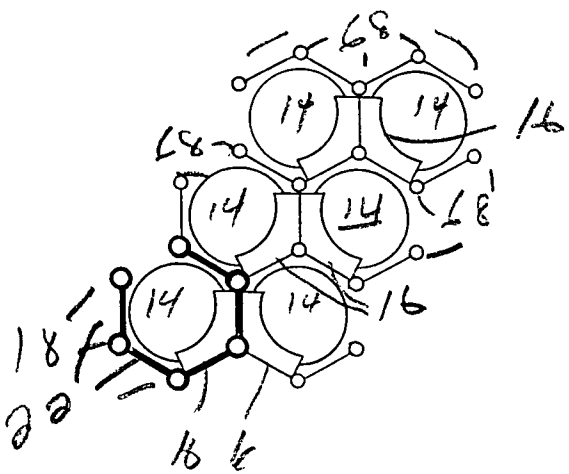
Figure 2W:
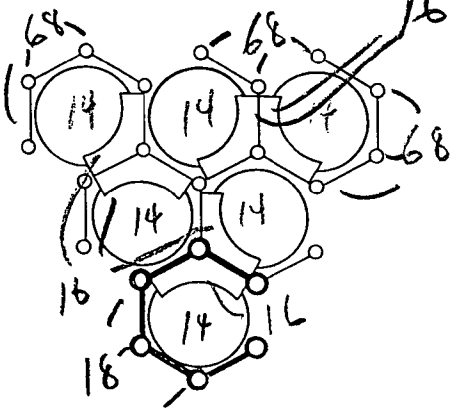

FIGS. 2A through 2XX illustrate a plurality of different configurations that the system 10 may be arranged to provide.

In these figures, the floor mats 14, work surfaces 16, poles 18, crossbeams 22 and short poles 68 are illustrated. FIGS. 2A through 2I illustrate a plurality of zig-zag configurations capable of supporting three or less users to greater than five users. FIGS. 2J-2R illustrate various delta configurations capable of providing work areas for two or less users to five or more users. FIGS. 2S through 2W illustrate a double delta configuration capable of providing work areas for four or less users to 15 or more users. FIGS. 2X through 2EE illustrate a plurality of room configurations identical or similar to the room 36 illustrated in FIG. 1B. The room configurations are capable of providing a work area for one to six or more users. FIGS. 2NN to 2VV illustrate a plurality of single sided constellations capable of providing work areas for one to ten or more users. FIGS. 2WW and 2XX are two additional room configurations capable of providing work areas for six or more users.

FIG. 3 illustrates a side view of a preferred embodiment of the pole 18. An upper portion 32 of the pole 18 has a plurality of parallel spaced apart apertures 150, and a plurality of holes 152 are positioned between the apertures 150. With particular reference to the enlarged view of FIG. 4, two rows of six apertures 150 are positioned within the channel 156. Centrally positioned within the channel 156 are the apertures 152 which are adapted to receive a conventional fastening mechanism such as a screw. This pattern is repeated at a central portion 160 of the pole and then at a lower portion 162. An enlarged grouping of the apertures 150 is located between the lower portion 162 and the central portion 160. The enlarged grouping 170 takes the same general configuration as shown in FIG. 4 except that the number of apertures 150 and holes 152 are substantially increased. The pole 18 includes three generally concave or inwardly curved outer surfaces 176. Apertures 180 are formed within the outer surfaces 176 for the delivery of a power cable to a power receptacle 84. The pattern of apertures 150, holes 152 and openings 180 are symmetrically repeated around the pole 18.

FIG. 5 illustrates an attachment bracket 200 for use with the pole 18. The attachment bracket 200 includes a plurality of hook shaped members 202 which are sized to be received within one column of the parallel apertures 150. The bracket 200 is a two-part element secured together using a conventional fastening mechanism at the clip portion 208.

Figure 6:
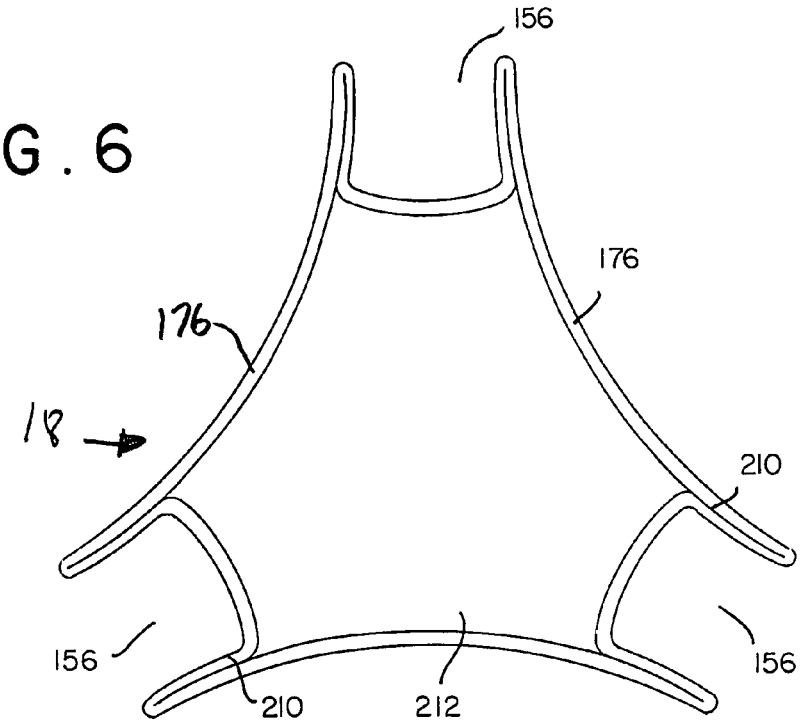
FIG. 6 illustrates a pole embodiment constructed as a one-piece element.

With particular reference to FIG. 6 a one-piece pole construction 18 is illustrated through the cross-section shown therein. The outer surface 176 is a generally curved form. Channels 156 are arranged such that crossbeams 22 or 24 attached therein form a 120 degree angle. The channels 156 have a dovetail configuration which becomes wider within an interior portion 210 thereof. A centrally defined opening 212 extends vertically within the pole 18. The pole in this and the following embodiments can be formed from a wide variety of materials e.g., steel or aluminum and using various well known processes such as the preferred roll forming and extrusion.

Figure 7:
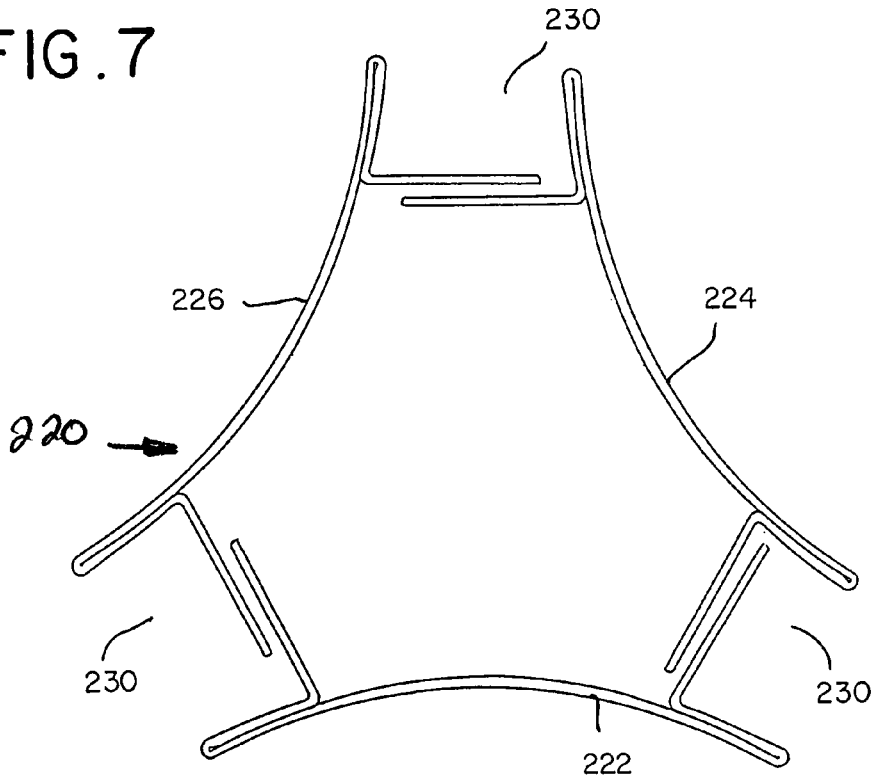
FIG. 7 illustrates another pole embodiment constructed from three portions.

FIG. 7 illustrates a three-piece embodiment of the pole 220. The pole 220 is characterized by three pieces 222, 224, 226 which take the same general configuration as the one-piece embodiment shown in FIG. 6, except that the channels 156 are defined by two oppositely extending walls that are secured together to form channel 230. Preferably, the poles 18 and 220 are formed from cold rolled steel.

Figure 7A:
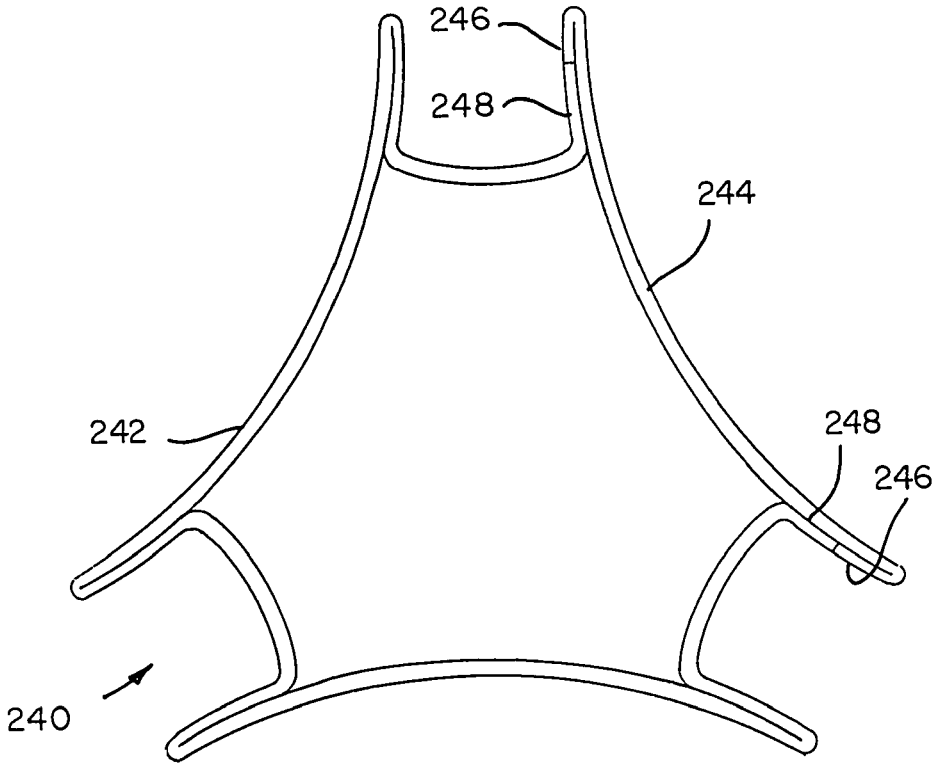
FIG. 7A illustrates another pole embodiment constructed from two portions.

FIG. 7A illustrates a two piece embodiment of the pole 240. The pole 240 includes a first piece 242 and a second piece 244. The piece 244 includes ends 246 that are attached to the ends 248 of the piece 242 by welding or the like.

Figure 8:
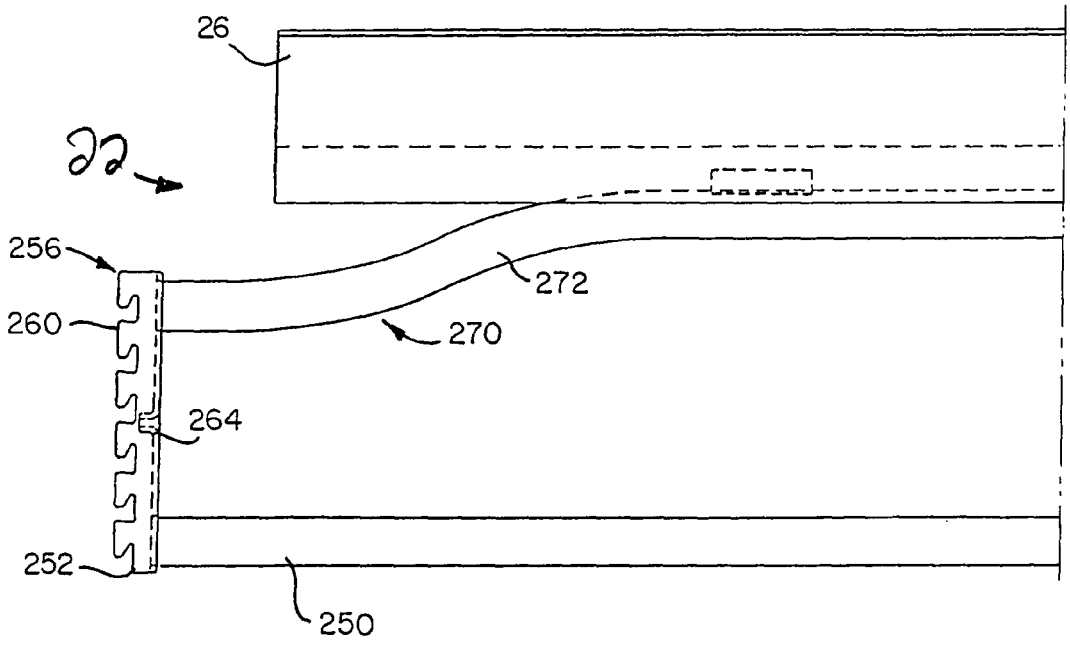
FIG. 8 is a partially broken away view of a crossbeam and trough constructed in accordance with the preferred embodiment of the present invention.
Figure 8:
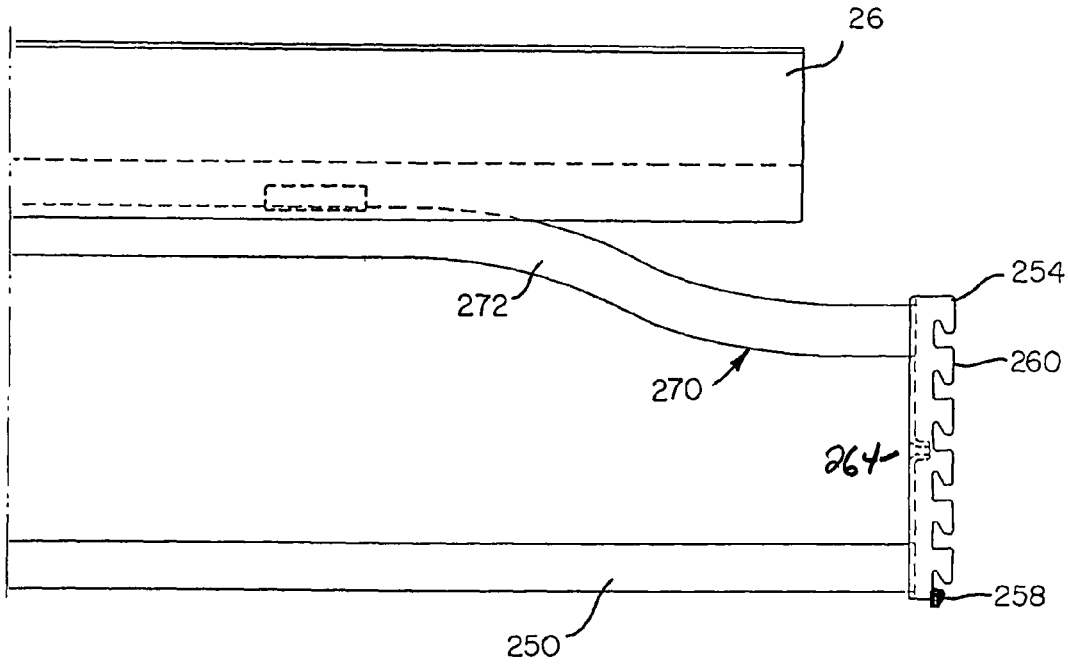

FIG. 8 is a partially broken-away view of the upper crossbeam 22 and the trough 26. The upper crossbeam 22 includes a longitudinally extending lower round tube 250 that extends from a first side 252 to a second side 254. The tube 250 is attached to the hanger members 256, 258. The hanger members 256, 258 include a plurality of hook-shaped members 260 which are sized to mate with the apertures 150 in the pole 18. The hangers 260 include openings 264 that are capable of receiving a conventional fastening mechanism such as a screw which can pass into one of the holes 152. An upper round tube 270 includes an angularly upwardly-extending portion 272 that meets with the trough 26.

Figure 9:
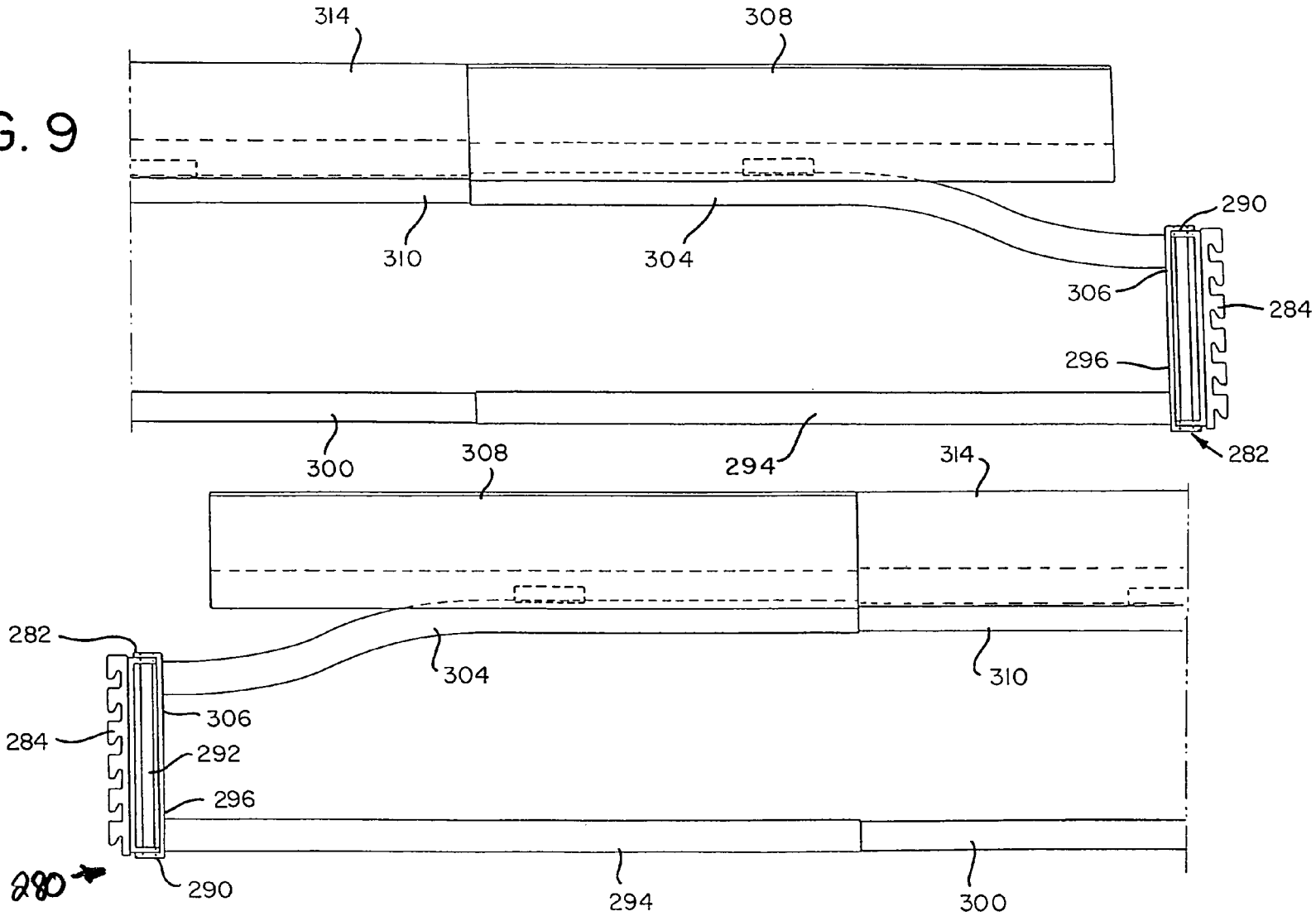
FIG. 9 is a partially broken away view of a telescoping crossbeam and trough constructed in accordance with the preferred embodiment of the present invention.
Figure 10:
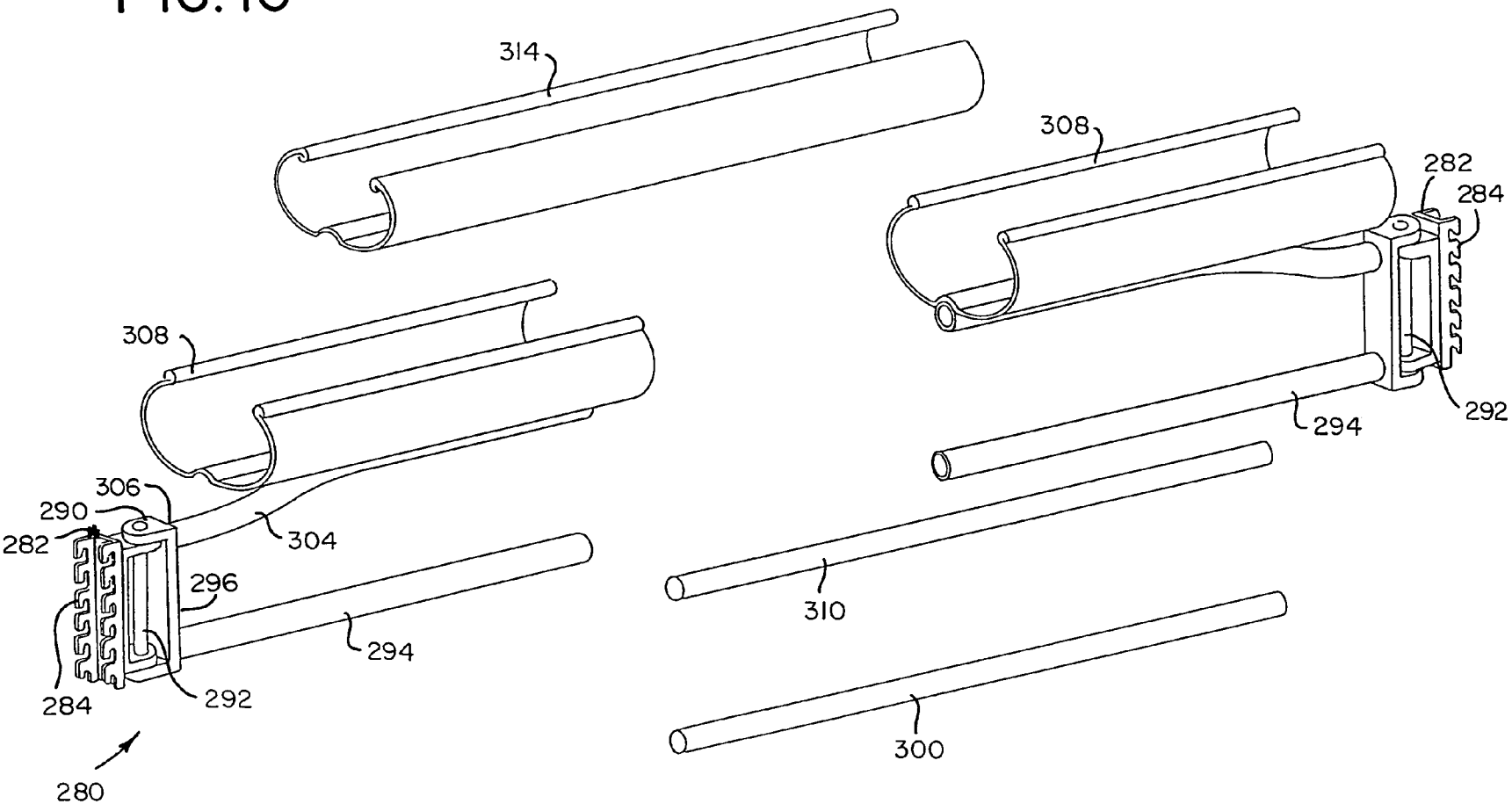
FIG. 10 is an exploded view of the telescoping crossbeam shown in FIG. 9.
Figure 11:
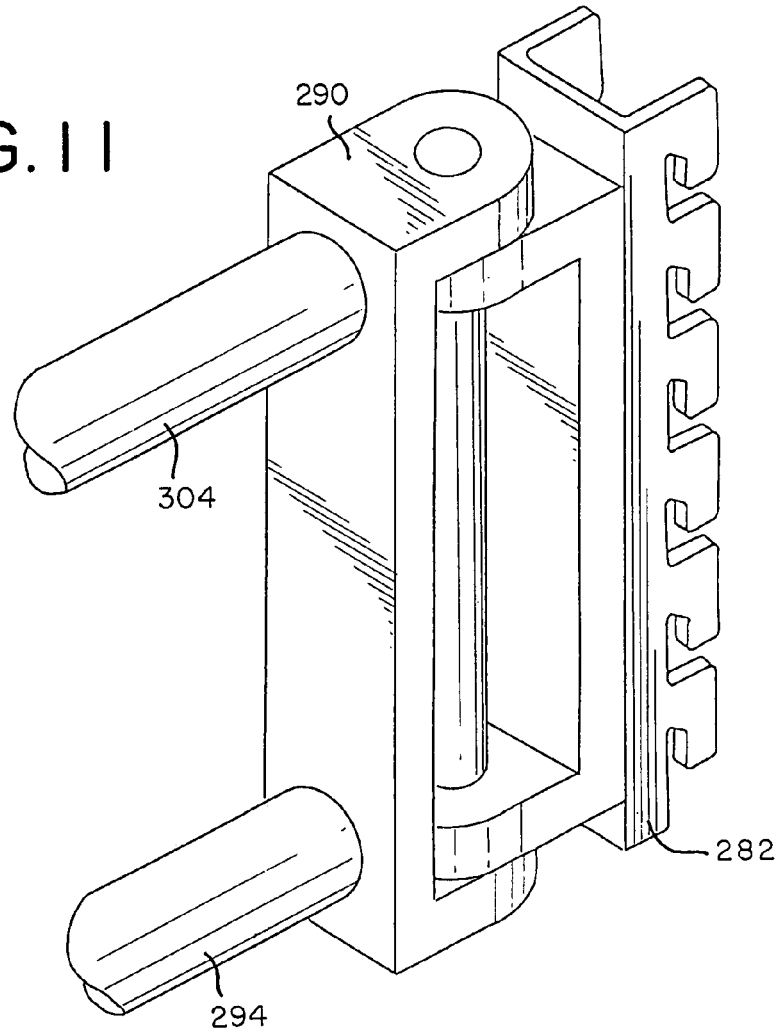
FIG. 11 is a broken away view of the end portion of the telescoping crossbeam and trough shown in FIGS. 9 and 11.

FIGS. 9-11 illustrate a telescoping and pivoting crossbeam and trough assembly 280. With particular reference to the exploded view shown in FIG. 10, the telescoping crossbeam 280 includes a hanger 282 having hook portions 284 pivotably attached to a bracket 290 (the opposite sides of the assembly have an identical construction). A pin 292 interconnects the hanger 282 to the bracket 290. A lower tube 294 extends outward from a lower portion 296 of the bracket 290. A lower intermediate tube 300 is sized such that it can fit within the circumference of the lower tube 294. An upper tube 304 extends outward and upward from an upper portion 306 of the bracket 290. End portion of the trough 308 are secured to the top of the upper tube 304. An upper intermediate tube 310 is sized to fit within the upper tube 304. An intermediate trough portion 314 is sized to fit within the end trough portions 308. A broken-away assembled view of the telescoping crossbeam 280 is illustrated in FIG. 9. FIG. 11 is an enlarged view of the hanger 282 and the bracket 290 with the upper tube 304 and the lower tube 294 attached thereto.

The telescoping crossbeam 280 is assembled by sliding the end tubes 294 and 304 out from engagement with the end tubes formed on the opposite piece. The intermediate tubes 310 and 300 are then exposed and the telescoping crossbeam is lengthened. The intermediate trough portion 314 is then revealed and continues to form the enclosed space formed in combination with the end trough portions 308 by the lengthening of the telescoping crossbeam 280.

Figure 12:
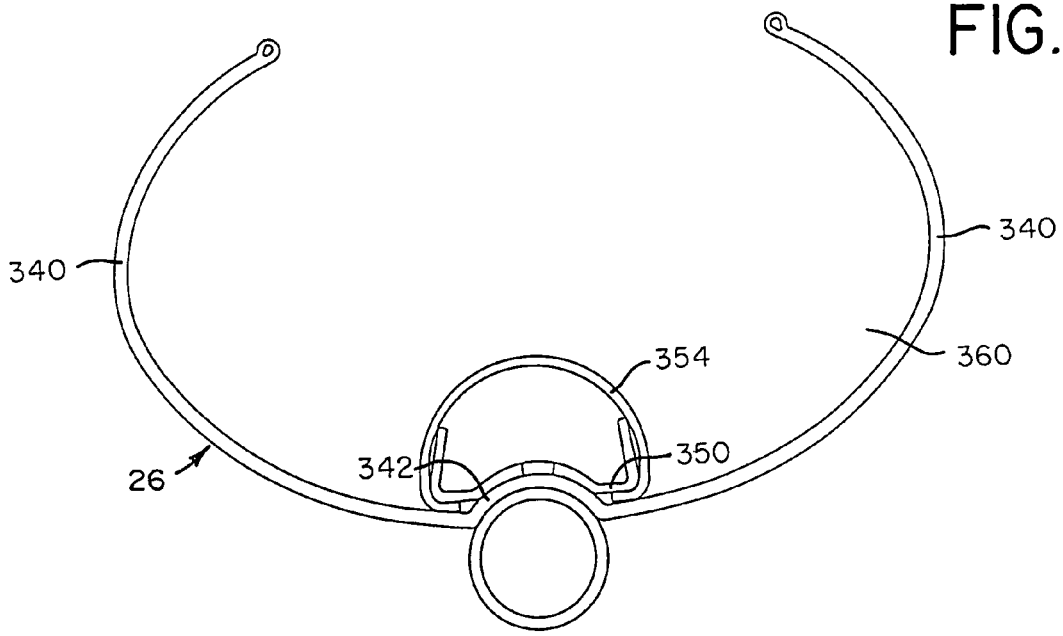
FIG. 12 is a cross-section illustrating the trough and utility passageway of the present invention.

FIG. 12 is a cross-section illustrating the construction of the trough 26. The trough 26 includes curved outer walls 340 and a curved lower portion 342 which corresponds with the curvature of the upper tube 272 (in the fixed length crossbeam) or tube 304 (in the telescoping crossbeam). A clip 350 is secured to the lower portion 342 of the trough 26. A cover 354 is secured over the clip 350. The cover 354 and the clip 350 define a passageway through which power cabling is passed. The remaining area 360 is useful for the passage of other utilities such as data cabling.

Figure 10A:
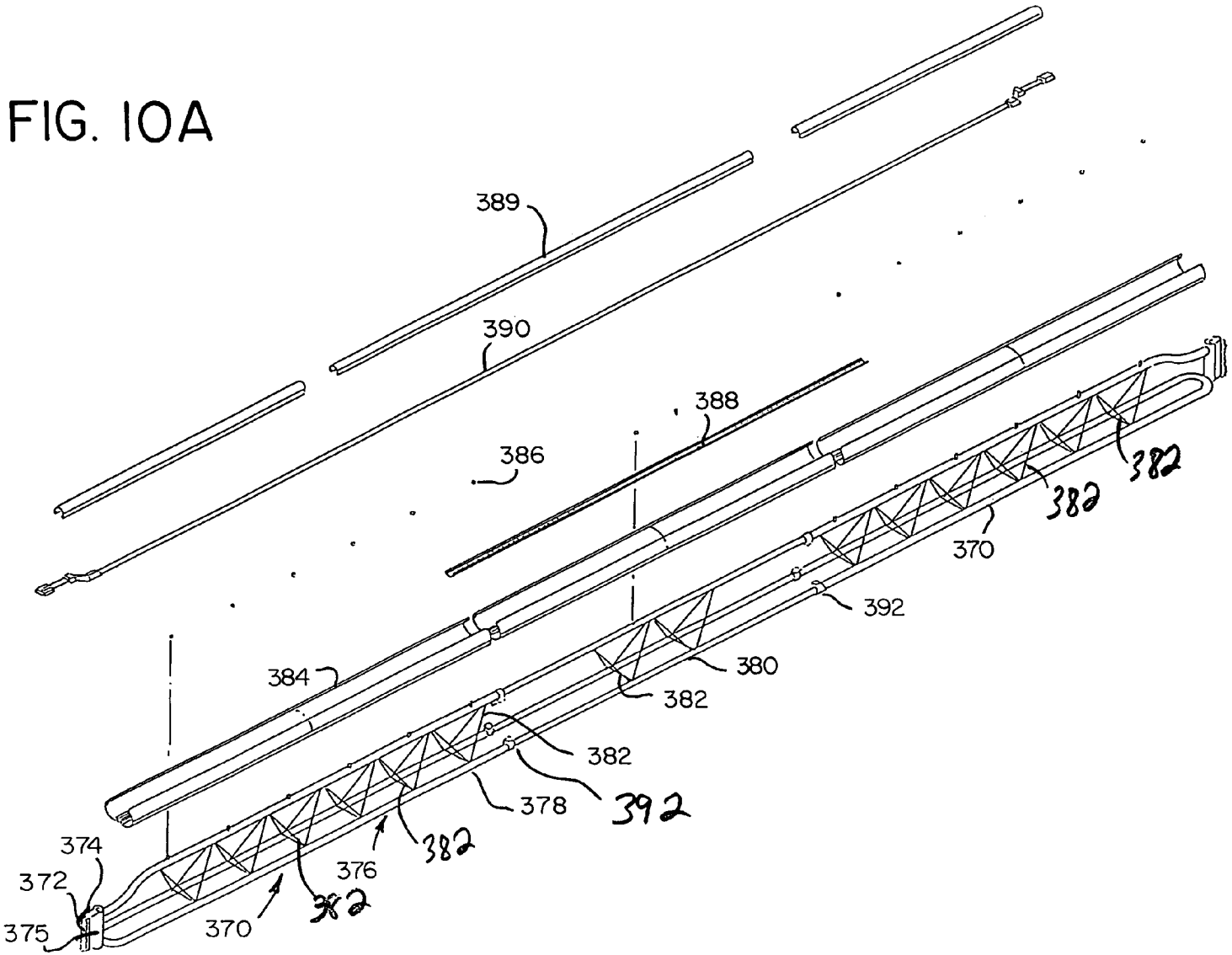
FIG. 10A is an exploded view of the telescoping crossbeam according to another preferred embodiment.

Referring back to FIG. 10A, an alternate embodiment of a telescoping and pivoting crossbeam and trough assembly 370 is illustrated. The embodiment of FIG. 10A operates in essentially the same manner as does the earlier embodiment with main exception being the addition of crossbeams for additional support. The telescoping crossbeam 370 includes a hanger 372 having hook portions 374 pivotably attached to a bracket 375 (the opposite sides of the assembly have an identical construction). An adjustable lower portion 376 extends between the brackets 375. The lower portions 376 includes two end portions 378 and a slidable intermediate portion 380 is sized such that it can fit within the circumference of the end portions 378. Crossbeams 382 provide additional support for the assembly 370. An upper trough 384 is secured to the lower portion via securing elements 386 such a screws. A bottom wireway 388 is secured to bottom portion of the trough 384. A plurality of cover members 389 are illustrated above an associated electrical harness assembly 390. Clips 392 secured the assembly 370 at a selected length.

Figure 14:
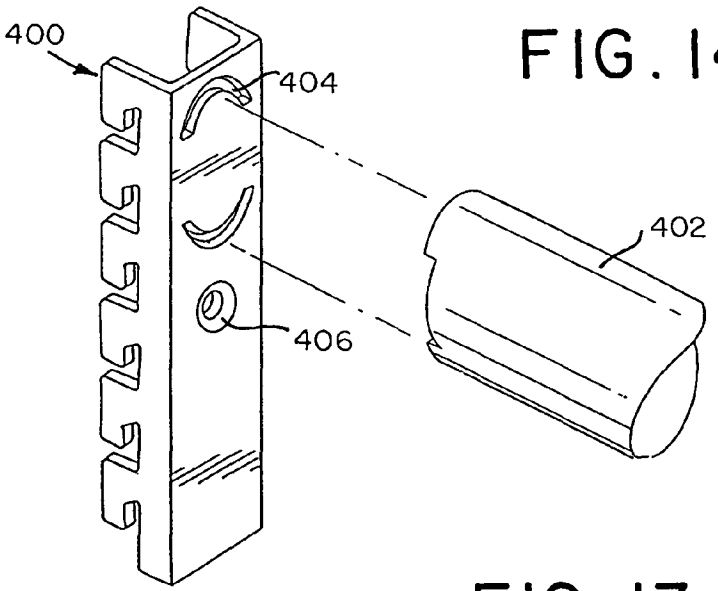
FIG. 14 is a partially exploded and broken away view of the crossbeam illustrated in FIG. 13.
Figure 14A:
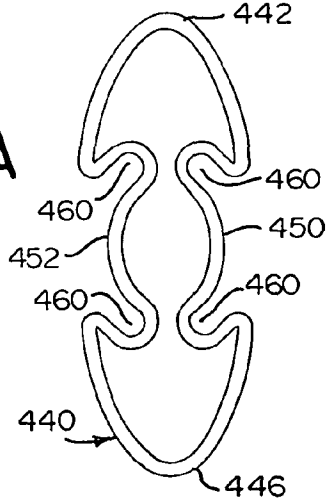
FIG. 14A is a cross-section of another preferred embodiment of a crossbeam.
Figure 13:
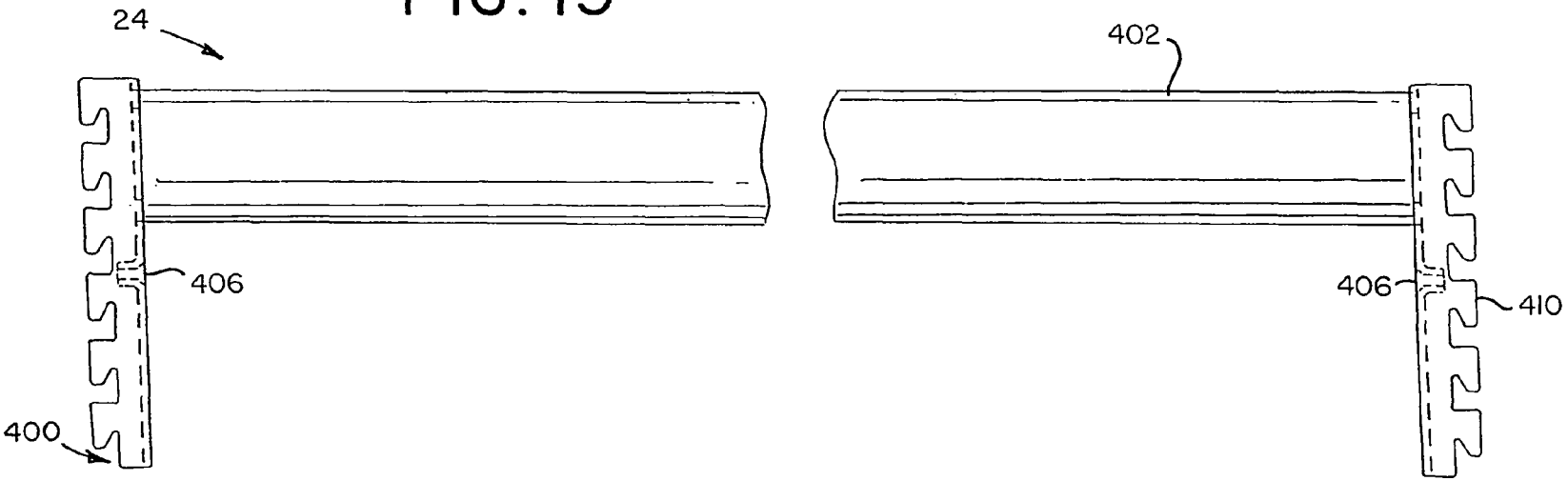
FIG. 13 illustrates an alternate crossbeam constructed in accordance with the preferred embodiment of the present invention.

FIGS. 13 and 14 illustrate the construction of the lower crossbeam 24. The lower crossbeam 24 includes a hanger member 400. The hanger member 400 operates in essentially the same manner as the hangers 260 as shown in FIG. 8. However, in contrast with the upper crossbeam 22, the lower crossbeam 24 includes a oval-shaped tube 402. The oval-shaped tube 402 is fit within the aperture 404 in the hanger 400 and welded into place. The hanger 400 includes an opening 406 for use with a conventional fastening mechanism such as a screw and hook portions 410 in order to secure the lower crossbeam 24 to the pole 18. FIG. 14A illustrates another preferred embodiment 440 in cross-section. The crossbeam 440 includes a top portion 442 and a bottom portion 446. The central portions 450 and 452 include channels 460 useful to attach barrier members thereto.

Figure 15:
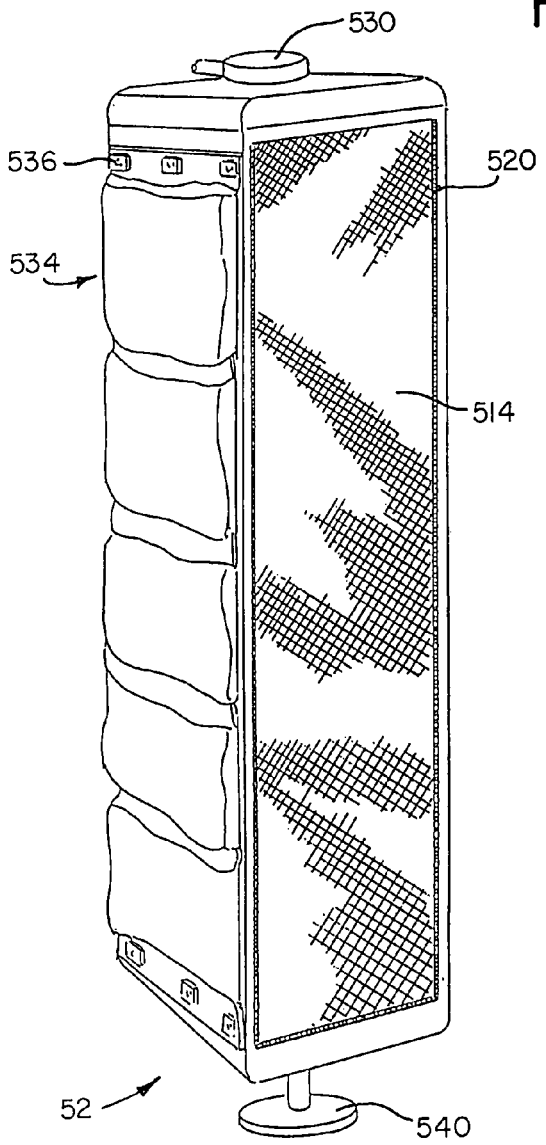
FIG. 15 illustrates a preferred embodiment of a soft storage member of the present invention.
Figure 15A:
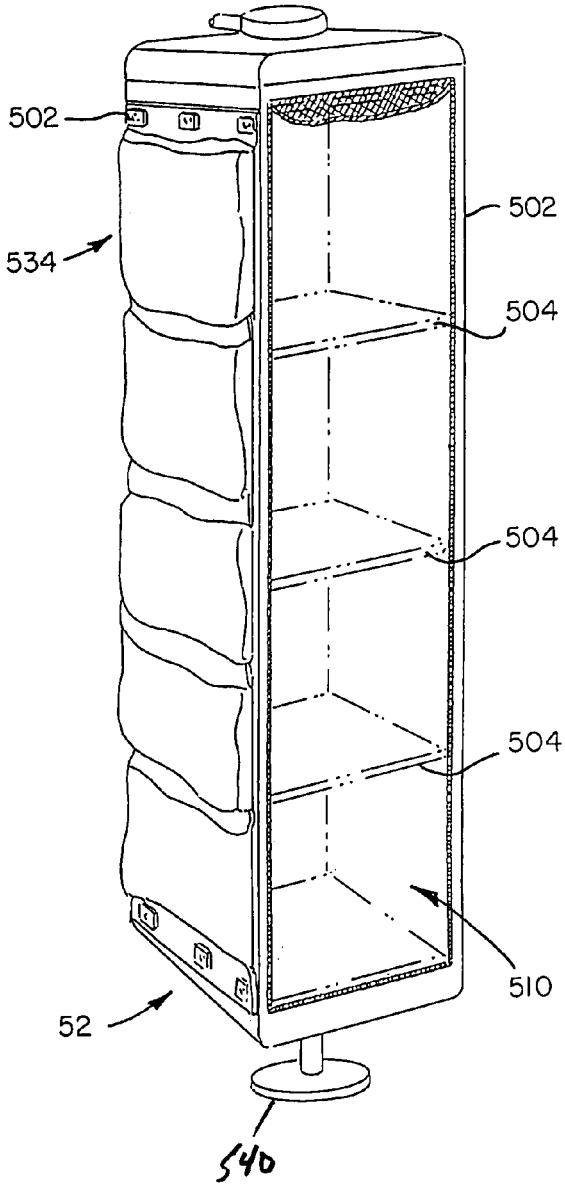
FIG. 15A illustrates the storage member of FIG. 15 with the mesh screen lifted up.

FIGS. 15-16 illustrate three storage members useful with the system 10 as shown in FIGS. 1A & 1B. A soft storage member 52 is illustrated in FIG. 15. The storage member 52 includes side walls 502 formed from a flexible material. A plurality of shelves 504 are located at spaced apart positions within the interior 510. A mesh screen door 514 having a conventional fastening mechanism such as a zipper 520 is used to enclose the interior 510. FIG. 15 illustrates the screen door 514 in the closed position. FIG. 16 illustrates the screen door 514 in the open position and tucked into an internal cavity (not shown). The storage member 500 is rotatably attached to a crossbeam at the housing 530. A removable storage bag 534 is attached to a side 502 using the clips 536. A pedestal 540 supports the storage member 52 on a base surface.

The unique fabric chosen for storage member 52 also serves a sound absorbing characteristic. The storage member 52 is capable of being readily removed and moved to a new work area when a worker changes locations. It is intended that the storage member 52 be formed from a fabric that can be easily restyled to a new color or pattern to suit the changing esthetic needs of the work environment.

Two rigid storage members 54, 56 are illustrated in FIG. 16. The storage members 54, 56 function in much the same way as the storage member 500 except that they include rigid side walls and a rigid door. The storage member 54 includes rigid side walls 602 and a rigid door 604. A plurality of shelves 610 and drawers 612 are also illustrated. A housing 620 provides for the rotational connection to a crossbeam 24. Clips 630 secure the door 604 in a closed position. FIG. 16A illustrates a smaller rigid storage member 56. The storage member 56 includes a plurality of ridges 640 which form a passageway for insertion of shelves 642 within the interior 644 of the storage member 56.

Figure 17:
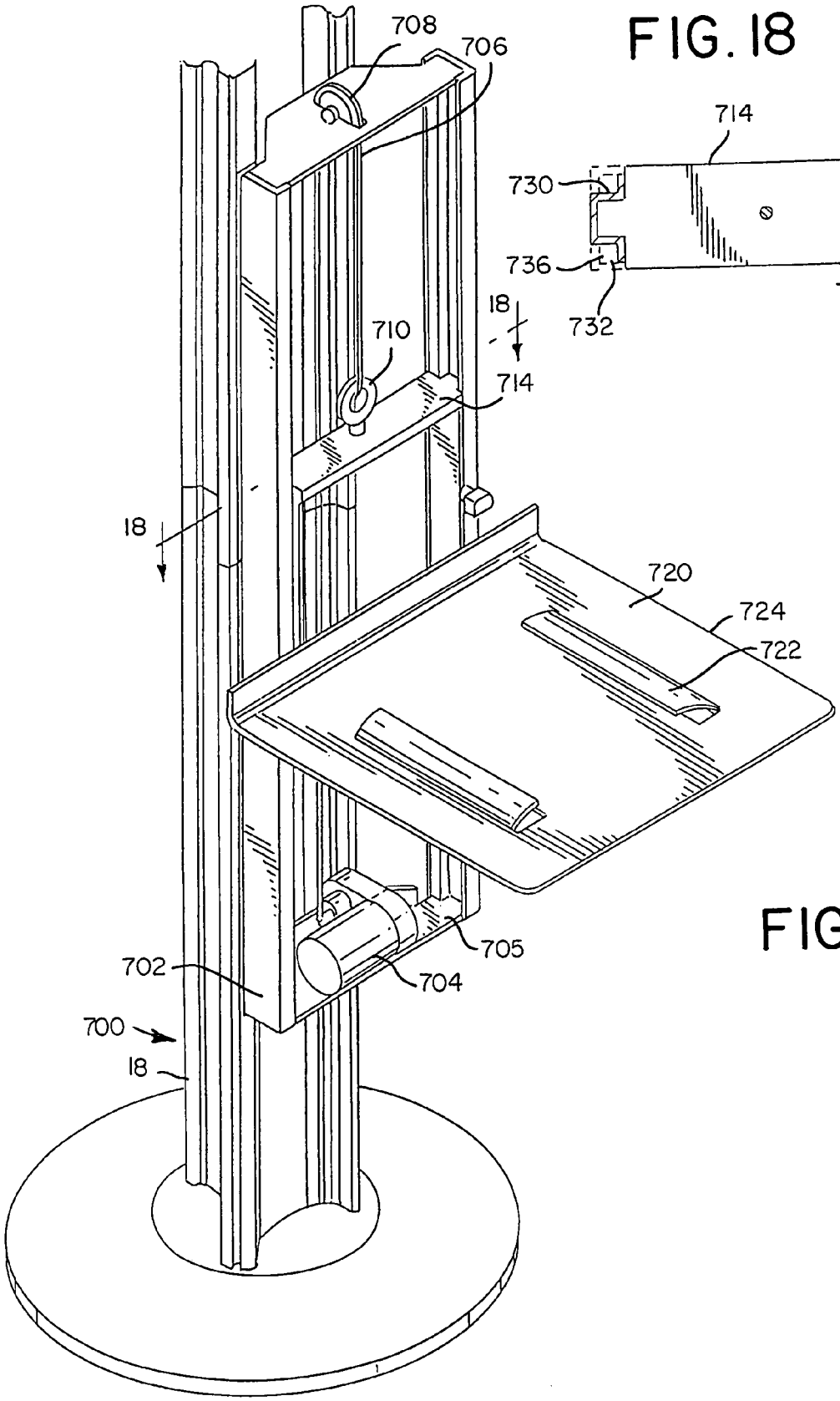
FIG. 17 illustrates a preferred embodiment of a monitor lift capable of being attached to a pole in accordance with one preferred embodiment.
Figure 18:
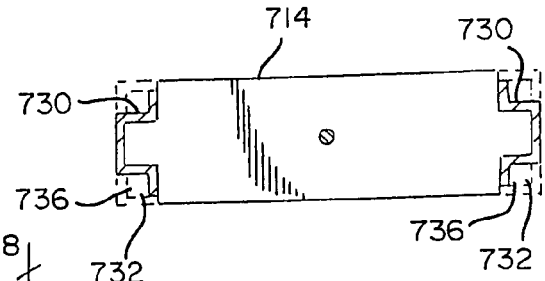
FIG. 18 illustrates a cross-section of the frame and slide member of the monitor lift illustrated in FIG. 17.

FIGS. 17-24 illustrate three alternative monitor lift assemblies useful with the system 10. Turning to FIGS. 17-18, a monitor lift assembly 700 which is attached to a pole 18 is illustrated. The monitor lift assembly 700 includes a frame 702 secured to the pole 18. The frame 702 includes a motor 704 attached to a bottom portion 705 thereof. The motor 704 is a conventional element available from for various manufacturers. The motor 704 is attached to cabling 706 which extends upward to the pulley 708 and downward to a hook member 710. The hook member 710 is attached to the slide member 714. A monitor support platform 720 is attached to the slide member 714. Monitor clips 722 are attached to the top surface 724 of the monitor support platform 720. The slide member 714 includes outer edges 730 which fit within a channel 732 that extends vertically along the interior surface 736 of the frame member 702.

In operation, the motor 704 pulls the slide member 714 upward or downward depending on the activation state of the motor as directed by the user. The slide member 714 and in particular the end portions 730 slide vertically upward or downward within the channel 732. This provides for the adjustment of the monitor support platform 720 to suit the particular needs of the user.

Figure 19:
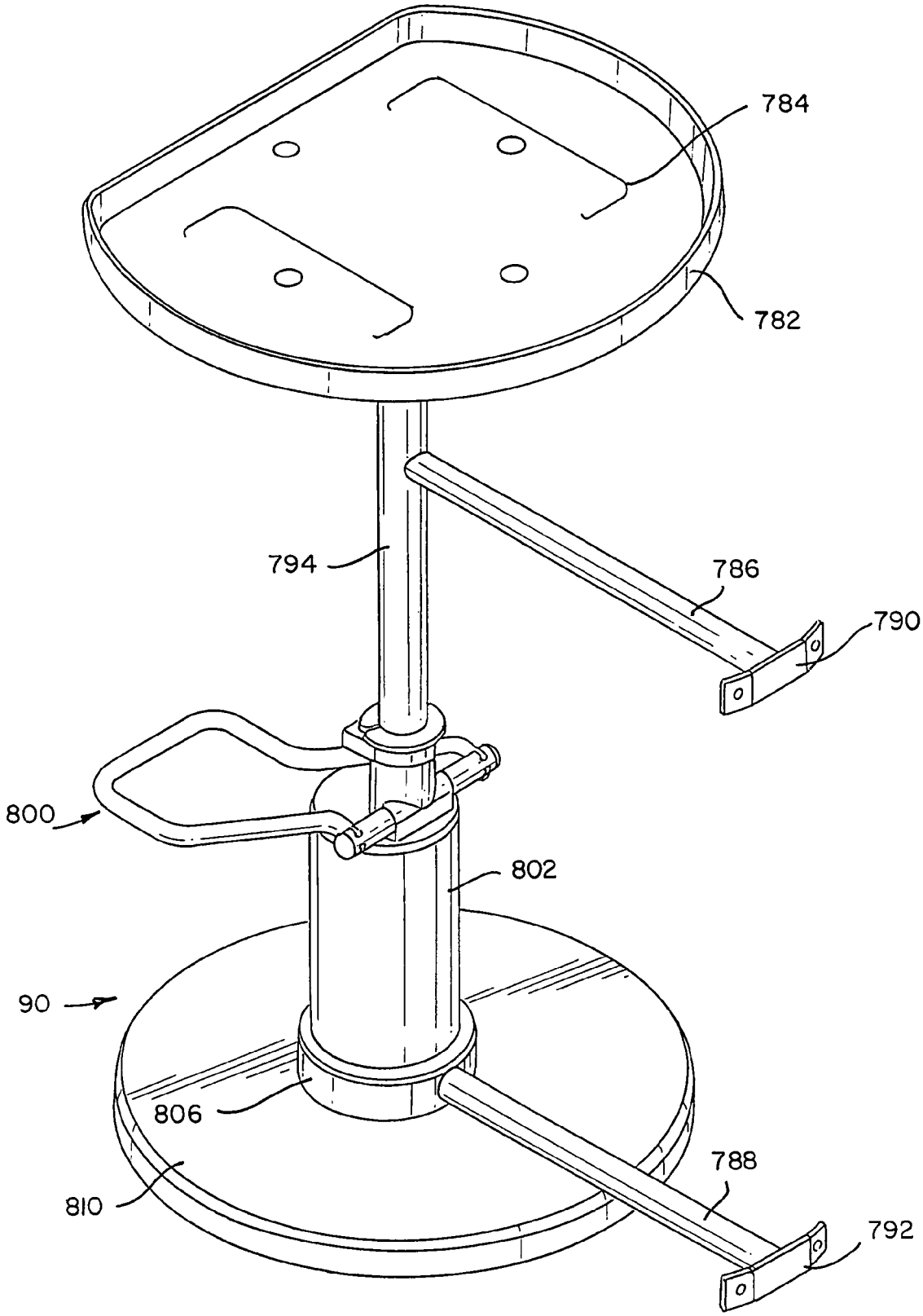
FIG. 19 is a perspective view of another preferred embodiment of a monitor lift of the present invention.
Figure 20:
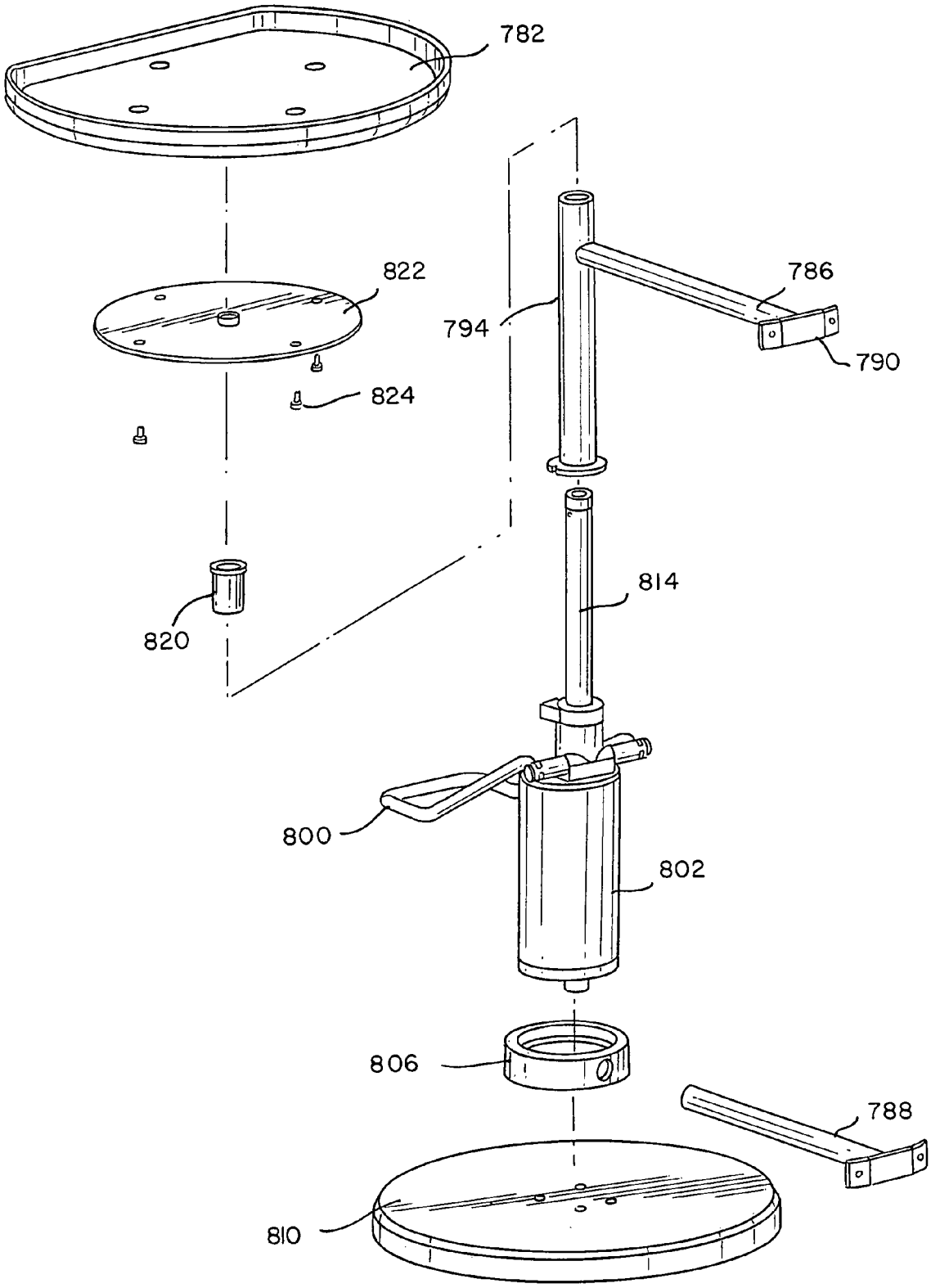
FIG. 20 is an exploded of the monitor lift shown in FIG. 19.
Figure 21:
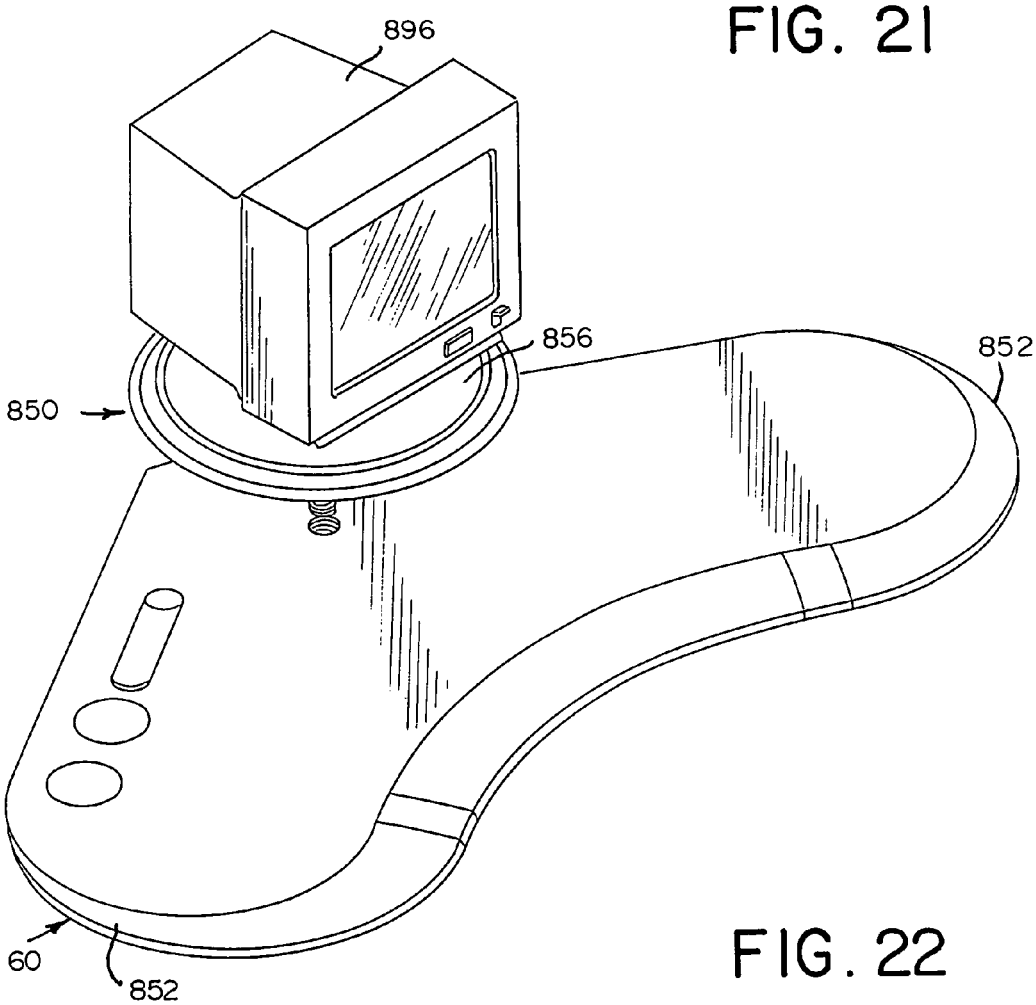
FIG. 21 illustrates yet another preferred embodiment of a monitor lift useful with the system of the present invention.

FIGS. 19 & 20 illustrate an alternative monitor lift assembly 90 (as shown in FIG. 1B) which can be attached to a pole 18. The monitor lift assembly 90 includes a monitor support surface 782 with clip members 784 capable of securing a monitor to the support surface 782. Crossbeams 786 and 788 extend to brackets 790, 792, respectively. The brackets 790, 792, are attached using a conventional fastening mechanism such a screw to a pole 18. Crossbeams 786 are connected to the housing 794 which extends downward from beneath the monitor support surface 782. A foot activation member 800 is attached to a hydraulic cylinder 802. The hydraulic cylinder 802 is a conventional element available from various manufacturers. A collar 806 is attached beneath the hydraulic cylinder 802 and is connected to the crossbeam 788.

With particular reference to the exploded view of FIG. 20, conventional fastening mechanisms such as screws (not shown) are used to interconnect the base 810 to the hydraulic cylinder 802. The hydraulic cylinder 802 includes a rod 814 that extends into the housing 794. The rod 814 passes through a bushing 820 and connects to the top plate 822. Conventional fastening mechanisms such as the screws interconnect the top plate 822 and the monitor support surface 782.

In operation, a user would depress the foot actuation member in order to drive the rod 814 through the activation of hydraulic cylinder 802. By pressing the foot activation member 800 all the way downward, the rod 814 is allowed to return to the downward position.

Figure 22:
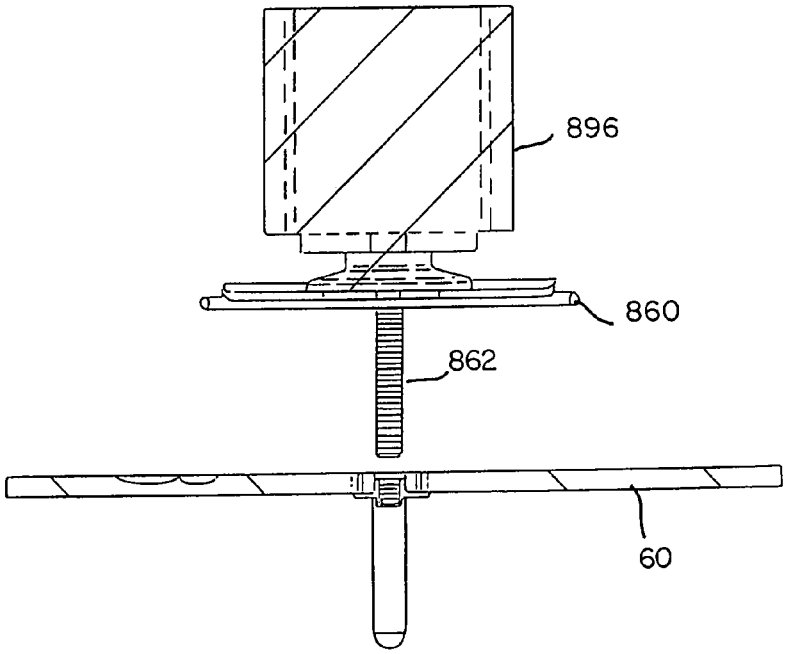
FIG. 22 illustrates a partially exploded view of the monitor lift shown in FIG. 21.
Figure 23:
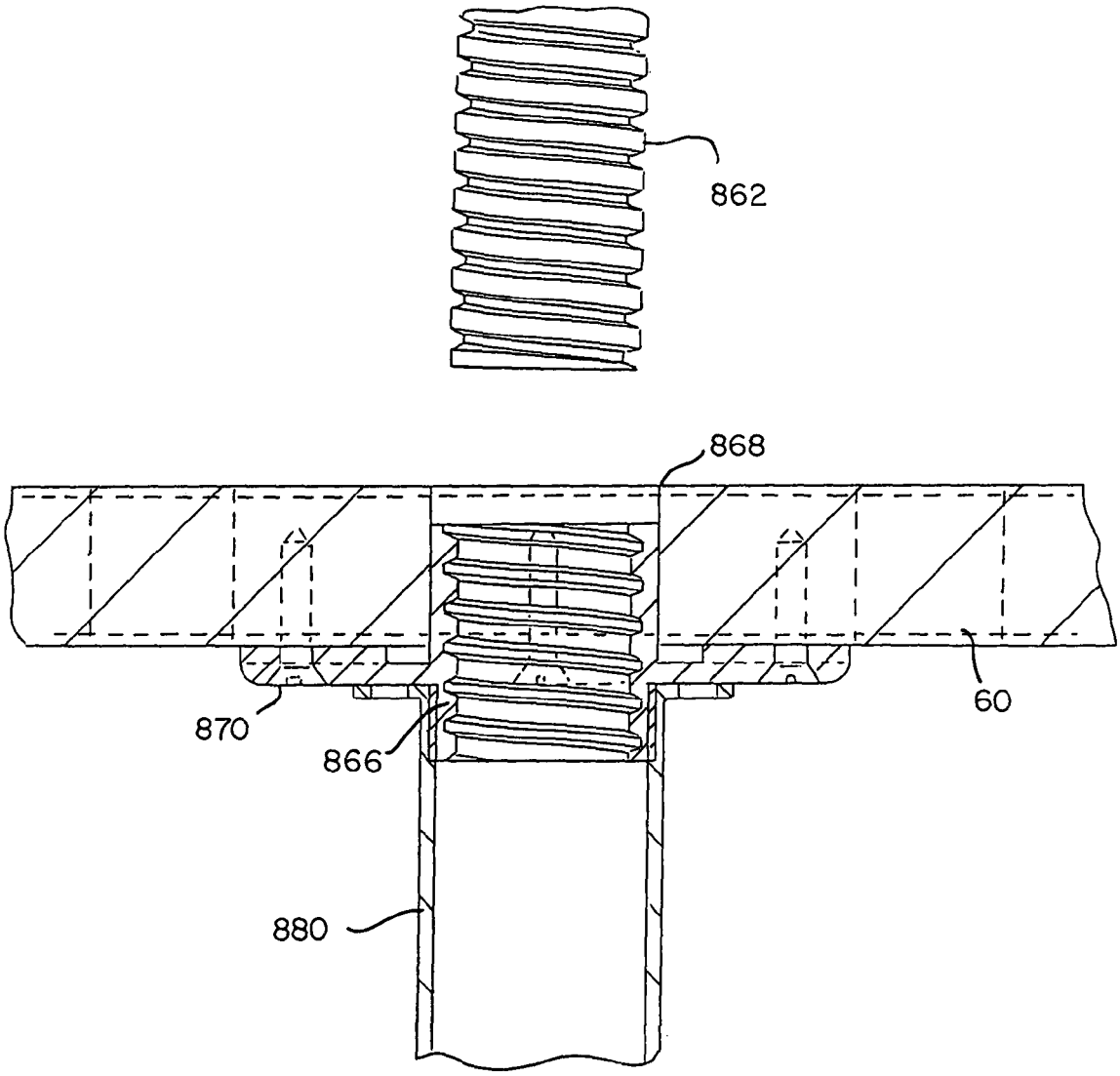
FIG. 23 illustrates a partial cross-section on the monitor lift illustrates in FIGS. 21 and 22.
Figure 24:
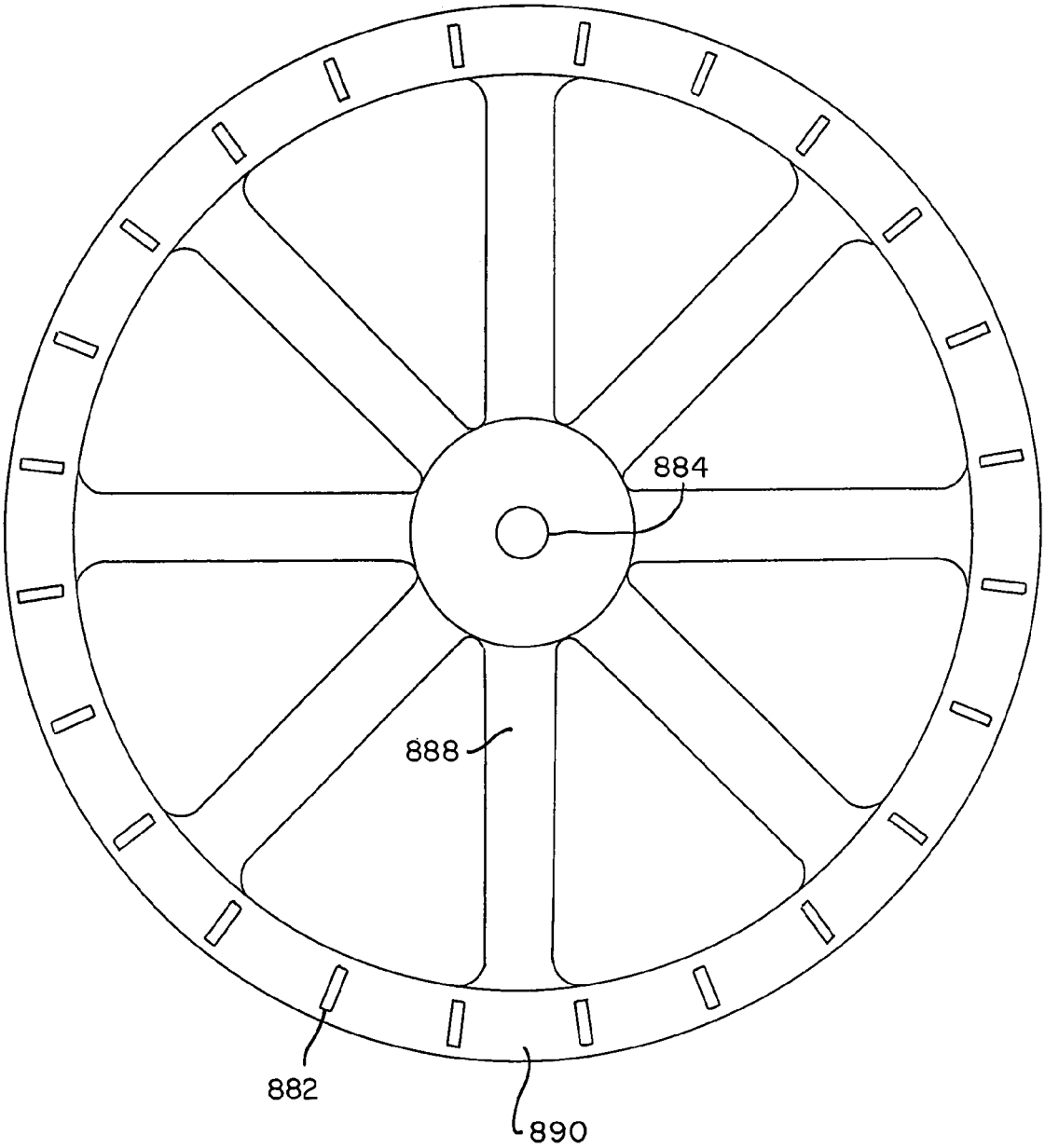
FIG. 24 illustrates the movable tray shown in FIGS. 21-23.
Figure 25:
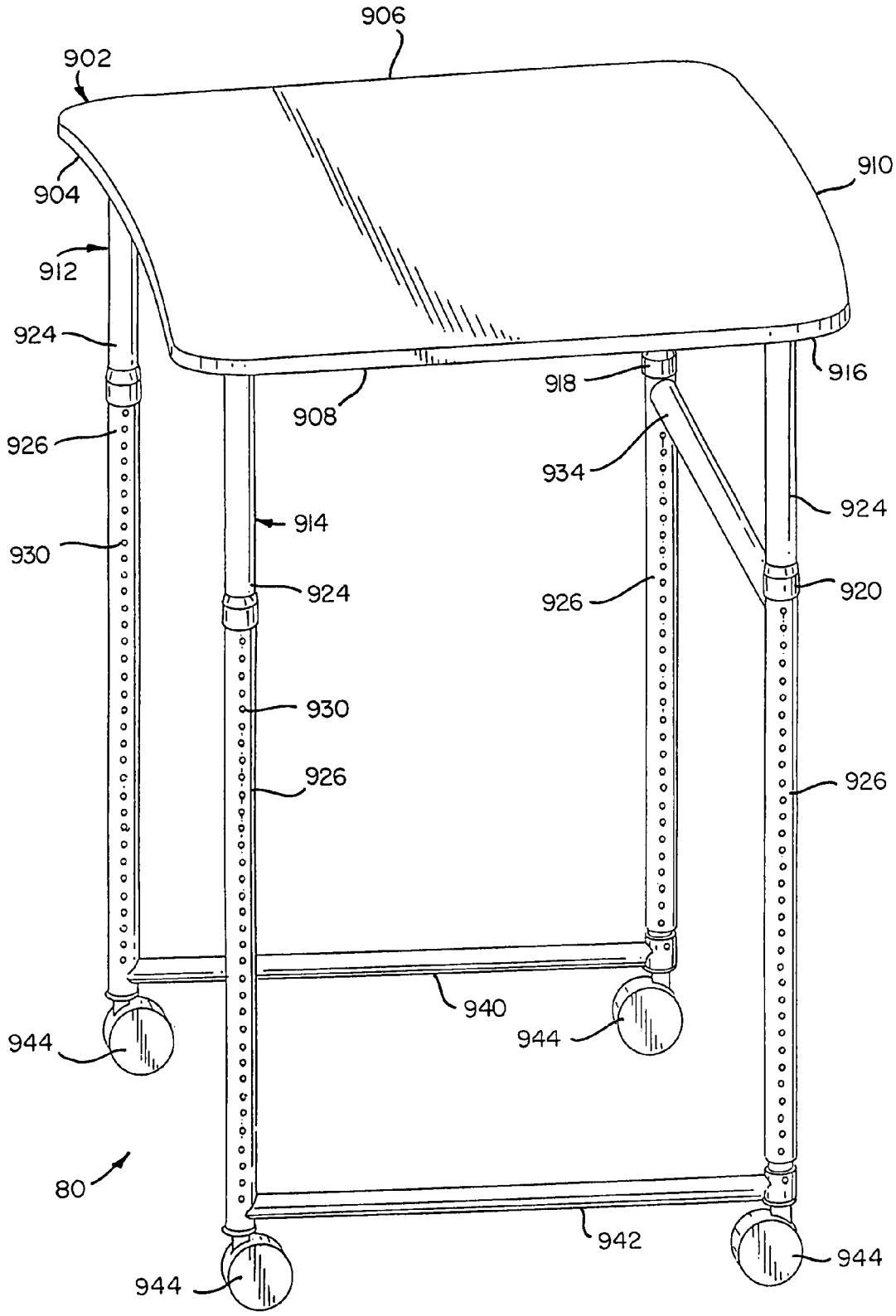
FIG. 25 is an assembled view illustrating a movable work surface constructed in accordance with the preferred embodiment and useful with the system of the present invention.

FIGS. 21-24 illustrate a third monitor lift 850 of the present invention. The monitor lift 850 is useful with a work surface 60 as shown in FIGS. 21-24. While the monitor lift 850 is shown in a central portion of the work surface 60, it should be recognized that it could be mounted adjacent outer edges 852 thereof. The monitor lift 850 includes a top tray 856 and a bottom tray 860. As best illustrated in FIG. 22, the bottom tray 860 is attached to a threaded screw 862. With particular reference to FIG. 23, the threaded screw 862 passes within a threaded collar 866 which is mounted within an aperture 868 of the work surface 60. A threaded collar 866 is attached using conventional fastening mechanisms such as screws 870 to the bottom surface 872 of the work surface 60. A cover member 880 extends downward from beneath the threaded collar 866 in order to cover the threaded screw 862. FIG. 24 best illustrates the top tray 856 from the bottom. The top tray 856 includes a plurality of bearings mounted within the slots 882. The top tray 856 also includes a central aperture 884 with a plurality of spokes 888 radiating outward to an outer rim 890.

In operation, the user would adjust the positioning of the top tray 856 and the monitor 896 by rotating the bottom tray 860. The user would also hold the monitor 896 in a fixed position (assuming the correct viewing angle was previously set) such that the monitor 896 was projected upward or downward depending upon the rotation of the bottom tray 860 and screw 862. The top tray 856 which includes the bearing (not shown) remains relatively fixed with respect to the work surface 60 as the bottom tray 860 is rotated by the user.

FIGS. 25-33 illustrate a movable work surface assembly 80 constructed in accordance with a preferred embodiment of the invention. While the work surface assembly 80 as shown has a generally rectangular shape with curved front and back edges, it should be understood that the present invention may be used with work surfaces having a wide variety of shapes, sizes and appearances. The work surface assembly 80 is a versatile element adjustable in both height and angle to suit the needs of a particular user. This adjustment feature allows the work surface assembly 80 to be adjusted to suit the particular work being done and the physical characteristics of the body type of the user.

The work surface assembly 80 includes a work surface 902 sized to support a work implement such as keyboard, mouse or pen and paper. However, the work surface assembly 80 has a wide range of uses with other types of work implements. The work surface 902 has a curved front edge 904, two side edges 906, 908, and a curved rear edge 910. Front legs 912, 914 extend downward from the bottom surface 916 adjacent the front edge 904. Rear legs 918, 920 extend downward from the bottom surface 916 adjacent the rear edge 910. The legs 912, 914, 918 and 920 include four top portions 924 that slidably fit within four bottom portions 926. The bottom portions 926 include a plurality of vertically aligned apertures 930. An upper crossbeam 934 interconnects the rear legs 918, 920. Lower crossbeams 940, 942 interconnect the front legs 912, 914 and the rear legs 918, 920. Wheels 944 are attached to the bottom of the front legs 912, 914 and the rear legs 918, 920.

Figure 26:
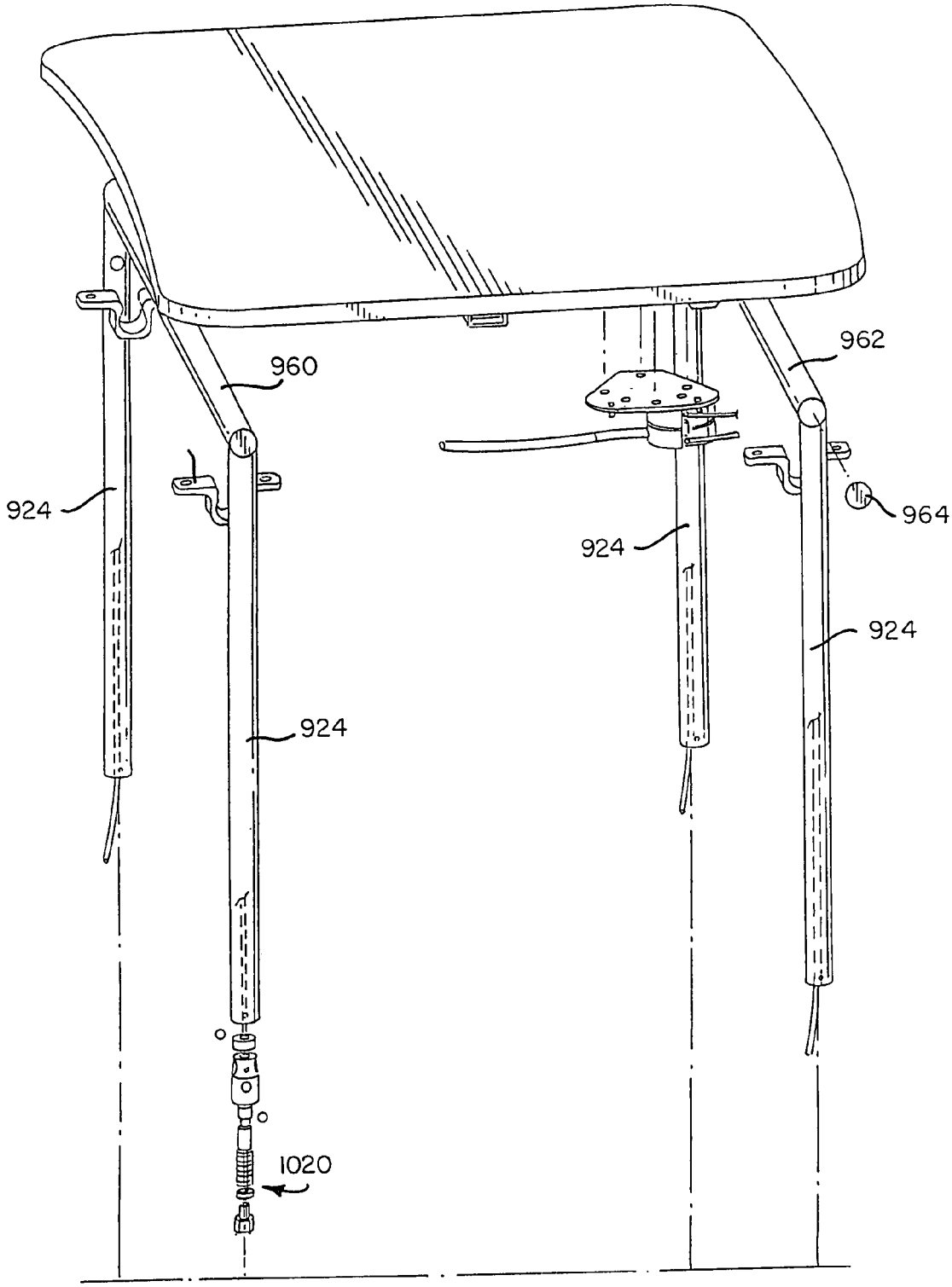
FIG. 26 is a partially exploded view of the movable work surface illustrated in FIG. 25.
Figure 27:
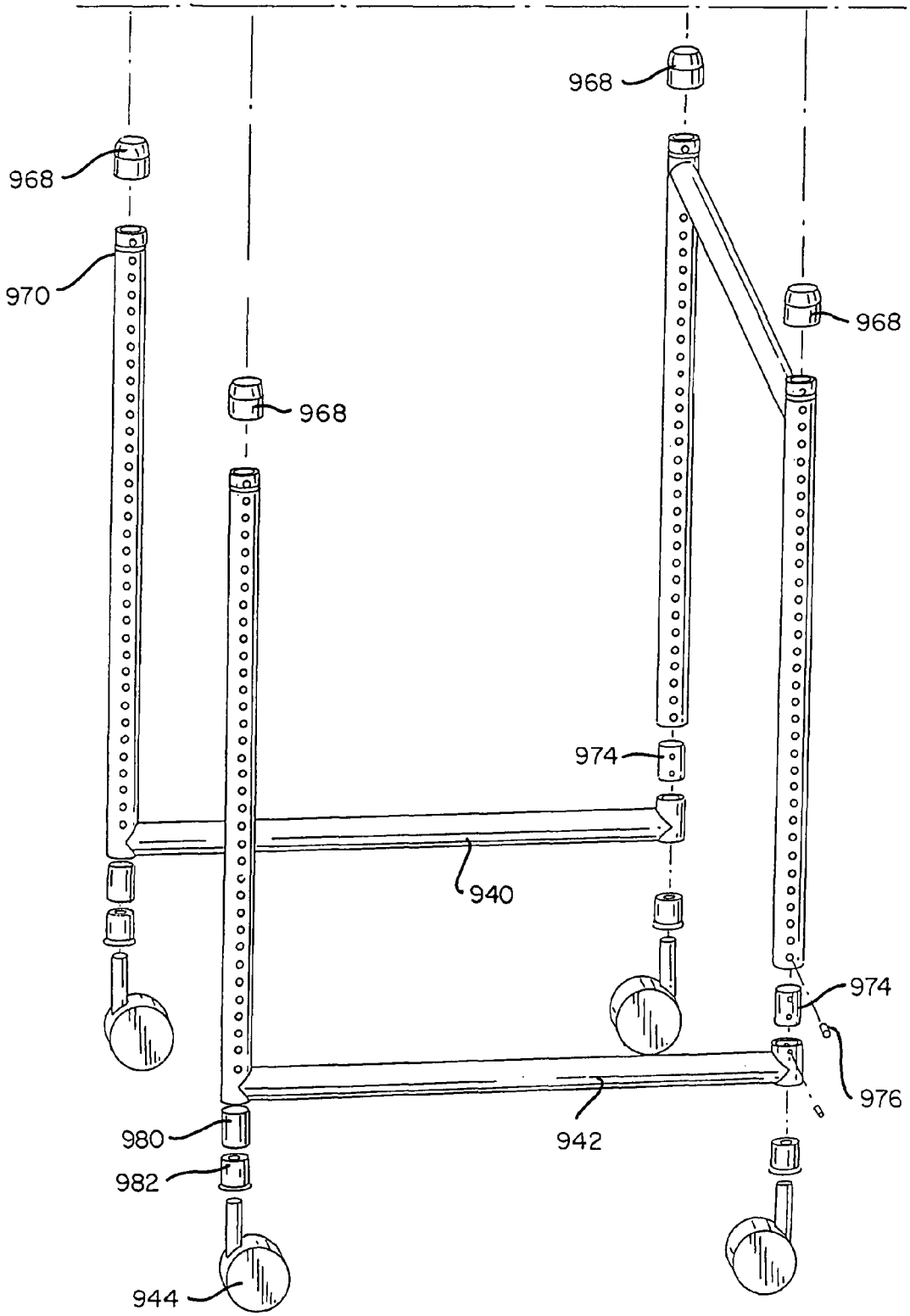
FIG. 27 is a partially exploded view illustrating the blow up portion of the movable work surface.
Figure 28:
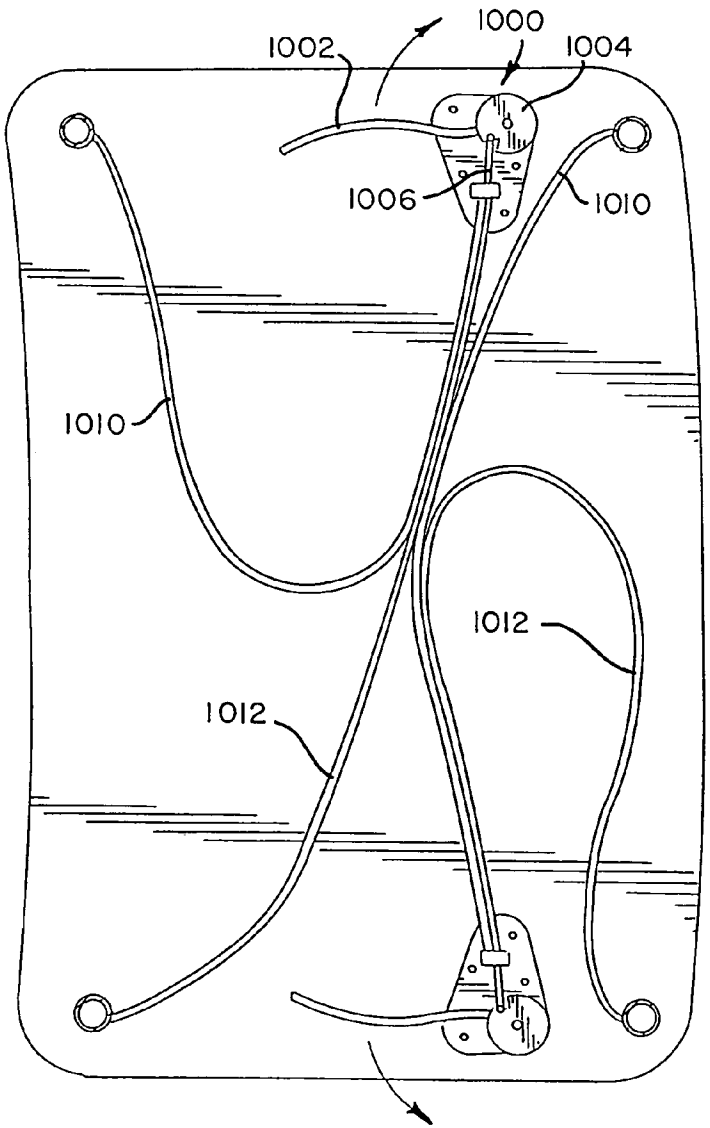
FIG. 28 is a bottom view of the movable work surface.
Figure 29:
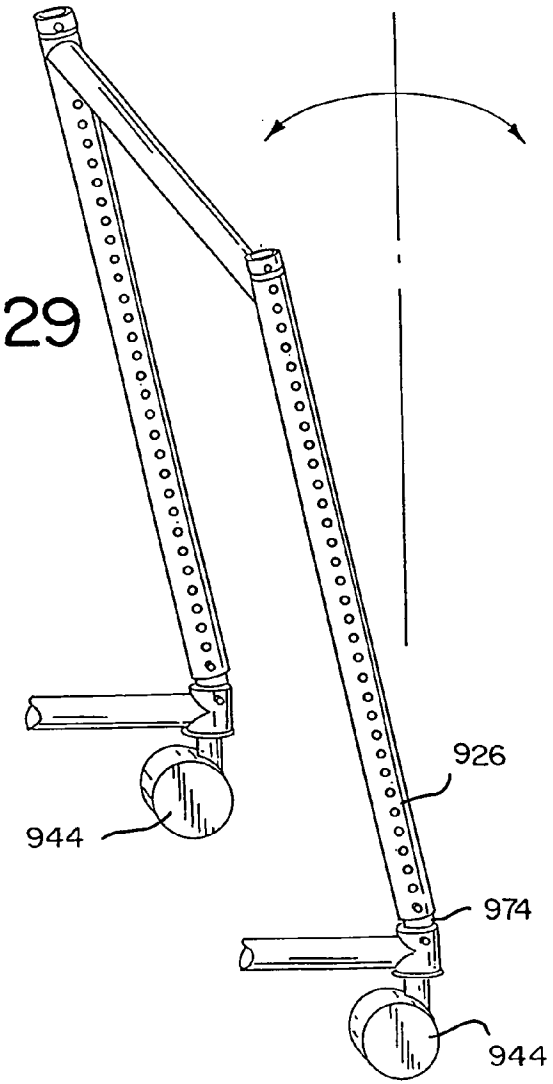
FIG. 29 is a partially broken away view of the movable work surface illustrating the pivotal movement of the rear legs.

FIGS. 26 and 27 further illustrate the assembly of the front legs 912, 914 and the rear legs 918, 920. As shown in FIG. 26, the front legs 912, 914 are interconnected by the crossbeam 960. The rear legs 918, 920 are interconnected by the crossbeam 962. Caps 964 are used to cover the open ends of the crossbeams 960, 962. The top portions 924 and the bottom portions 926 are best illustrated in FIG. 27. Collars 968 are located at the upper end 970 of the bottom portions 926 in order to provide for a better engagement between the top portions 924 and the bottom portions 926. The rear legs 918 and 920 are attached to the crossbeams 940, 942 using a flexible coupling 974. The flexible coupling 974 allows the legs 918, 920 to pivot as needed when the work surface assembly 80 is adjusted to a nonhorizontal position (see FIG. 29). Conventional fastening mechanisms such as pins 976 are used to interconnect the bottom portions 926 of the rear legs 918, 920. Wheels 944 are attached to the bottom portion of the legs 912, 914, 918, 920 using a conventional fastening mechanism such as coupling 980, 982.

Figure 30:
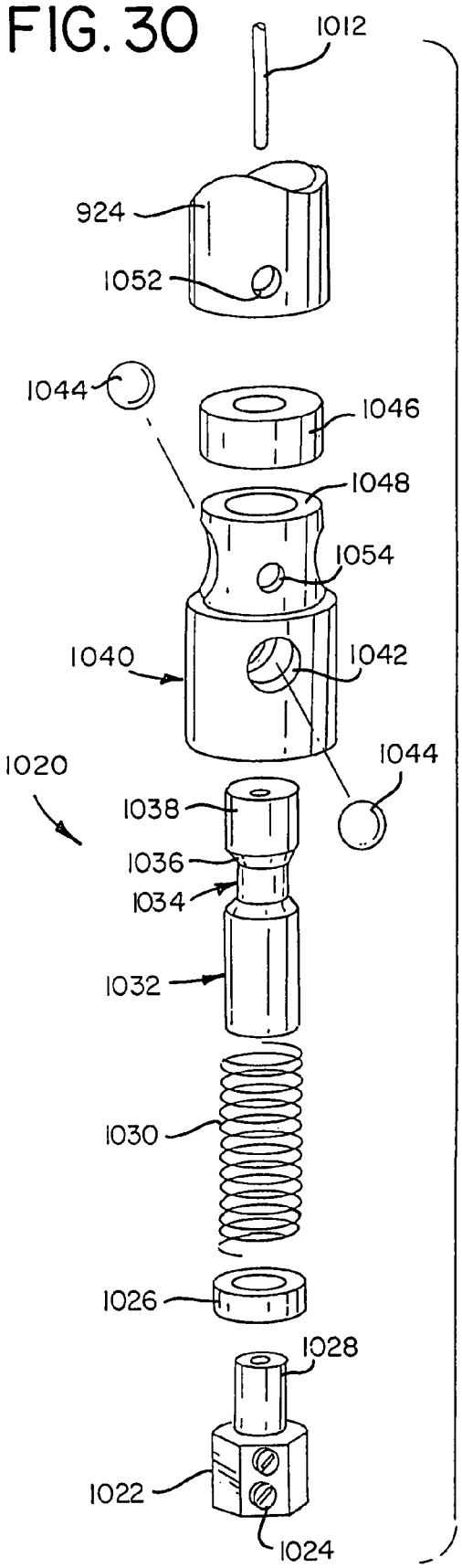
FIG. 30 is an exploded view of the locking mechanism of the present invention.
Figure 31:
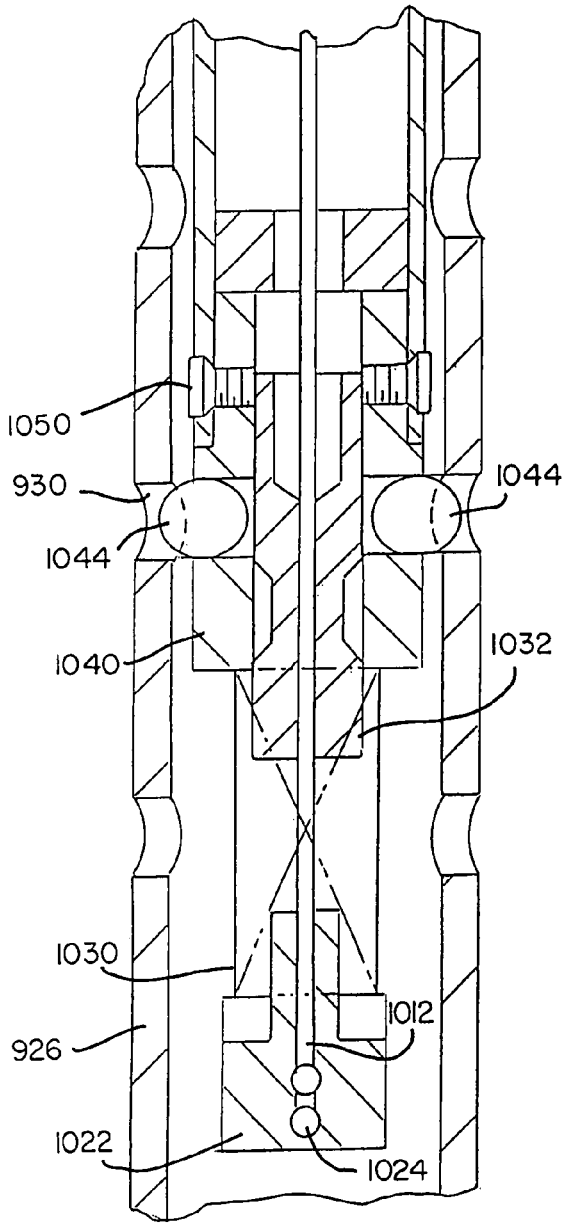
FIGS. 31 and 32 are cross-sections of the leg and locking mechanisms illustrating the locked and unlocked positions.
Figure 32:
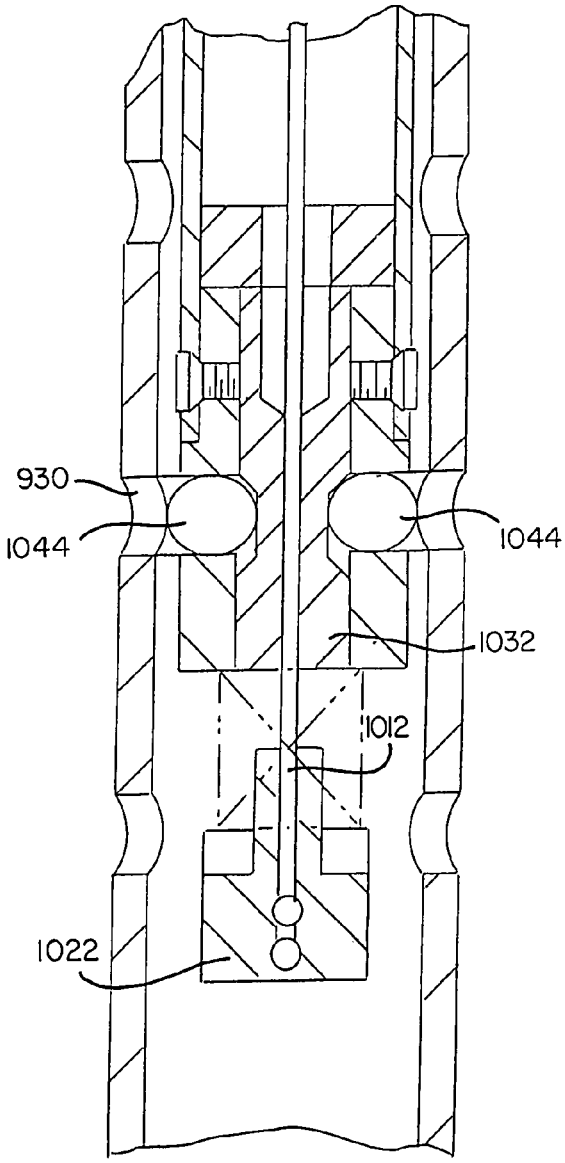

The adjustment mechanism 1000 is best illustrated in FIGS. 28, 30-32. As shown in the bottom view of FIG. 28, the adjustment mechanism 1000 includes two actuation members 1002. The actuation members 1002 are attached to the bottom surface 916 adjacent the first side edge 906 and second side edge 908 of the work surface 902. Each actuation member 1002 is connected to a pivotable collar 1004 and cabling 1006. Cabling 1006 includes a first member 1010 and a second member 1012. Cabling 1010, 1012 extend into the legs 912 and 914, 918 and 920, respectively. The operation of the locking assembly 1020 is best illustrated in FIGS. 30-32. The locking assembly 1020 is used on all the legs 912, 914, 918 and 920. With particular reference to the exploded view shown in FIG. 30, the locking assembly 1020 includes cable member 1012 which extends downward to a retainer 1022. Conventional fastening elements such as screws 1024 are used to attach the cabling element to the retainer 1022. A washer 1026 fits over a hub 1028 of the retainer 1022. A spring mechanism 1030 extends above the retainer 1022 and adjacent a spool 1032. The spool 1032 includes a cut-out portion 1034 having angled sides 1036 and an outer surface 1038. The spool 1032 is slidably fit within the housing 1040. The housing 1040 includes circular apertures 1042 in which ball bearings 1044 are slidably engaged. Washer 1046 is positioned adjacent the top surface 1048 of the housing 1040. A conventional fastening mechanism such as a screw 1050 is used to secure the locking assembly 1020 to the top portion 924 of the leg. In particular, the screw 1050 is threaded into an aperture 1052 of the top portion 924 of the leg and into an aperture 1054 of the housing 1040 (see FIGS. 31 & 32).

FIGS. 31 & 32 best illustrate the adjustment capability of the work surface assembly 80. When in the locked position as illustrated in FIG. 31, the ball bearings 1044 are pressed against the outer surface 1038 of the spool 1032 such that they engage the apertures 930. In this position, the upper portion 924 is locked into position with respect to the bottom portion 926 of the legs 912, 914, 918 and 920. By depressing the actuation member 1002 a user may adjust the positioning of the work surface assembly 80. In particular, by pulling the actuation member 1002 the cabling 1012 is pulled upward such that the spool 1032 is pulled into the position illustrated in FIG. 32. As shown in FIG. 32, the upward movement of the spool 1032 directs a cutout portion 1034 to a position adjacent one of the apertures 930. As a result, the ball bearings 1044 slide inward so as not to be captured within the apertures 930. As a result, the leg is freely adjustable upward or downward when in this position. By releasing the actuation member 1002, the spool 1034 is again moved downward through the action of the spring 1030 to the position illustrated in FIG. 31, thereby locking the leg at a selected height.

Use of the adjustment mechanism 1000 allows the work surface 902 to be adjusted both horizontally and angularly. The user could depress the actuation members 1002 simultaneously in order to vertically adjust the work surface 902 upward or downward. Alternatively, a user could depress one of the actuation members 1002 in order to angularly adjust the front edge 904 or rear edge 910 of the work surface 902.

Figure 33:
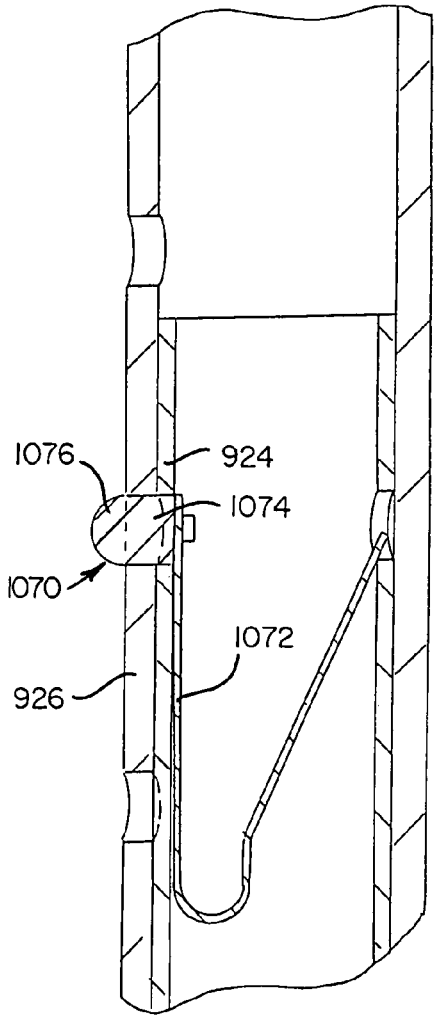
FIG. 33 is a cross-section of an alternate locking mechanism useful with the movable work surface illustrated in FIGS. 25-32.

An alternate embodiment of an adjustment mechanism 1070 is illustrated in FIG. 33. The adjustment mechanism 1070 includes a resilient clip portion 1072 and a outwardly extending tab portion 1074. The tab portion 1074 can engage one of the apertures 1076 in order to lock the leg into a selected position. By depressing the tab portion 1074, the leg can be adjusted to a new height.

The preferred embodiment of the movable work surface 82 as illustrated in FIG. 1C includes an alternate height adjustment mechanism. The legs 1090 have top portions 1092 and bottom portions 1094. At least one aperture is located within the top portions 1092 and a plurality of apertures are located in bottom portions 1094. A moveable ball detent pin having a conventional locking mechanism that can be used to lock the moveable work surface at a desired height. The movable work surface 80 or 82 can include clip 1100 for accessories such a file bag, mouse pad or the like as illustrated in FIG. 26.

Figure 34:
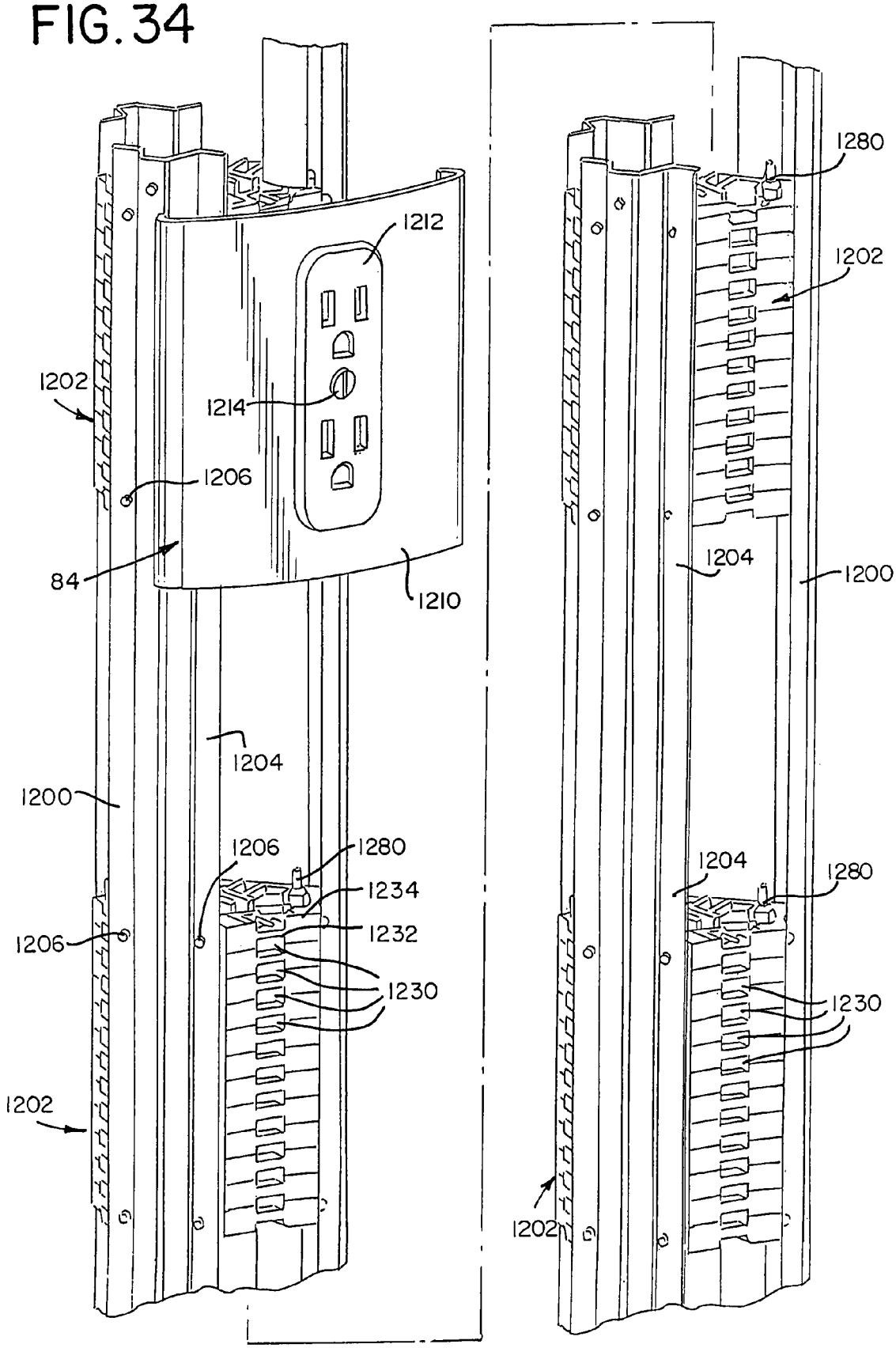
FIG. 34 is an illustration of the electrical connection system within the interior of the pole.

FIGS. 34-39 illustrate a preferred embodiment of a power distribution system useful with the present invention. With particular reference to FIG. 34, rails 1200 are located within the poles 18. The rails 1200 extend vertically within the poles 18 with the blocks 1202 located intermittently along the rails. The blocks 1202 are secured to the rails at the edge portions 1204 using a conventional securing means such as a screw 1206.

With particular reference again to FIG. 34, a receptacle 84 as illustrated in FIG. 1B, is shown attached to the electrical block 1202. The receptacle 84 includes an outer cover portion 1210 and a standard duplex receptacle 1212. A conventional securing element 1214 is used to connect the duplex receptacle 1212 to the receptacle 84.

Figure 38:
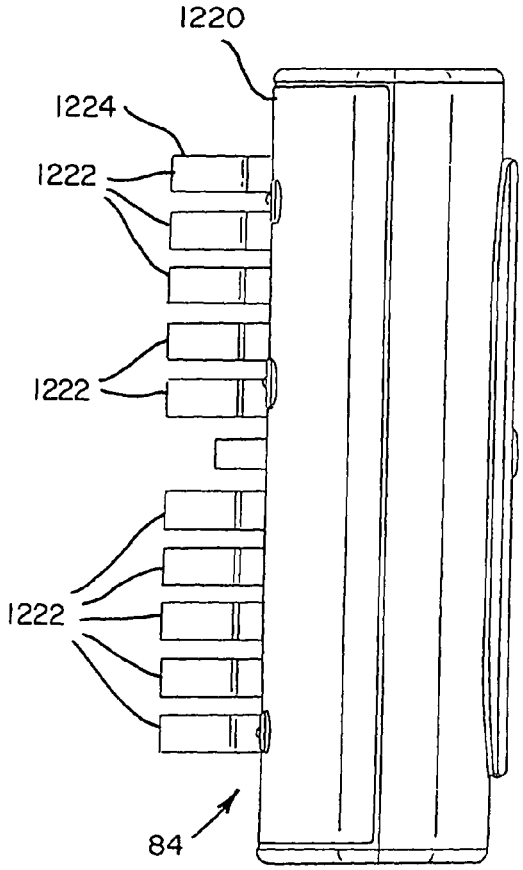
FIG. 38 illustrates a side view of a receptacle as illustrated in FIG. 34.

Referring to FIG. 38, a side view of the receptacle 84 is illustrated. A plurality of electrical contacts 1222 extend from the rear surface 1220. The electrical contacts 1222 include an outer housing 1224 and an internal electrical contact. The electrical contacts 1222 fit within apertures 1230 formed in the block 1202. The apertures 1230 are formed by cutout portions 1232 within the wafers 1234.

Figure 35:
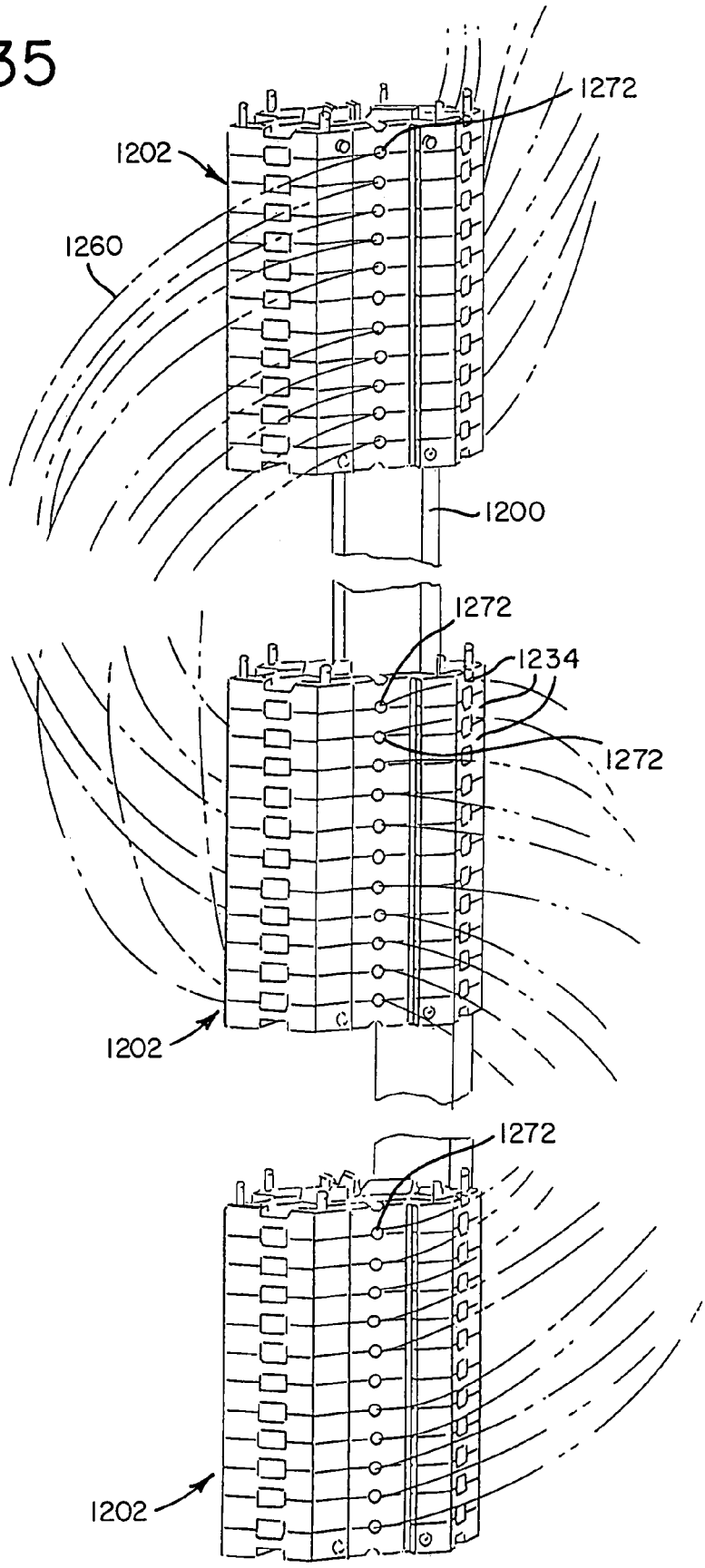
FIG. 35 illustrates the connection of the electrical block assemblies to one another within the interior of the pole.
Figure 37:
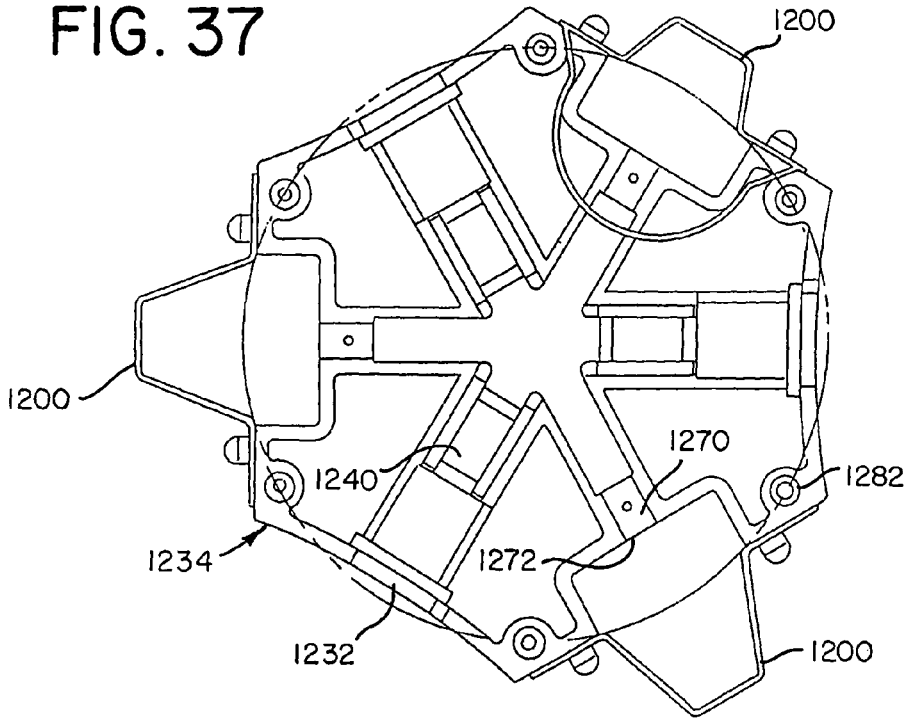
FIG. 37 illustrates a wafer used to construct the electrical block assembly.

Referring to FIG. 37, the cutout portions 1232 are illustrated. The contact 1240 is adapted to connect with the contact within the contact 1222 of the receptacle 84. The blocks 1202 are interconnected via wires 1260 as illustrated in FIG. 35. The wires 1260 pass from one block to another in order to provide for power distribution to the various blocks 1202. Referring again to FIG. 37, the wires are located within the portion 1270 of the wafers 1234 and pass out and into the holes 1272 (FIG. 35). In this manner, the wires 1260 provide for power access to the contact 1240 and to a user via the receptacle 84. The wafers 1234 are preferably formed from a polycarbonate material. The wafers 1234 include plugs 1280 and a corresponding aperture 1282 in order to form the block assembly 1202. It is an important aspect of the present invention that the block 1202 may be assembled using a wide number of wafers 1234. In particular, as few as six wafers 1234 may be used in order to provide a five-wire circuit connection. Alternatively, as many as 13 wafers can be used to provide a 12-wire circuit. Of course, as those of ordinary skill in the art will recognize, the block 1202 can be configured to provide greater than a 12-wire connection as well. The block 1202 also provides for power distribution via three discrete directions. In this manner, as many as three receptacles can be attached to a single block 1202 in order to distribute power via the receptacles 84 in three discrete directions. It should be recognized, however, that the block 1202 could be configured into alternate forms so as to provide power distribution in as few as two directions and more than three directions.

Figure 36:
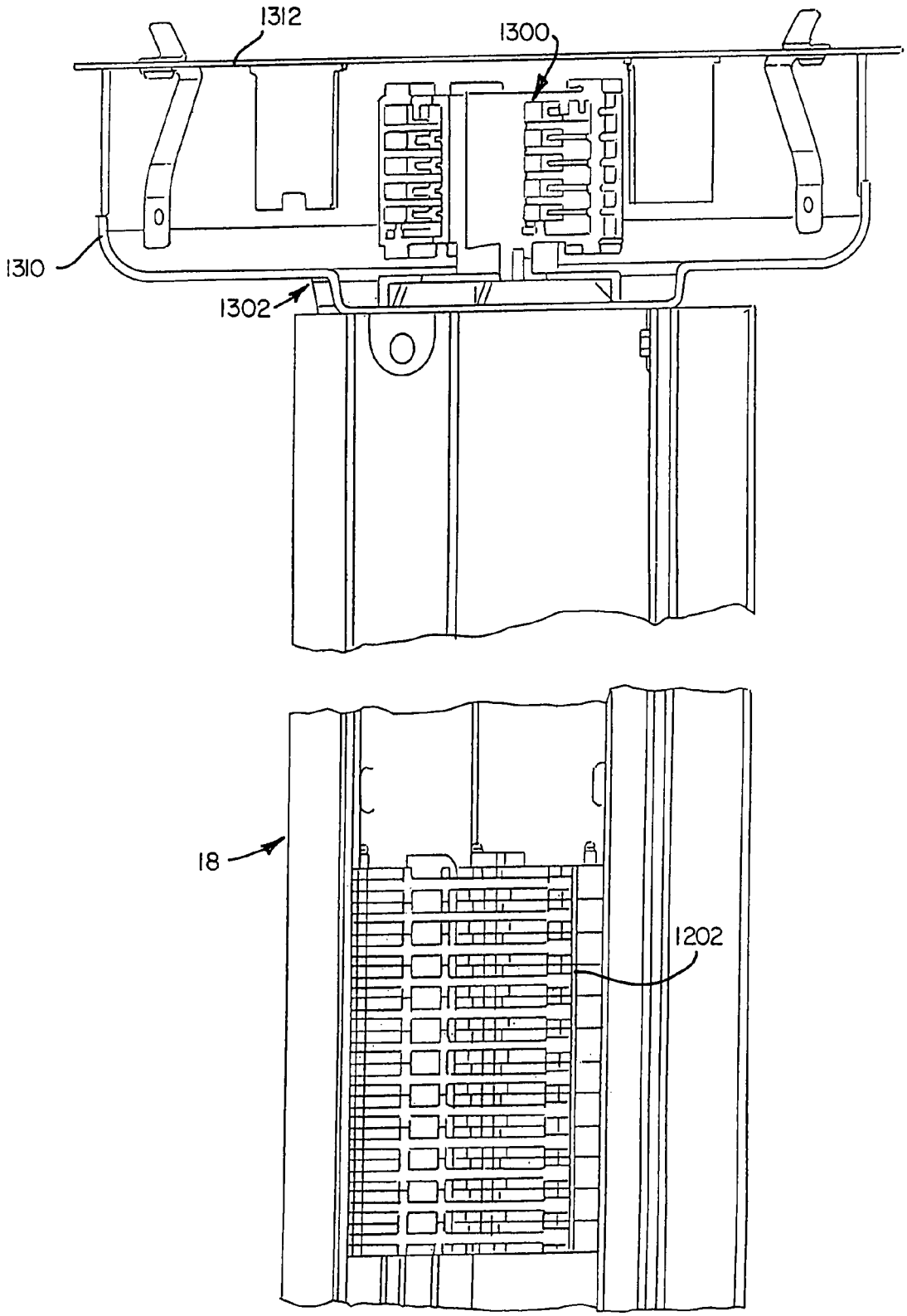
FIG. 36 illustrates the electrical system within an upper portion of the pole.
Figure 39:
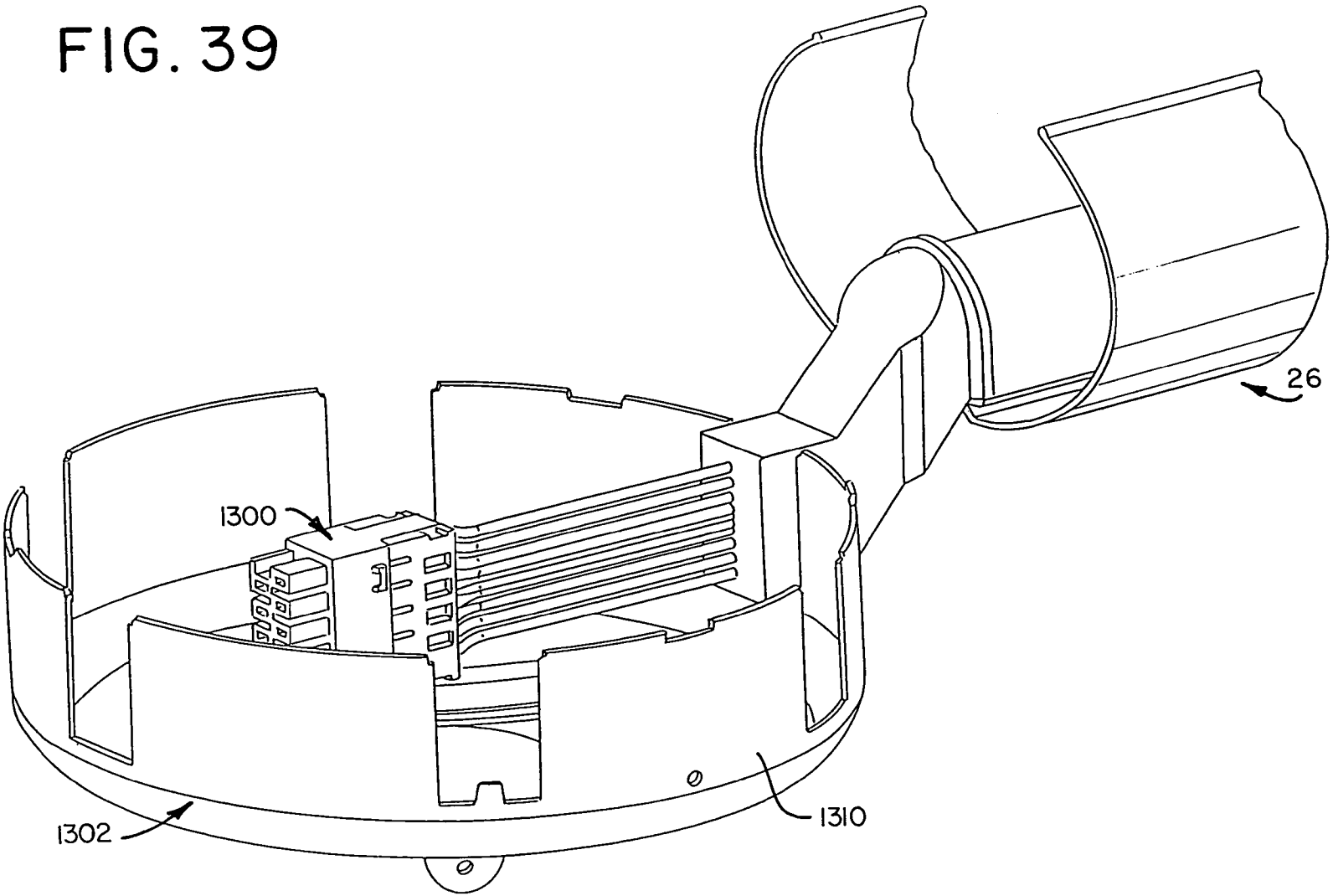
FIG. 39 illustrates the electrical connection member in the upper portion of the pole.

FIGS. 36 and 39 illustrate the connection of a block 1202 to a conventional PENT harness assembly 1300 located within the top portion 1302 of a pole 18. The power is then distributed via the upper crossbeams 26 using a conventional harness assembly. An outer shell 1310 and cover 1312 are also illustrated in the Figures.

Figure 40A:
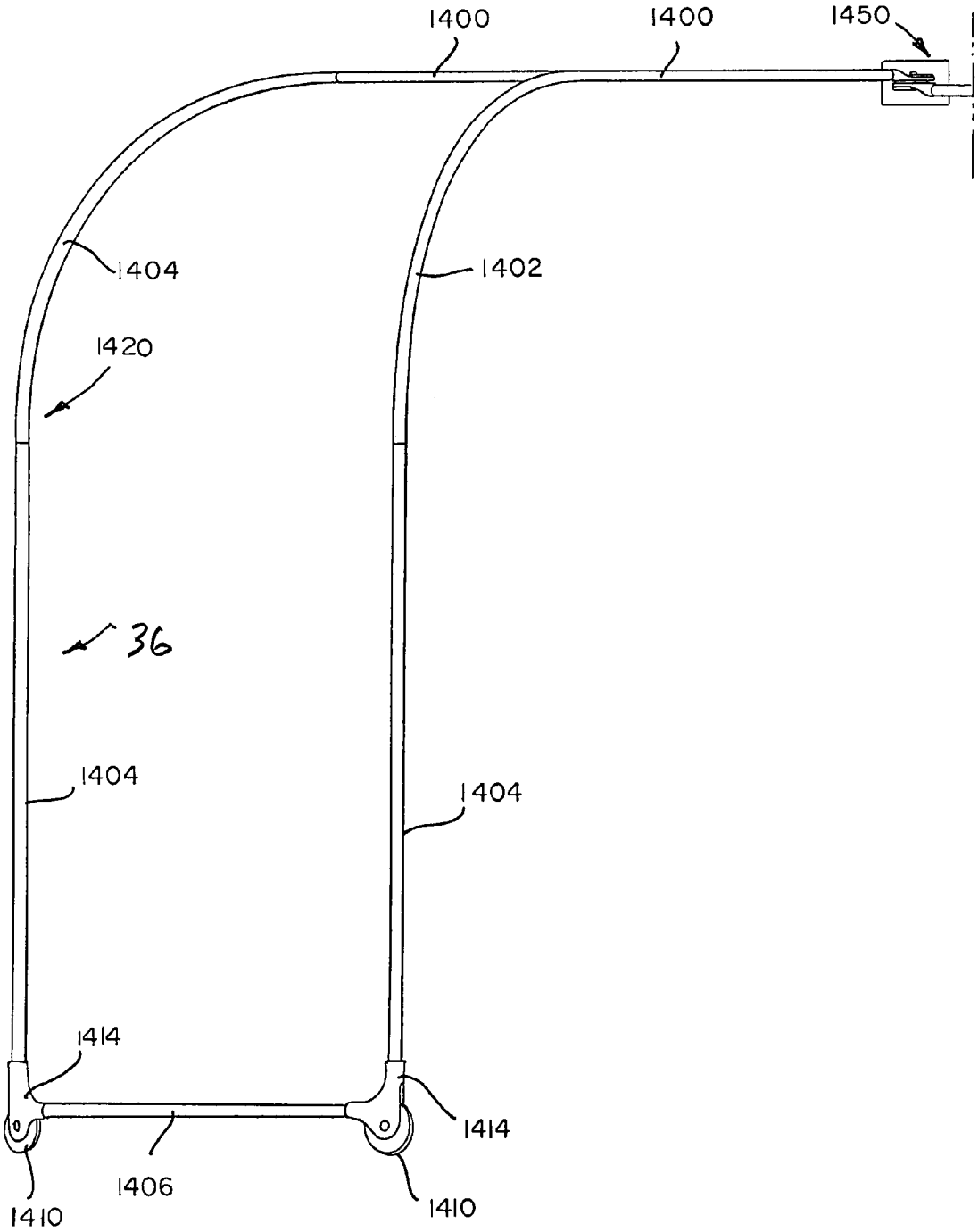
FIGS. 40A and B illustrate a preferred embodiment of a movable barrier member.
Figure 40B:
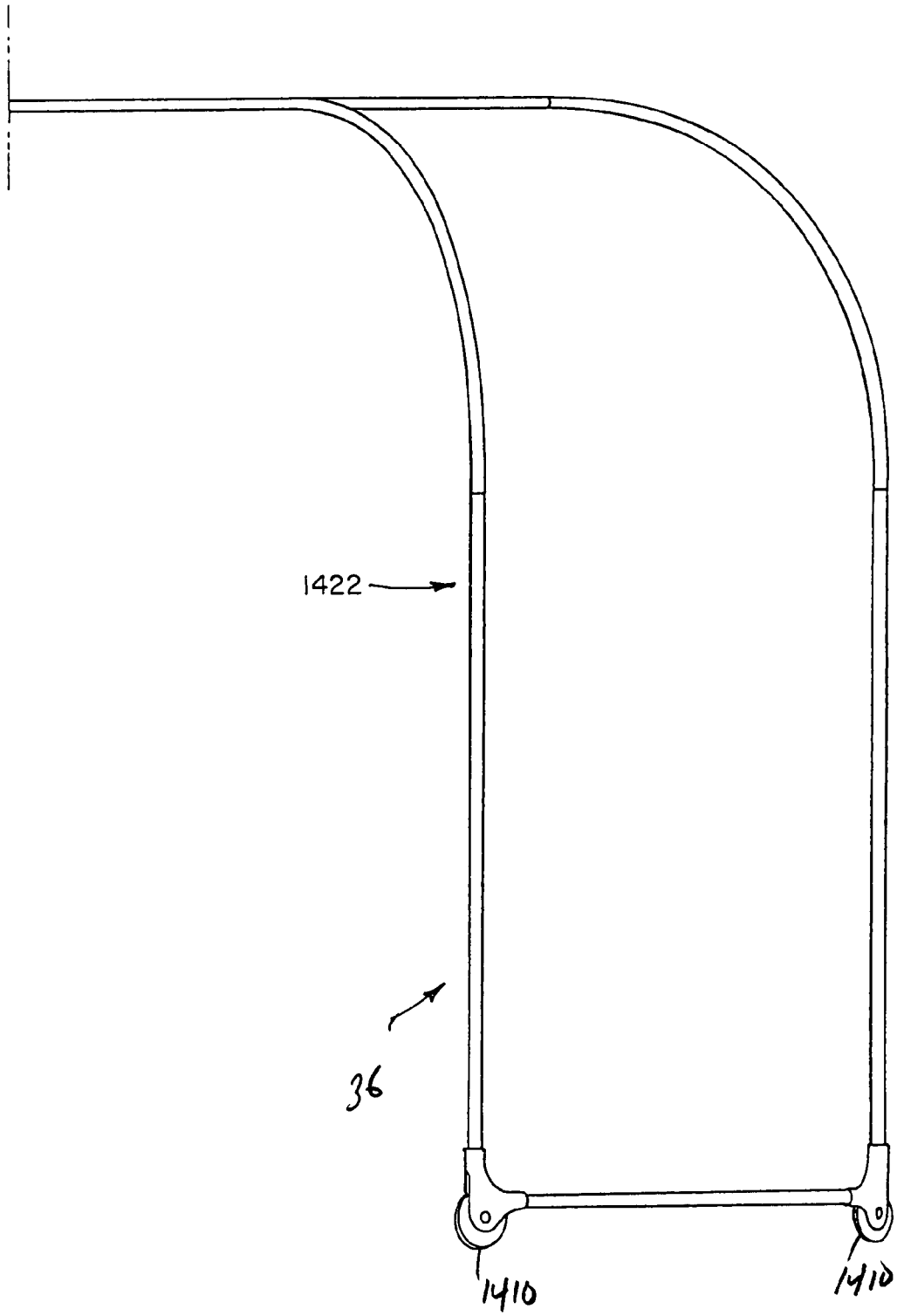

FIGS. 40A and B and FIG. 41 illustrate a preferred embodiment of the moveable or rolling barrier member 104. The rolling barrier member 104 includes top portions 1400, curved intermediate portions 1402 and bottom portions 1404. A connection portion 1406 connects the two sides of the rolling barrier member 104. Wheels 1410 are connected to the collars 1414. The collars 1414 interconnect the bottom portions 1404 to the connection portion 1406. The rolling barrier member 104 includes a first movable member 1420 and a second movable member 1422 constructed as identified above. The first member 1420 and the second member 1422 are designed to be collapsible one behind the other in order to minimize the area covered by the rolling barrier member 1404. Alternately, the first member 1420 and second member 1422 can be adjusted into a wide variety of positions such as those illustrated in FIGS. 1D and E and 40A and B.

The connection member 1450 is best illustrated in FIG. 41. The top portions 1400 are connected to collars 1452. The collars 1452 are connected using the pivot bolt 1460. A washer 1462 is interspaced between the collars 1452. The connection member 1450 allows the members 1420 and 1422 to be readily adjusted into a wide variety of positions such as a collapsed position, a spaced apart position or a position directly adjacent to one another. A conventional fabric may be used to cover the members 1420 and 1422.

Figure 42A:
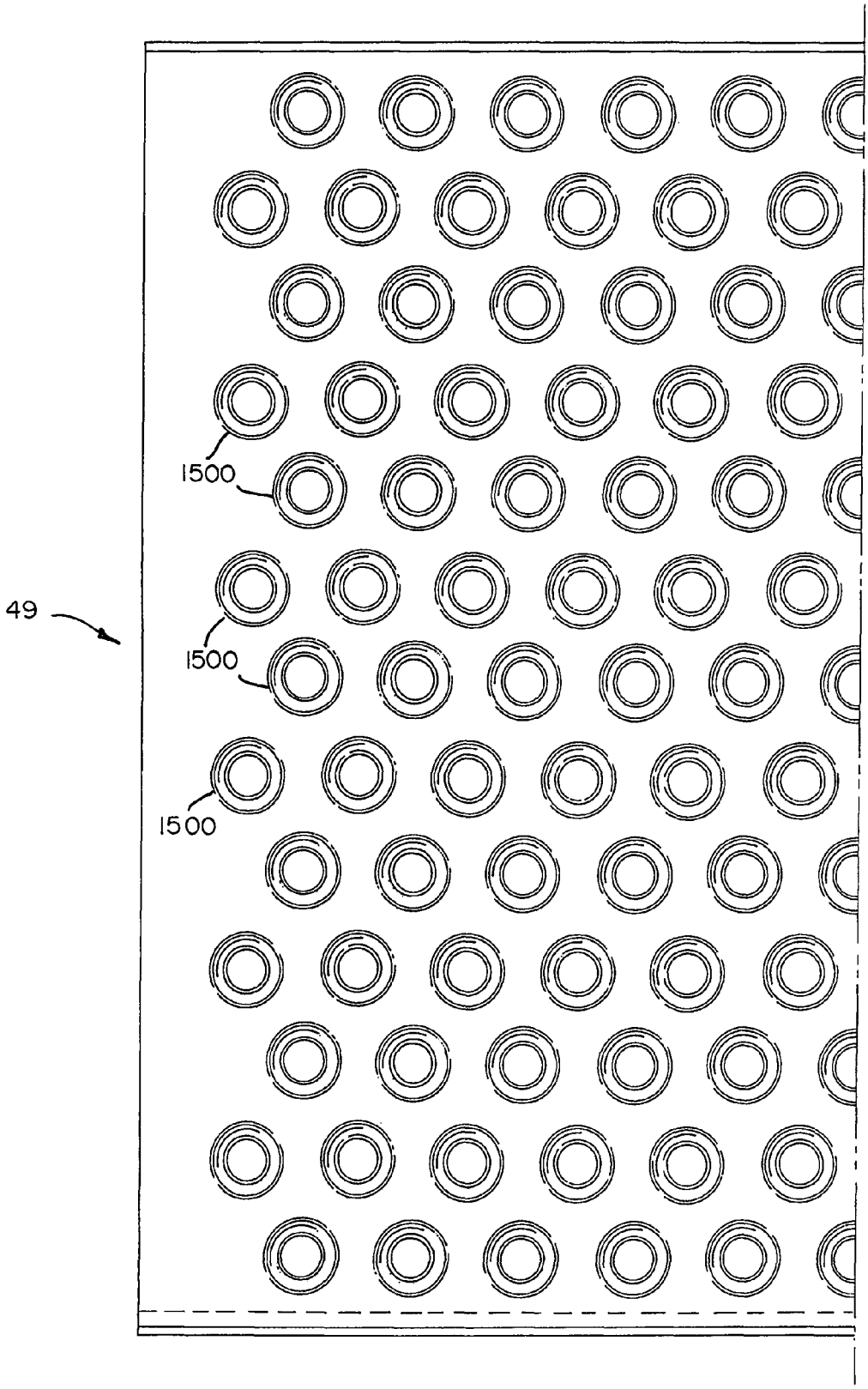
FIGS. 42A and B illustrate a preferred embodiment of a barrier member useful with the system shown in FIGS. 1A-E.
Figure 42B:
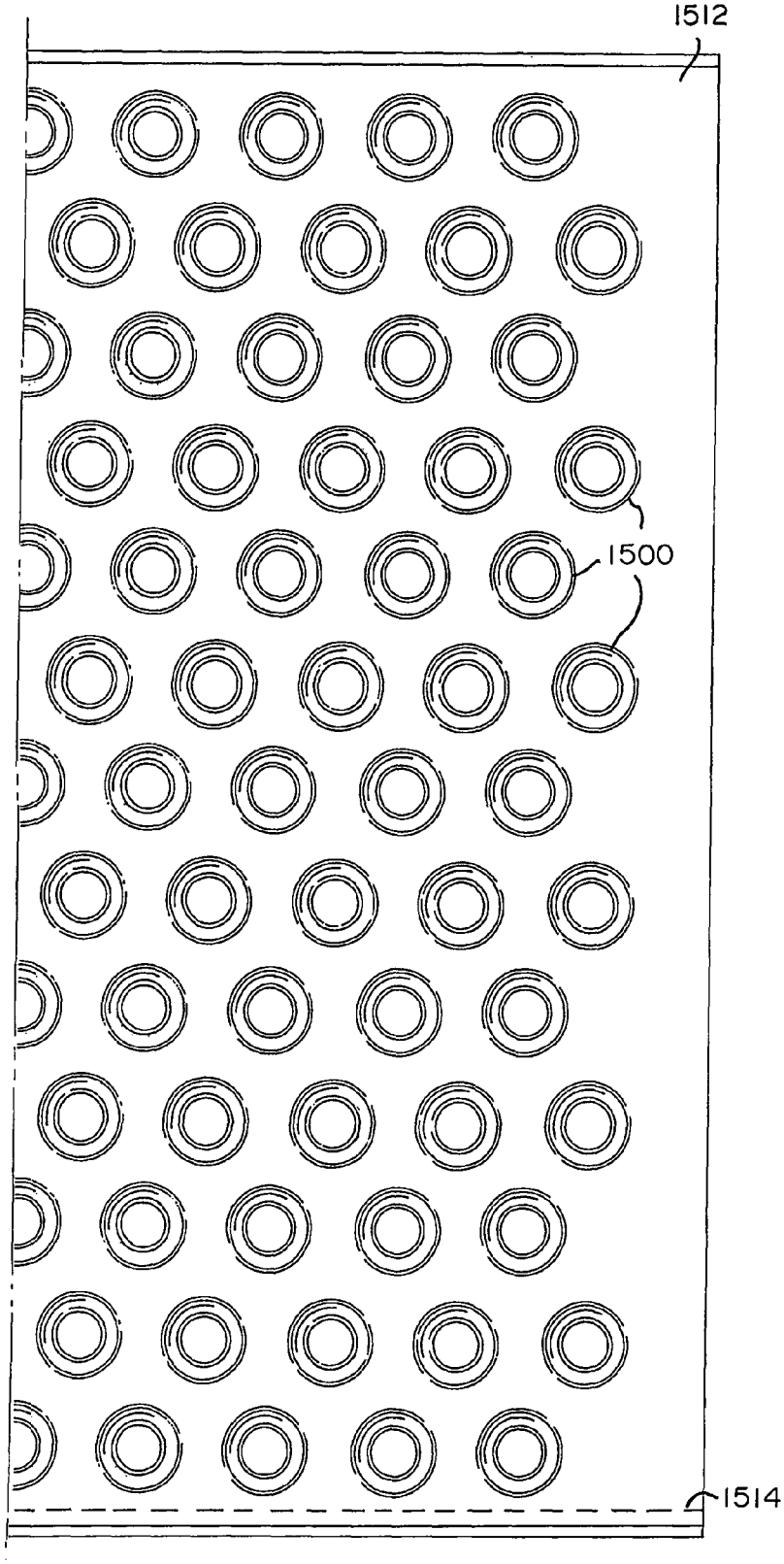

FIGS. 42A and B through 44 illustrate a preferred embodiment of a barrier member 49 as seen in FIG. 1C. The barrier member 49 is preferably formed from a conventional fabric material and a PETG backing material. A Velcro loop material is also attached to the outer surface of the barrier member 49. The barrier member 49 is preferably manufactured using a bladder bonding process. The bladder bonding process is useful in melting an adhesive attached to the backing material and forms the protrusions 1500 as illustrated in FIGS. 42A and B. The protrusions 1500 are preferably rounded in shape. Although other configurations as recognized by those of ordinary skill in the art could be implemented with the present invention.

Figure 43:
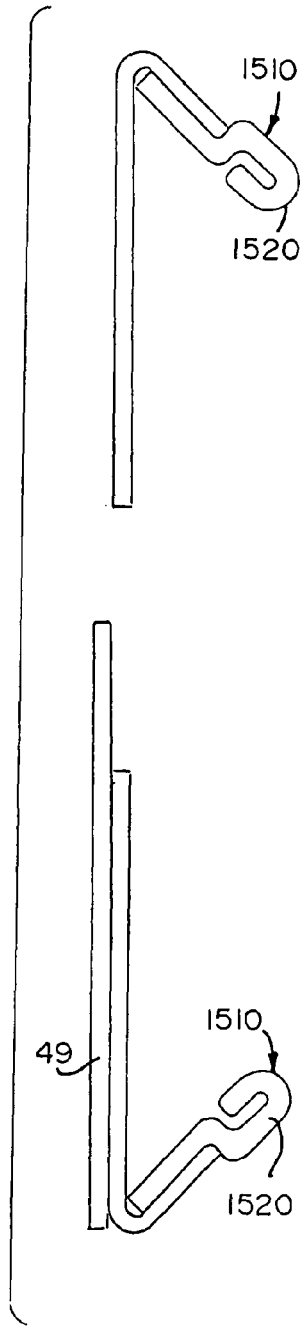
FIG. 43 illustrates a preferred embodiment of a connection member useful to attach a screen to a crossbeam.

FIG. 43 illustrates a connection mechanism used to attach the barrier member 49 to the crossbeams 24, e.g. a shown in FIG. 14A. More specifically, hooks 1510 are sewn to a top portion 1512 and a bottom portion 1514 of the barrier member 49. The hooks 1510 are sized to fit within mating channels within the crossbeams 24. The hooks 1510 include a J portion 1520 particularly sized to fit within the corresponding channels of the crossbeams 24.

Figure 43A:
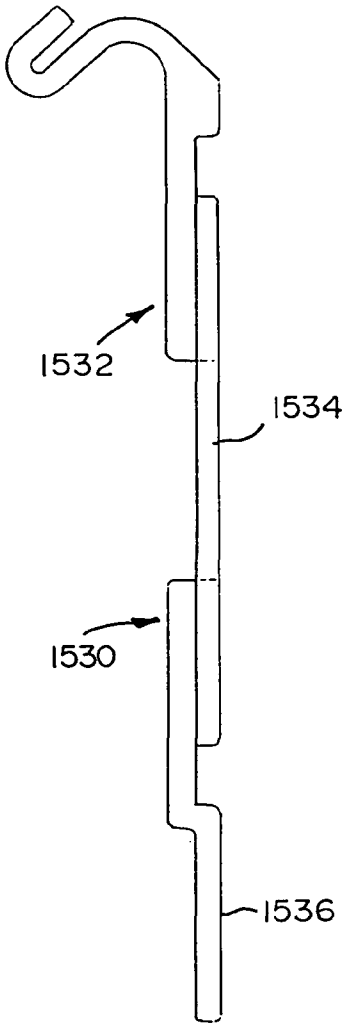
FIG. 43A illustrates another preferred embodiment of a connection member useful with a barrier member or a screen.

An alternate preferred embodiment of a connection mechanism 1530 is illustrated in FIG. 43A. The connection mechanism 1530 is useful with barrier members of different sizes as illustrated herein. A hook shaped portion 1532 is secured within the cavity of an associated crossbeam. The hook shaped portion 1532 is attached to an elastic material 1534 such as rubber. The bottom portion of the barrier member or yet another intermediate element 1536 is then attached to the elastic material 1534. As a result, the barrier member can accommodate variations in the position of the beams or cuts of the fabric used to form a particular barrier member.

Figure 44:
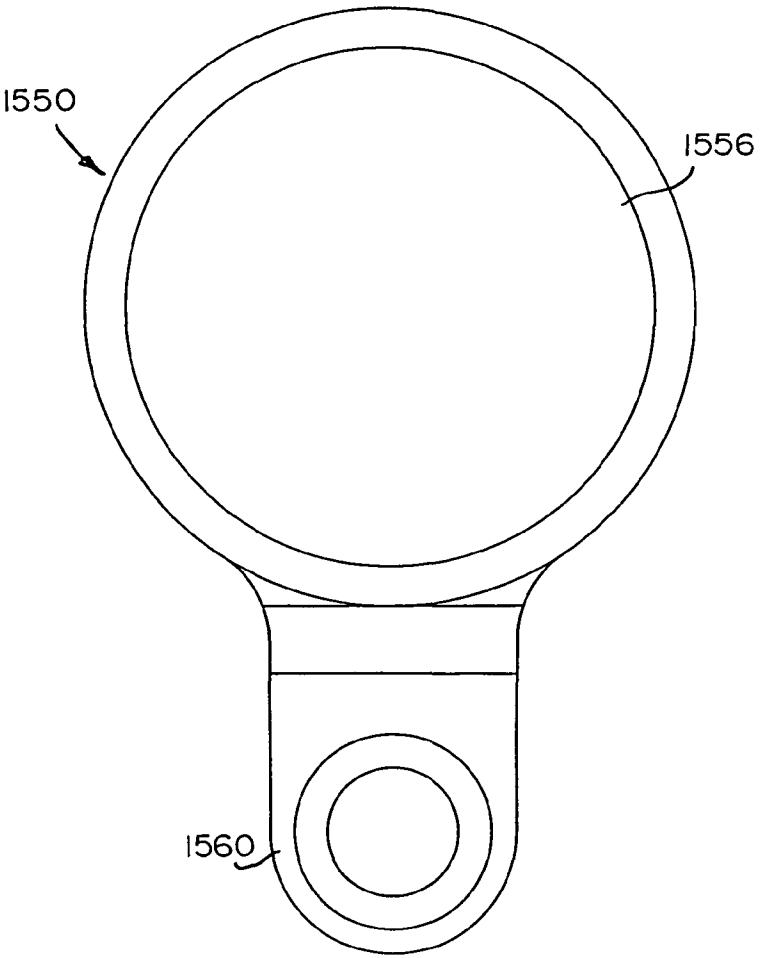
FIG. 44 illustrates a connection member useful with the screen illustrated in FIGS. 42A and B.

Referring to FIG. 44, a utility member 1550 useful with the barrier member 49 is illustrated. The utility member 1550 includes a Velcro fastening material on a surface 1556. The surface 1556 can be attached to one of the protrusions 1500 on the barrier member 49. The utility member 1550 includes a lower portion 1560 which can be attached to a utility portion capable of supporting a piece of paper or other work implement. The utility member 1550 is an example of a wide variety of connection members that may be attached to the barrier member 49 for a wide variety of purposes. The utility member 1550 is particularly useful in that it provides a worker with direct access to a particular work implement.

Figure 46:
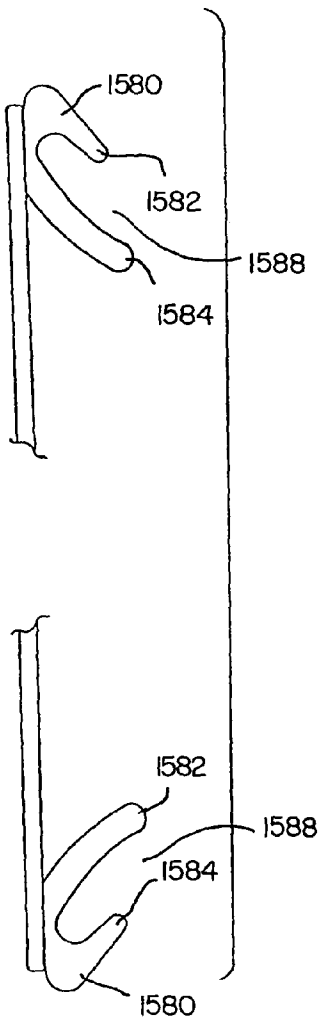
FIG. 46 illustrates a preferred embodiment of a connection member useful to attach the barrier of FIG. 45 to a crossbeams.
Figure 45:
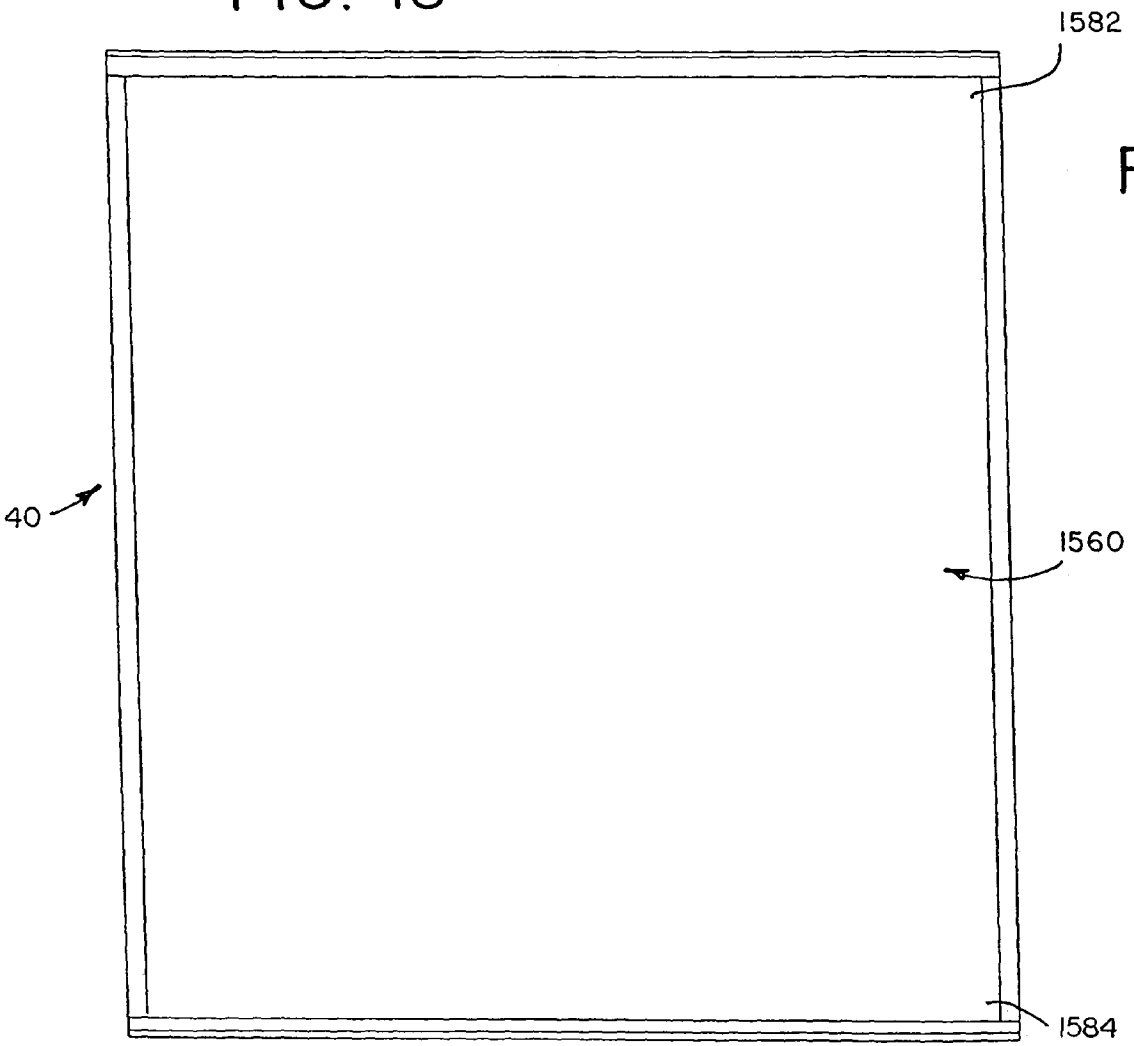
FIG. 45 illustrates an alternate preferred embodiment of a barrier member useful with the system shown in FIGS. 1A-E.

FIG. 45 illustrates the preferred embodiment of the barrier member 40. The barrier member 40 can be constructed using conventional fabric material 1560. With reference to FIG. 46, hooks 1580 are attached to an upper portion 1582 and lower portion 1584 of the barrier member 40. The hooks 1580 include outer portions 1582 and 1584 which are adapted to be connected to the crossbeams 22. The crossbeams 22 include a finger adapted to be received within the channel 1588 defined by the portions 1582 and 1584.

Figure 47A:
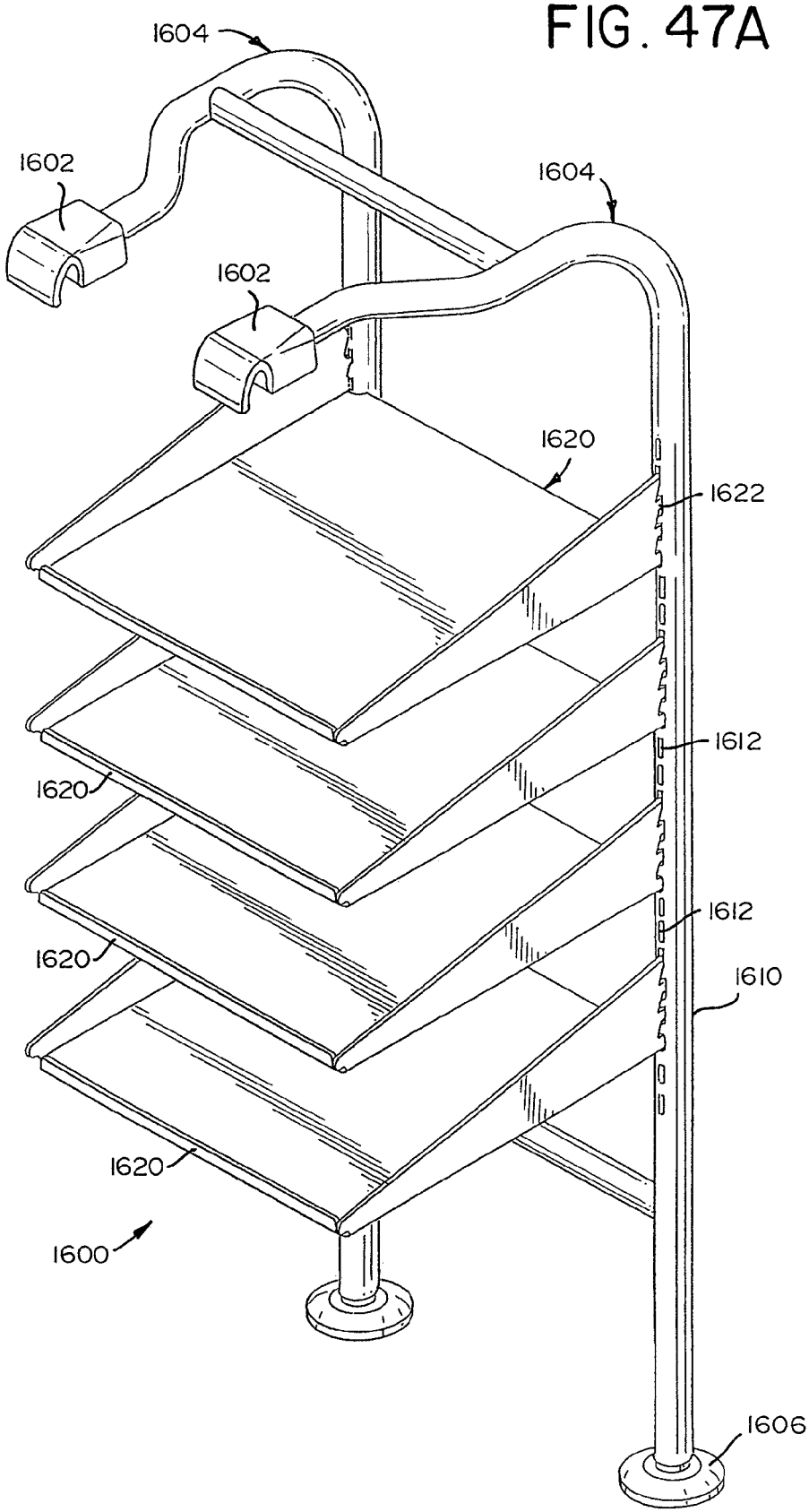
FIGS. 47A and B illustrate a front perspective and side views of a shelving unit useful with the system shown in FIGS. 1A-E.
Figure 47B:
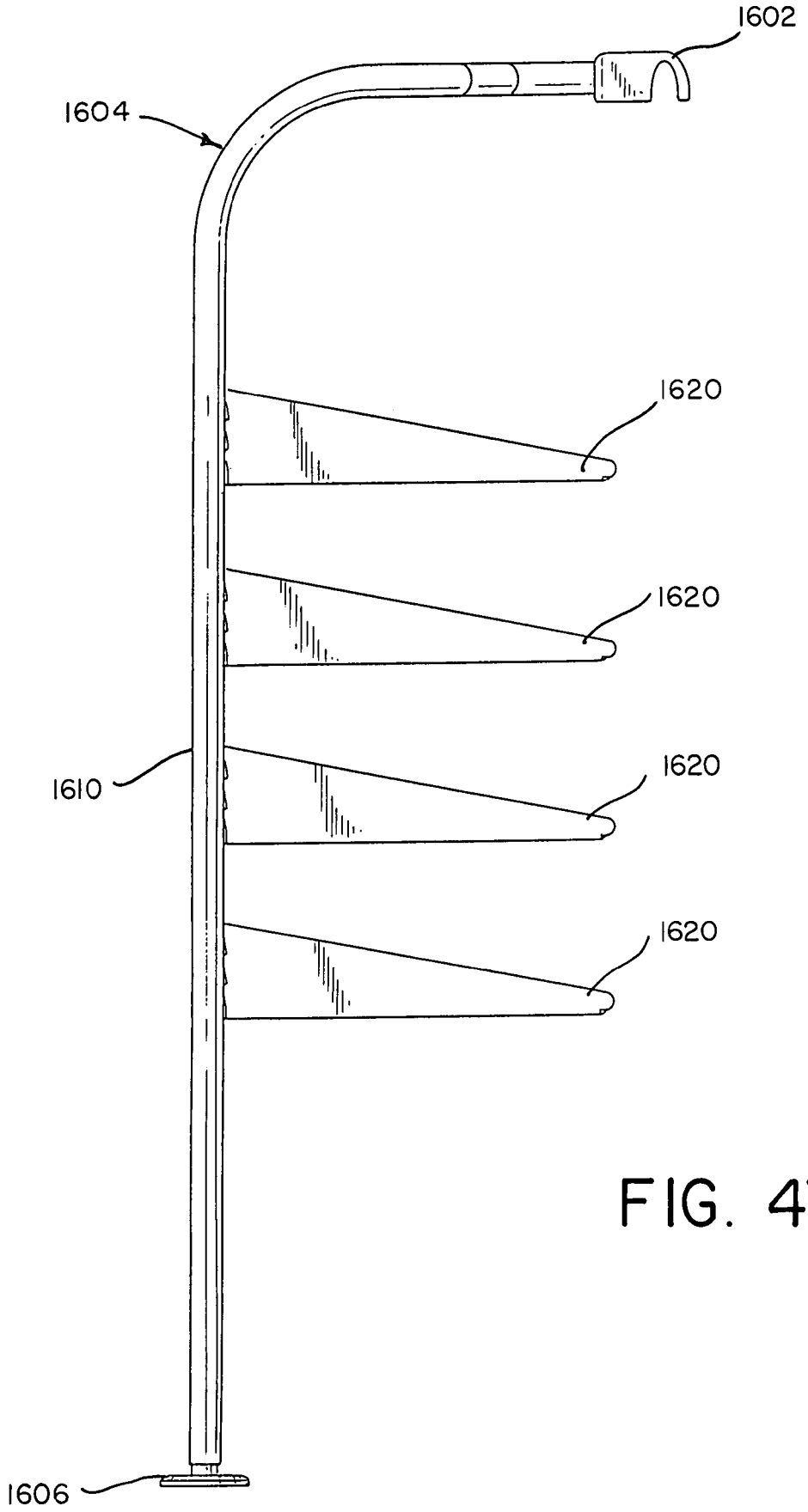

Referring to FIGS. 47A and B, a shelf assembly 1600 is illustrated. The shelf assembly 1600 includes hook portions 1602 adapted to be attached to the crossbeams 24. The hook portions 1602 are preferably formed from a die cast aluminum material adapted to be attached to the crossbeams of the system. Steel tubes 1604 extend outward and downward from the hooks 1602. At the base of the steel tubes 1604, feet 1606 are located. Within an intermediate portion 1610 of the steel tubes 1604, a plurality of hanger slots 1612 are located. Steel shelves 1620 include hanger clips 1622 adapted to fit within the apertures 1612. The shelves 1620 can be configured into a wide arrangement of assemblies as desired by the user. In addition, four shelves 1620 are illustrated in the preferred embodiment of FIGS. 47 and 48. However, as few as one shelf could be used with the present invention, or more than four shelves.

FIGS. 48A and B illustrated a preferred embodiment of tool rail 1650. Upper clips 1652 and lower clips 1654 are used to attach the tool rail 1650 to the crossbeam of the system. Parallel support members 1660 and 1662 are interconnected by a plurality of spaced apart rods 1670. The rods 1670 extend substantially along the length of the support members 1660 and 1662. Work implements and the like can be attached to tool rail 1650.

Figure 49:
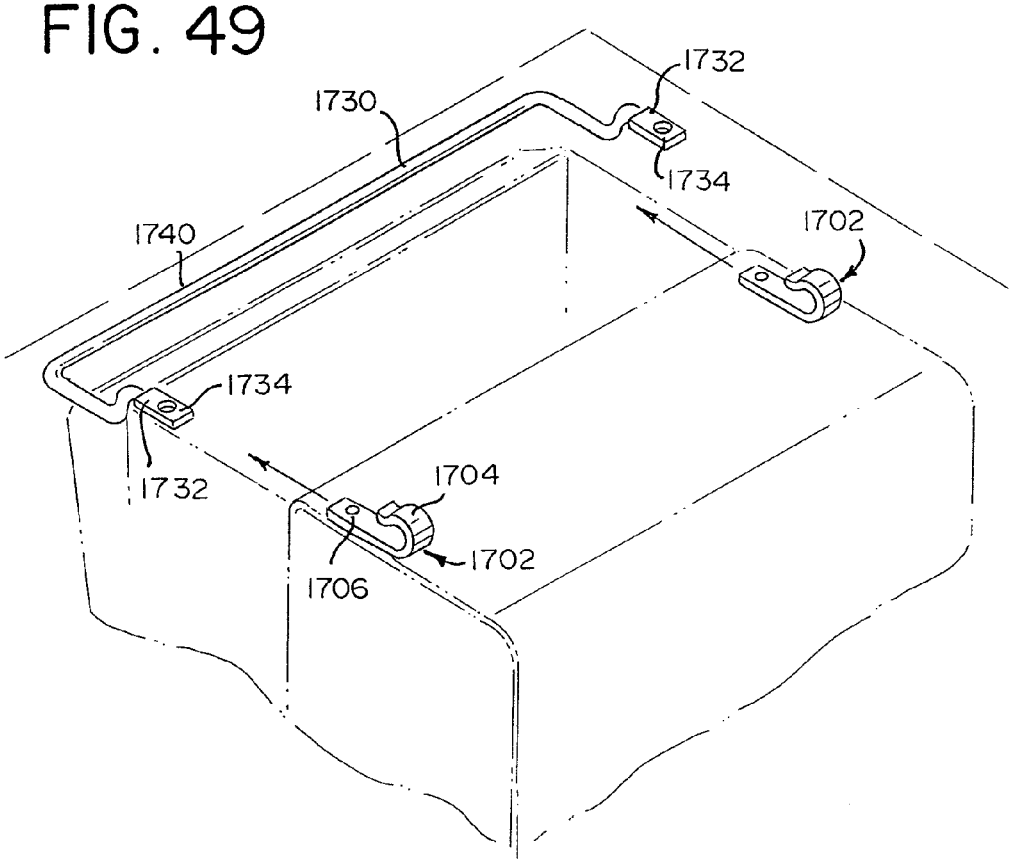
FIGS. 49 and 50 illustrate a work bag and connection member useful with the worksurfaces illustrated in FIGS. 1A-E.
Figure 50:
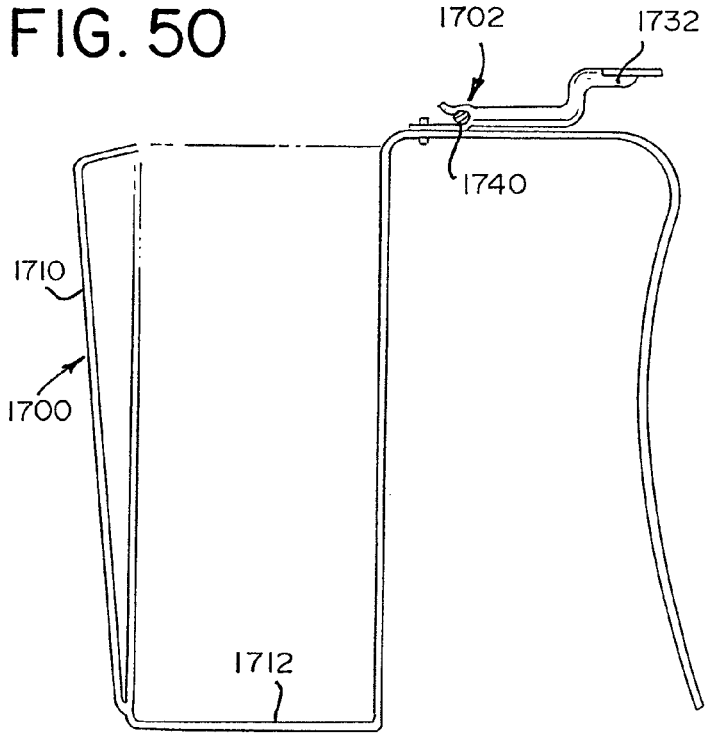

FIGS. 49 and 50 illustrate a file bag 1700 useful with the present invention. The file bag 1700 includes clips 1702. Clips 1702 include a curved upper portion 1704 and an aperture 1706 for use with a conventional securing means. The file bag 1700 includes a front cover 1710 and an interior space 1712 in which files and work materials may be stored. The bracket 1730 can be attached to the bottom surface of a work surface. The bracket 1730 includes end portions 1732 having apertures 1734. A conventional securing means such as a screw can be placed through the aperture 1734 into the bottom surface of a work surface in order to secure the bracket 1730 thereto. The bracket 1730 includes an extended intermediate portion 1740 for attachment to the clip 1702. The attachment of the clip 1702 to the bracket 1730 is illustrated in FIG. 50. The bag 1700 is particularly useful for a worker who desires to easily transport work materials and yet store them in a secure location such as beneath a work surface 60 as illustrated in FIGS. 1A-E.

The embodiments described above and shown herein are illustrative and not restrictive. The scope of the invention is indicated by the claims rather than by the foregoing description and attached drawings. The invention may be embodied in other specific forms without departing from the spirit of the invention. Accordingly, these and any other changes which come within the scope of the claims are intended to be embraced herein.

We claim:

1. A system for defining a plurality of work zones within an otherwise open area comprising:

a framework formed from a plurality of spaced apart poles extending upward from a base surface, the poles interconnected by a plurality of crossbeams, of which at least one is pivotal and adjustable in length, the framework capable of being configured in groups of from one to six poles with a plurality of the groups having one or more work surfaces attached thereto in order to form a work area for a user;

wherein at least some of the poles have two crossbeams extending from a top portion thereof, the two connection members extending at an angle substantially greater than 90° and substantially less than 180°, and at least some of the poles and crossbeams are adapted to provide a raceway for the delivery of utilities.

2. The system of claim 1, wherein the poles have an outer surface having three distinct and generally curved portions.

3. The system of claim 2, wherein a vertically extending channel separates each of the three generally curved portions.

4. The system of claim 3, wherein at least one of the vertically extending channels is adapted to receive a hook attachment member extending from a work environment element.

5. The system of claim 4, wherein the hook attachment member is adapted to attach a work surface to a pole.

6. The system of claim 5, wherein the vertically extending channel has a dovetail shape.

7. The system of claim 6, wherein the poles have a height substantially greater than six feet.

8. A system for defining a plurality of work zones within an otherwise open area comprising:

a first group and a second group of spaced apart poles extending upward from a base surface, the poles interconnected by a plurality of crossbeams at a height substantially above a standing user, at least some of the poles adapted to provide a raceway for the delivery of utilities, each pole capable of being attached to one or more crossbeams with most groups of two crossbeams forming an obtuse angle, the first group and the second group interconnected by a crossbeam adjustable in length.

9. The system of claim 8, wherein the cross-beam is pivotable.

10. The system of claim 6, wherein at least some of the poles are adapted to be attached to a work environment element selected from the group consisting of work surfaces, storage members, monitor support members, and dividing screens.

11. The system of claim 10 further comprising movable work surfaces having a plurality of legs with wheels attached to a bottom portion thereof.

12. The system of claim 11, wherein the poles have an outer surface having three distinct and generally curved portions.

13. The system of claim 12, wherein a vertically extending channel separates each of the three generally curved portions.

14. The system of claim 13, wherein at least one of the vertically extending channels includes a plurality of spaced apart apertures formed in two vertically extending columns.

15. The system of claim 14, wherein the vertically extending channel has a dovetail shape.

* * * * *